US012624542B2

(12) United States Patent
Brekke et al.

(10) Patent No.: US 12,624,542 B2
(45) Date of Patent: May 12, 2026

(54) HANGER FOR FIRE SEPARATION WALL

(71) Applicant: Columbia Insurance Company, Omaha, NE (US)

(72) Inventors: Steven Brekke, Lakeville, MN (US); Mark R Rolf, Fredericksburg, VA (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 18/492,460

(22) Filed: Oct. 23, 2023

(65) Prior Publication Data

US 2024/0052624 A1 Feb. 15, 2024

Related U.S. Application Data

(63) Continuation of application No. 18/112,843, filed on Feb. 22, 2023, now Pat. No. 11,920,339, which is a continuation of application No. 17/235,349, filed on Apr. 20, 2021, now Pat. No. 11,649,626, which is a continuation of application No. 16/433,799, filed on Jun. 6, 2019, now Pat. No. 11,021,867, which is a continuation of application No. 16/225,517, filed on Dec. 19, 2018, now Pat. No. 10,316,510, which is a continuation of application No. 15/675,409, filed on Aug. 11, 2017, now Pat. No. 10,184,242, which is a continuation of application No. 14/555,049, filed on Nov. 26, 2014, now Pat. No. 10,024,049.

(Continued)

(51) Int. Cl.
*E04B 1/26* (2006.01)

(52) U.S. Cl.
CPC ..... *E04B 1/2612* (2013.01)

(58) Field of Classification Search
CPC ..... E04B 1/2612; E04B 1/2608; E04B 5/12; E04B 7/06
USPC ..... 52/708
See application file for complete search history.

(56) References Cited

U.S. PATENT DOCUMENTS 414,169 A 10/1889 Reuschel
478,163 A 7/1892 Lehman
(Continued)

FOREIGN PATENT DOCUMENTS

EP 0210744 B1 2/1991
GB 2062058 A 5/1981
(Continued)

OTHER PUBLICATIONS

Oxford University Press, Inc., The New Oxford American Dictionary, second edition, definition of "manufacture", 2005, 4 pages.
(Continued)

*Primary Examiner* — James M Ference
(74) *Attorney, Agent, or Firm* — Stinson LLP

(57) ABSTRACT

A hanger for connecting a structural component to a wall that can have sheathing mounted thereon either before or after the hanger is connected to the wall. The hanger includes a channel-shaped portion configured to receive the structural component. An extension portion extends from the channel-shaped portion and is configured to extend through the sheathing to engage the wall at a first location. A connection portion is configured for attachment to the wall at a second location spaced from the first location.

22 Claims, 43 Drawing Sheets

Related U.S. Application Data

(60) Provisional application No. 61/922,531, filed on Dec. 31, 2013.

(56) References Cited

U.S. PATENT DOCUMENTS 537,504 A 4/1895 Dorn
546,147 A 9/1895 Gregg
598,135 A 2/1898 Butz
625,427 A 5/1899 Stewart et al.
666,918 A 1/1901 Butz
717,316 A 12/1902 Avery
753,053 A 2/1904 Eberhardt
770,050 A 9/1904 Dreyer
783,807 A 2/1905 Tuteur
784,218 A * 3/1905 Lane ..... E04B 1/2608 403/384
796,433 A 8/1905 Kahn
804,451 A 11/1905 Carlson
828,488 A 8/1906 Lanz
874,514 A 12/1907 Lindow
922,215 A 5/1909 Tuteur
924,842 A 6/1909 Seipp
943,847 A 12/1909 Seipp
1,368,699 A 2/1921 Collins
1,406,723 A 2/1922 Caldwell
1,728,981 A 9/1929 Ropp
1,792,815 A 2/1931 Chapin
3,088,558 A 5/1963 Dickinson
3,125,785 A 3/1964 Conville
3,298,651 A 1/1967 Passer
3,601,428 A 8/1971 Gilb
3,633,950 A 1/1972 Gilb
3,752,512 A 8/1973 Gilb
3,867,802 A 2/1975 Murphy
3,885,363 A 5/1975 Whittey
3,907,445 A 9/1975 Wendt
3,945,741 A 3/1976 Wendt
3,972,169 A 8/1976 Sheppard, Jr.
3,989,398 A * 11/1976 Wendt ..... F16B 9/058 403/230
4,005,942 A 2/1977 Gilb
4,196,556 A 4/1980 Russo
4,198,175 A 4/1980 Knepp et al.
4,223,866 A 9/1980 Black
4,230,416 A 10/1980 Gilb
4,261,155 A 4/1981 Gilb
4,353,664 A 10/1982 Gilb
4,411,548 A 10/1983 Tschan
4,422,792 A 12/1983 Gilb
4,423,977 A 1/1984 Gilb
4,472,916 A 9/1984 Krebs
4,480,941 A 11/1984 Gilb et al.
4,560,301 A 12/1985 Gilb
4,584,813 A 4/1986 Hudson
4,594,017 A 6/1986 Hills
4,665,672 A 5/1987 Commins et al.
4,696,113 A 9/1987 Rice
4,709,527 A 12/1987 Cooley
4,714,372 A * 12/1987 Commins ..... E04B 1/2608 52/92.2
4,717,279 A 1/1988 Commins
4,827,684 A 5/1989 Allan
4,893,961 A 1/1990 O'Sullivan et al.
4,920,725 A 5/1990 Gore
5,004,369 A 4/1991 Young
5,104,252 A 4/1992 Colonias et al.
5,111,632 A 5/1992 Tumer
5,160,211 A 11/1992 Gilb
5,217,317 A 6/1993 Young
5,220,766 A 6/1993 Hills, Sr.
5,230,198 A 7/1993 Callies
5,237,613 A 8/1993 Berry et al.
5,249,404 A 10/1993 Leek et al.
5,341,619 A 8/1994 Dunagan et al.
5,423,156 A 6/1995 Nellessen, Jr.
5,457,928 A 10/1995 Sahnazarian
5,555,694 A 9/1996 Commins
5,564,248 A 10/1996 Callies
5,603,580 A 2/1997 Leek et al.
5,697,725 A 12/1997 Ballash et al.
5,797,694 A 8/1998 Breivik
5,836,131 A 11/1998 Viola et al.
5,896,721 A 4/1999 Sugiyama
6,112,495 A 9/2000 Gregg et al.
6,131,358 A 10/2000 Wise
6,135,687 A 10/2000 Leek et al.
6,230,466 B1 5/2001 Pryor
6,272,951 B1 8/2001 Lambson
6,463,711 B1 10/2002 Callies
6,658,806 B1 12/2003 Leek
6,877,291 B2 4/2005 Shamroukh et al.
7,316,098 B1 1/2008 Sackett
7,707,785 B2 5/2010 Lin
7,971,410 B2 7/2011 Jerke
8,205,402 B1 6/2012 diGirolamo et al.
8,347,581 B2 1/2013 Doerr et al.
8,387,333 B2 3/2013 Brekke
8,677,718 B2 3/2014 Marshall
8,720,155 B1 5/2014 Robell
9,151,058 B1 10/2015 Leathe
9,206,594 B1 12/2015 Grevious et al.
9,228,338 B2 1/2016 Lin
9,290,926 B2 3/2016 Sidhu
9,394,680 B2 7/2016 Bundy et al.
9,790,684 B2 10/2017 Neumayr
9,938,709 B2 4/2018 Daudet et al.
10,214,897 B2 2/2019 Tan
11,021,867 B2 * 6/2021 Brekke ..... E04B 1/2612
11,065,667 B2 7/2021 Daudet et al.
11,142,902 B2 10/2021 Evans et al.
11,225,787 B2 1/2022 Evans et al.
11,560,707 B2 1/2023 Tiramani et al.
11,920,339 B2 * 3/2024 Brekke ..... E04B 1/2612
2001/0054270 A1 12/2001 Rice
2002/0078656 A1 6/2002 Leek et al.
2002/0104279 A1 8/2002 Beliveau
2002/0148191 A1 10/2002 Hynes
2003/0009980 A1 * 1/2003 Shahnazarian ..... E04B 1/2608 52/746.1
2004/0096269 A1 5/2004 Shahnazarian
2004/0129845 A1 7/2004 Whale et al.
2005/0120669 A1 6/2005 Harrison
2005/0155307 A1 7/2005 Timony
2006/0081743 A1 4/2006 Evans et al.
2006/0156682 A1 7/2006 McAndrew et al.
2006/0191233 A1 8/2006 Tamlyn
2007/0011959 A1 1/2007 DeBene
2007/0119108 A1 5/2007 Downard
2007/0294979 A1 12/2007 Lin et al.
2008/0101855 A1 5/2008 Lin
2008/0134620 A1 6/2008 Contasti
2008/0237421 A1 10/2008 Szpotowski
2009/0056268 A1 3/2009 Greenlee et al.
2009/0113839 A1 5/2009 Carr
2010/0031601 A1 2/2010 Lin
2011/0047806 A1 3/2011 Harrison
2011/0146173 A1 6/2011 Visser
2012/0219785 A1 8/2012 Yu
2012/0222382 A1 9/2012 Brekke
2012/0285020 A1 11/2012 Brown
2012/0297724 A1 11/2012 Pope et al.
2013/0047539 A1 2/2013 Katsalidis
2013/0067850 A1 3/2013 Sasanecki
2013/0133284 A1 5/2013 Powers, III
2013/0232758 A1 9/2013 Pond
2014/0338282 A1 11/2014 Sidhu
2015/0059259 A1 3/2015 Hatzinikolas
2015/0167291 A1 6/2015 Bundy et al.
2015/0184370 A1 7/2015 Brekke et al.
2015/0218832 A1 8/2015 Peters et al.
2017/0321418 A1 11/2017 Tremblay
2019/0136520 A1 5/2019 Daudet

(56) References Cited

U.S. PATENT DOCUMENTS

| | | | | |
|---|---|---|---|---|
| 2021/0396000 | A1 | 12/2021 | Evans et al. | |
| 2022/0243455 | A1 | 8/2022 | Evans et al. | |
| 2024/0052624 | A1* | 2/2024 | Brekke | E04B 1/2612 |

FOREIGN PATENT DOCUMENTS

| | | | |
|---|---|---|---|
| GB | 2433522 | A | 6/2007 |
| GB | 2451853 | A | 2/2009 |
| IE | 56802 | | 12/1991 |
| JP | H3-14482 | | 3/1991 |
| JP | H0314482 | Y2 | 3/1991 |
| JP | 05171718 | A | 7/1993 |
| JP | H70229225 | A | 8/1995 |
| JP | D1213894 | | 6/2004 |
| JP | 1226744 | S | 12/2004 |
| JP | 1226745 | S | 12/2004 |
| JP | D1226422 | S | 12/2004 |
| JP | D1226744 | S | 12/2004 |
| JP | D1226745 | S | 12/2004 |
| WO | 0106068 | A1 | 1/2001 |
| WO | 008035098 | A2 | 3/2008 |
| WO | 2012060863 | A2 | 5/2012 |
| WO | 2013126987 | A1 | 9/2013 |
| WO | 2017069993 | A1 | 4/2017 |

OTHER PUBLICATIONS

Columbia Insurance Company, Patent Owner's Exhibit 2066—Blank renderings of the Hanger Shown in Figs. 5-7, Before the Patent Trial and Appeal Board, Case No. PGR2021-00109, 2 pages.
Simpson Strong-Tie Company Inc., Wood Construction Connectors 2013-2014 Catalog, 106 pages.
Dr. Reynaud Serrette, Fourth Declaration, Before the Patent Trial and Appeal Board, Case No. PGR2021-00109, Dec. 16, 2022, 56 pages.
Deposition Transcript of William Andrew Fennell, Before the Patent Trial and Appeal Board, Case No. PGR2021-00109, Dec. 8, 2022, 125 pages.
Columbia Insurance Company, Patent Owner's Reply in Support of Its Revised Contingent Motion to Amend Under 35 CFR 42.221, Before the Patent Trial and Appeal Board, Case No. PGR2021-00109, Dec. 16, 2022, 23 pages.
Deposition Transcript of Dr. Reynaud Serrette, Before the Patent Trial and Appeal Board, Case No. PGR2021-00109, Dec. 29, 2022, 83 pages.
Simpson Strong-Tie Company Inc., Petitioner's Sur-Reply to Patent Owner's Reply to Petitioner's Opposition to the Patent Owner's Revised Contingent Motion to Amend, Before the Patent Trial and Appeal Board, Case No. PGR2021-00109, Jan. 6, 2023, 21 pages.
Columbia Insurance Company, Patent Owner's Demonstratives, Before the Patent Trial and Appeal Board, Case No. PGR2021-00109, Jan. 2023, 94 pages.
Simpson Strong-Tie Company Inc., Petitioner's Demonstratives for Oral Argument, Before the Patent Trial and Appeal Board, Case No. PGR2021-00109, Jan. 2023, 69 pages.
Record of Oral Hearing held Jan. 17, 2023, Before the Patent Trial and Appeal Board, Case No. PGR2021-00109, 78 pages.
Appellant Simpson Strong-Tie Company Inc.'s Principal Brief, dated Oct. 16, 2023, U.S. Court of Appeals for the Federal Circuit, *Simpson Strong-Tie Company Inc.* v. *Columbia Insurance Company*, Case No. 2023-1944, 306 pages.
Final Written Decision of the Patent Trial and Appeal Board, *Simspon Strong-Tie Company Inc.* v. *Columbia Insurance Company*, PGR2021-00109, U.S. Pat. No. 11,021,867B2, Paper 73, dated Mar. 15, 2023, 165 pages.
Appellee Columbia Insurance Company's Brief, dated Nov. 27, 2023, U.S. Court of Appeals for the Federal Circuit, *Simspon Strong-Tie Company Inc.* v. *Columbia Insurance Company*, Case No. 2023-1944, 87 pages.
Decision Granting Institution of Post-Grant Review 35 U.S.C.324, Paper 7, entered Mar. 22, 2024, U.S. Patent and Trademark Office, Before the Patent Trial and Appeal Board, *Simspon Strong-Tie Company Inc.* v. *Columbia Insurance Company*, No. PGR2023-00047, U.S. Pat. No. 11,649,626 B2, 87 pages.
Decision Granting Institution of Post-Grant Review 35 U.S.C.324, Paper 7, entered Mar. 22, 2024, U.S. Patent and Trademark Office, Before the Patent Trial and Appeal Board, *Simspon Strong-Tie Company Inc.* v. *Columbia Insurance Company*, No. PGR2023-00048, U.S. Pat. No. 11,649,626 B2, 63 pages.
Decision Granting Institution of Post-Grant Review 35 U.S.C.324, Paper 7, entered Mar. 22, 2024, U.S. Patent and Trademark Office, Before the Patent Trial and Appeal Board, *Simspon Strong-Tie Company Inc.* v. *Columbia Insurance Company*, No. PGR2023-00049, U.S. Pat. No. 11,649,626 B2, 63 pages.
Invalidity Claim Chart, U.S. Pat. No. 11,021,867, Exhibit A-1 to Simpson Strong-Tie Company, Inc.'s Invalidity Contentions Pursuant to Patent Local Rules 3-3 and 3-4, dated Oct. 20, 2023, 17 pp.
Invalidity Claim Chart, U.S. Pat. No. 11,021,867, Exhibit A-2 to Simpson Strong-Tie Company, Inc.'s Invalidity Contentions Pursuant to Patent Local Rules 3-3 and 3-4, dated Oct. 20, 2023, 14 pp.
Invalidity Claim Chart, U.S. Pat. No. 11,021,867, Exhibit A-3 to Simpson Strong-Tie Company, Inc.'s Invalidity Contentions Pursuant to Patent Local Rules 3-3 and 3-4, dated Oct. 20, 2023, 18 pp.
Invalidity Claim Chart, U.S. Pat. No. 11,021,867, Exhibit A-4 to Simpson Strong-Tie Company, Inc.'s Invalidity Contentions Pursuant to Patent Local Rules 3-3 and 3-4, dated Oct. 20, 2023, 22 pp.
Invalidity Claim Chart, U.S. Pat. No. 11,021,867, Exhibit A-5 to Simpson Strong-Tie Company, Inc.'s Invalidity Contentions Pursuant to Patent Local Rules 3-3 and 3-4, dated Oct. 20, 2023, 9 pp.
Invalidity Claim Chart, U.S. Pat. No. 11,021,867, Exhibit A-6 to Simpson Strong-Tie Company, Inc.'s Invalidity Contentions Pursuant to Patent Local Rules 3-3 and 3-4, dated Oct. 20, 2023, 7 pp.
Invalidity Claim Chart, U.S. Pat. No. 11,649,626, Exhibit B-1 to Simpson Strong-Tie Company, Inc.'s Invalidity Contentions Pursuant to Patent Local Rules 3-3 and 3-4, dated Oct. 20, 2023, 58 pp.
Invalidity Claim Chart, U.S. Pat. No. 11,649,626, Exhibit B-2 to Simpson Strong-Tie Company, Inc.'s Invalidity Contentions Pursuant to Patent Local Rules 3-3 and 3-4, dated Oct. 20, 2023, 27 pp.
Invalidity Claim Chart, U.S. Pat. No. 11,649,626, Exhibit B-3 to Simpson Strong-Tie Company, Inc.'s Invalidity Contentions Pursuant to Patent Local Rules 3-3 and 3-4, dated Oct. 20, 2023, 3 pp.
Invalidity Claim Chart, U.S. Pat. No. 11,649,626, Exhibit B-4 to Simpson Strong-Tie Company, Inc.'s Invalidity Contentions Pursuant to Patent Local Rules 3-3 and 3-4, dated Oct. 20, 2023, 67 pp.
Invalidity Claim Chart, U.S. Pat. No. 11,649,626, Exhibit B-5 to Simpson Strong-Tie Company, Inc.'s Invalidity Contentions Pursuant to Patent Local Rules 3-3 and 3-4, dated Oct. 20, 2023, 76 pp.
Invalidity Claim Chart, U.S. Pat. No. 11,649,626, Exhibit B-6 to Simpson Strong-Tie Company, Inc.'s Invalidity Contentions Pursuant to Patent Local Rules 3-3 and 3-4, dated Oct. 20, 2023, 4 pp.
Invalidity Claim Chart, U.S. Pat. No. 11,649,626, Exhibit B-7 to Simpson Strong-Tie Company, Inc.'s Invalidity Contentions Pursuant to Patent Local Rules 3-3 and 3-4, dated Oct. 20, 2023, 43 pp.
Invalidity Claim Chart, U.S. Pat. No. 11,649,626, Exhibit B-8 to Simpson Strong-Tie Company, Inc.'s Invalidity Contentions Pursuant to Patent Local Rules 3-3 and 3-4, dated Oct. 20, 2023, 4 pp.
Invalidity Claim Chart, U.S. Pat. No. 11,649,626, Exhibit B-9 to Simpson Strong-Tie Company, Inc.'s Invalidity Contentions Pursuant to Patent Local Rules 3-3 and 3-4, dated Oct. 20, 2023, 60 pp.
Invalidity Claim Chart, U.S. Pat. No. 11,649,626, Exhibit B-10 to Simpson Strong-Tie Company, Inc.'s Invalidity Contentions Pursuant to Patent Local Rules 3-3 and 3-4, dated Oct. 20, 2023, 5 pp.
Invalidity Contentions, Simpson Strong-Tie Company, Inc.'s Invalidity Contentions Pursuant to Patent Local Rules 3-3 and 3-4, dated Oct. 20, 2023, 15 pp.
Complaint for Patent Infringement; Jury Trial Requested, dated May 17, 2023, U.S. District Court, Northern District of California, *Columbia Insurance Co. and MiTek Inc.* v. *Simpson Strong-Tie Company Inc.*, 562 pages.
"Fully-loaded Getting the Most from Sloped and Skewed W Hangers", Connector Update, vol. 2, No. 3, Nov. 1990, 2 pages.

(56) References Cited

OTHER PUBLICATIONS

Declaration of W. Andrew Fennell in Support of Petition for Post-Grant Review of U.S. Pat. No. 11,649,626, dated Aug. 15, 2023, U.S. Patent Trial and Appeal Board, *Simspon Strong-Tie Company Inc.* v. *Columbia Insurance Company*, Case PGR2023-00047, 226 pages.
Petition for Post-Grant Review of U.S. Pat. No. 11,649,626, dated Aug. 17, 2023, U.S. Patent Trial and Appeal Board, *Simspon Strong-Tie Company Inc.* v. *Columbia Insurance Company*, Case PGR2023-00047, 203 pages.
Declaration of W. Andrew Fennell in Support of Petition for Post-Grant Review of U.S. Pat. No. 11,649,626, dated Aug. 17, 2023, U.S. Patent Trial and Appeal Board, *Simspon Strong-Tie Company Inc.* v. *Columbia Insurance Company*, Case PGR2023-00048, 260 pages.
Petition for Post-Grant Review of U.S. Pat. No. 11,649,626, dated Aug. 17, 2023, U.S. Patent Trial and Appeal Board, *Simspon Strong-Tie Company Inc.* v. *Columbia Insurance Company*, Case PGR2023-00048, 227 pages.
Declaration of W. Andrew Fennell in Support of Petition for Post-Grant Review of U.S. Pat. No. 11,649,626, dated Aug. 15, 2023, U.S. Patent Trial and Appeal Board, *Simspon Strong-Tie Company Inc.* v. *Columbia Insurance Company*, Case PGR2023-00049, 225 pages.
Petition for Post-Grant Review of U.S. Pat. No. 11,649,626, dated Aug. 17, 2023, U.S. Patent Trial and Appeal Board, *Simspon Strong-Tie Company Inc.* v. *Columbia Insurance Company*, Case PGR2023-00049, 197 pages.
Complaint for Patent Infringement, Case No. 3:19-cv-04683, filed Aug. 12, 2019, pp. 6.
Plaintiffs' Notice of Motion and Motion for Preliminary Injunction; Memorandum of Points and Authorities in Support of Motion, Case No. 3:19-cv-04683, filed Aug. 12, 2019, pp. 20.
Installer's Pocket Guide, Simpson Strong-Tie Company, Inc. (2009), pp. 60.
Top-Flange Joist Hangers Installed on Walls Over Wood Structural Panel Sheathing or Drywall, Technical Bulletin, Simpson Strong-Tie Company, Inc. (2013), pp. 2.
S/LBV / S/B and S/BA Hangers, Simpson Strong-Tie Company, Inc. (2010), pp. 1.
Cold-Formed Steel Connectors for Residential and Mid-Rise Construction (C-CFS10), Simpson Strong-Tie Company, Inc. (2010) pp. 76.
Wood Construction Connectors Catalog 2013-2014 (C-2013), Simpson Strong-Tie Company, Inc. pp. 236.
Declaration of Dr. Reynaud Serrette, filed as Exhibit 2001 in Case No. PGR2019-00063 on Dec. 13, 2019, 124 pages.
Curriculum Vitae of Reynaud L. Serrette, Ph.D., filed as Exhibit 2002 in Case No. PGR2019-00063 on Dec. 13, 2019, 15 pages.
American Institute of Timber Construction, Timber Construction Manual, Fourth Edition, 1994, filed as Exhibit 2015 in Case No. PGR2019-00063 on Dec. 13, 2019, 17 pages.
International Code Council, International Building Code, 2012, filed as Exhibit 2016 in Case No. PGR2019-00063 on Dec. 13, 2019, 57 pages.
International Code Council, International Building Code, 2000, filed as Exhibit 2017 in Case No. PGR2019-00063 on Dec. 13, 2019, 60 pages.
MiTek, Fire Wall Hangers FWH Series, Structural Connectors Specification Sheet, 2019, tiled as Exhibit 2018 in Case No. PGR2019-00063 on Dec. 13, 2019, 2 pages.
Simpson Strong-Tie, DU/DHU/DHUTF Drywall Hangers Specification Sheet, filed as Exhibit 2019 in Case No. PGR2019-00063 on Dec. 13, 2019, 7 pages.
ICC-ES Evaluation Report, Mar. 2019, filed as Exhibit 2021 in Case No. PGR2019-00063 on Dec. 13, 2019, 18 pages.
Definition of From, The New Oxford American Dictionary, Second Edition, 2005, filed as Exhibit 2022 in Case No. PGR2019-00063 on Dec. 13, 2019, 4 pages.
Gypsum Association, Gypsum Panel Products Types, Uses, Sizes, and Standards, 2004, filed as Exhibit 2023 in Case No. PGR2019-00063 on Dec. 13, 2019, 2 pages.
PABCO Gypsum, for Those About to Rock PABCO Gypsum Products, filed as Exhibiti 2024 in Case No. PGR2019-00063 on Dec. 13, 2019, 8 pages.
Beall, C., "Fire Ratings of Masonry Walls," 1989, filed as Exhibit 2025 in Case No. PGR2019-00063 on Dec. 13, 2019, 3 pages.
Bilow, D. N., et al., "Fire and Concrete Structures," 2008, filed as Exhibit 2026 in Case No. PGR2019-00063 on Dec. 13, 2019, 10 pages.
Irish Concrete Federation, Comprehensive Fire Protection and Safety with Concrete, Dec. 2007, filed as Exhibit 2027 in Case No. PGR2019-00063 on Dec. 13, 2019, 33 pages.
MontgomeryTownship Department of Planning and Zoning, Basement Finish/Remodel Code, 2009, filed as Exhibit 2028 in Case No. PGR2019-00063 on Dec. 13, 2019, 5 pages.
Township of Hillsborough, Sample Guide for Finish Basement Requirements in Existing One and Two Family Dwellings, Jan. 30, 2012, filed as Exhibit 2029 in Case No. PGR2019-00063 on Dec. 13, 2019, 5 pages.
Lstiburek, J., "Understanding Basements," Building Science Digest 103, filed as Exhibit 2030 in Case No. PGR2019-00063 on Dec. 13, 2019, 18 pages.
Moisture Control in Buildings: The Key Factor in Mold Prevention, 2nd Edition, 2009, filed as Exhibit 2031 in Case No. PGR2019-00063 on Dec. 13, 2019, 67 pages.
U.S. Department of Agriculture, Forest Service, Wood-Frame House Construction, Agriculture Handbook No. 73, Apr. 1975, filed as Exhibit 2032 in Case No. PGR2019-00063 on Dec. 13, 2019, 12 pages.
CEL Consulting, Inc., Testing of Joist Hangers per AC13 "Acceptance Criteria for Joist Hangers and Similar Devices," filed as Exhibit 2033 in Case No. PGR2019-00063 on Dec. 13, 2019, 17 pages.
Patent Owner's Preliminary Response to the Petition for Post Grant Review filed in Case No. PGR2019-00063 on Dec. 13, 2019, 120 pages.
Petitioner Simpson Strong-Tie Company Inc.'s Reply to Patent Owner's Preliminary Response filed in Case No. PGR2019-00063 on Feb. 10, 2020, 9 pages.
Supplemental Declaration of W. Andrew Fennell in Support of Petitioner's Reply to Patent Owner's Preliminary Response filed in Case No. PGR2019-00063 on Feb. 10, 2020, 6 pages.
Minutes of Telephonic Meeting Held on Jan. 30, 2020, filed in Case No. PGR2019-00063 on Jan. 30, 2020, 29 pages.
Order Denying Plaintiffs' Motion for Preliminary Injunction, Case No. 3:19-w-04683, filed Oct. 4, 2019, pp. 20.
Reply in Support of Plaintiffs' Notice of Motion and Motion for Preliminary Injunction; Memorandum of Points and Authorities in Support of Motion, Case No. 3:19-cv-04683, filed Sep. 13, 2019, pp. 18.
Answer, Affirmative Defenses, and Counterclaim to Complaint for Patent Infringement, Case No. 3:19-cv-04683, filed Sep. 3, 2019, pp. 8.
Memorandum of Points and Authorities in Opposition to Motion for Preliminary Injunction, Case No. 3:19-cv-04683, filed Sep. 5, 2019, pp. 31.
Declaration of W. Andrew Fennell in Support of Opposition to Motion for Preliminary Injunction, Case No. 3:19-cv-04683, filed Sep. 5, 2019, pp. 91.
Declaration of Sam Hensen in Support of Opposition to Motion for Preliminary Injunction, Case No. 3:19-cv-04683 filed Sep. 5, 2019, pp. 8.
Investigation of U.S. Appl. No. 16/225,517, Exhibit A to Declaration of W. Andrew Fennell in Support of Opposition to Motion for Preliminary Injunction, Case No. 3:19-cv-04683,dated Jun. 3, 2019, pp. 68.
Declaration of Joseph V. Mauch in Support of Opposition to Motion for Preliminary Injunction, Case No. 3:19-cv-04683, filed Sep. 5, 2019, pp. 4.

(56) References Cited

OTHER PUBLICATIONS

Invalidity Claim Chart, U.S. Pat. No. 10,316,510, Exhibit E to Declaration of Joseph V. Mauch in Support of Opposition to Motion for Preliminary Injunction, Case No. 3:19-cv-04683, dated Sep. 2019, pp. 30.
Invalidity Claim Chart, U.S. Pat. No. 10,316,510, Exhibit F to Declaration of Joseph V. Mauch in Support of Opposition to Motion for Preliminary Injunction, Case No. 3:19-cv-04683, dated Sep. 2019, pp. 30.
Invalidity Claim Chart, U.S. Pat. No. 10,316,510, Exhibit G to Declaration of Joseph V. Mauch in Support of apposition to Motion for Preliminary Injunction, Case No. 3:19-cv-04683, dated Sep. 2019, pp. 32.
Invalidity Claim Chart, U.S. Pat. No. 10,316,510, Exhibit H to Declaration of Joseph V. Mauch in Support of Opposition to Motion for Preliminary Injunction, Case No. 3:19-cv-04683, dated Sep. 2019, pp. 32.
Petition for Post-Grant Review of U.S. Pat. No. 10,316,510, filed Sep. 5, 2019, pp. 152.
Declaration of W. Andrew Fennell in Support of Petition for Post-Grant Review of U.S. Pat. No. 10,316,510, Exhibit 1003 , dated Sep. 5, 2019, pp. 172.
Fire-Rated Assemblies in Commercial Construction, Exhibit 1016 to Petition for Post-Grant Review of U.S. Pat. No. 10,316,510, dated May 2014, pp. 106.
Fire Resistance Design Manual Sound Control, Exhibit 1017 to Petition for Post-Grant Review of U.S. Pat. No. 10,316,510, dated Jun. 2012, pp. 230.
International Building Code, Exhibit 1018 to Petition for Post-Grant Review of U.S. Pat. No. 10,316,510, dated May 2011, pp. 12.
Stainless steel for durability, fire-resistance and safety, Exhibit 1030 to Petition for Post-Grant Review of U.S. Pat. No. 10,316,510, pp. 8.
Infringement Claim Charts, Exhibit 1031 to Petition for Post-Grant Review of U.S. Pat. No. 10,316,510, dated Aug. 2019, pp. 20.
Pages of Oxford Compact English Dictionary—Simpson Strong-Tie Company Inc. EX 1037, published in 2000, pp. 6.
Corrected Opening Brief of Appellant in the Appeal of PGR2019-00063, dated Nov. 12, 2021, pp. 292.
U.S. Patent and Trademark Office Decision Granting Institution of Post-Grant Review, U.S. Patent Trial and Appeal Board, *Simspon Strong-Tie Company Inc.* v. *Columbia Insurance Company*, Case No. PGR2021-00109, U.S. Pat. No. 11,021,867 B2, Paper 42, dated Mar. 17, 2022, 89 pages.
Columbia Insurance Company, Patent Owner's Preliminary Response to the Petition for Post Grant Review, Before the Patent Trial and Appeal Board, Case No. PGR2021-00109, Dec. 21, 2021, 119 pp.
Dr. Reynaud Serrette, Declaration, Before the Patent Trial and Appeal Board, Case No. PGR2021-00109, Dec. 21, 2021, 95 pp.
Reynaud Serrette, Ph.D. Curriculum Vitae, undated, 15 pp.
Columbia Insurance Company, Request for Issuance of Certificate of Correction, U.S. Pat. No. 11,021,867, Dec. 2, 2021, 12 pp.
International Code Council (ICC), 2012 International Building Code, May 2011, 70 pp.
ASTM International, Designation: E119-12a, Standard Test Methods for Fire Tests of Building Construction and Materials, Sep. 2012, 34 pp.
ASTM International, Designation: E814-13, Standard Test Method for Fire Tests of Penetration Firestop Systems, Nov. 2013, 12 pp.
Simpson Strong-Tie Company Inc., DU/DHU/DHUTF, Fire Wall Hangers, 2021, 2 pp.
W. Andrew Fennell, Declaration in Support of Petitioner's Reply and Opposition to Patent Owner's Contingent Motion to Amend, Before the Patent Trial and Appeal Board, Case No. PGR2019-00063, Aug. 27, 2020.  Unsigned .
Cooperative Patent Classification, Section E04B, Fixed Constructions, Building: General Building Constructions; Walls, e.g. Partitions; Roofs; Floors; Ceilings; Insulation or Other Protection of Buildings, Aug. 2021, 13 pp.
U.S. Patent and Trademark Office, Response for Certificate of Correction, Decision on Request filed Dec. 2, 2021, U.S. Pat. No. 11,021,867, Dec. 23, 2021, 2 pp.
U.S. Patent and Trademark Office, Certificate of Correction, U.S. Pat. No. 11,021,867, dated Dec. 28, 2021, 1 page.
Columbia Insurance Company, Patent Owner's Response to the Petition for Post Grant Review, Before the Patent Trial and Appeal Board, Jun. 9, 2022, 135 pp.
Columbia Insurance Company, Patent Owner's Contingent Motion to Amend Under 37 C.F.R. 42.221, Before the Patent Trial and Appeal Board, Jun. 9, 2022, 51 pp.
Ed Sauter, Tilt-Up Concrete Association, Tilt-Up Today, Connections in Tilt-Up Buildings, Jul. 1, 2008, 5 pp.
Hanley Wood University, Continuing Education course: Multifamily, Mid-Rise Buildings Using Wood Construction, a Cost-Effective and Sustainable Choice for Achieving High-Performance Goals, undated, 10 pp.
U.S. Dept. of Housing and Urban Development Office of Policy Development and Research, Review of Structural Materials and Methods for Home Building in the United States: 1900 to 2000, Jan. 25, 2001, 48 pp.
Whole Building Design Guide (WBDG), Strategies and Trends for Mid-Rise Construction in Wood, Mar. 10, 2017, 21 pp.
Simpson Strong-Tie Company, Inc., Fastening Systems Technical Guide, 2019, 164 pp.
Rob Thallon, Graphic Guide to Frame Construction, 4th ed, rev./updated, 2016, 258 pp.
Deposition Transcript of W. Andrew Fennell, Before the Patent Trial and Appeal Board, Case No. PGR2021-00109, May 25, 2022, 72 pp.
Deposition Transcript of W. Andrew Fennell, Before the Patent Trial and Appeal Board, Case No. PGR2019-00063, May 14, 2020, vol. 1, 61 pp.
Dr. Reynaud Serrette, Supplemental Declaration, Before the Patent Trial and Appeal Board, Case No. PGR2021-00109, Jun. 9, 2022, 88 pp.
Simpson Strong-Tie Company, Inc., Petitioner's Reply to Patent Owner's Response, Before the Patent Trial and Appeal Board, Case No. PGR2021-00109, Sep. 1, 2022, 39 pp.
Simpson Strong-Tie Company, Inc., Petitioner's Opposition to Patent Owner's Contingent Motion to Amend, Before the Patent Trial and Appeal Board, Case No. PGR2021-00109, Sep. 1, 2022, 33 pp.
Deposition Transcript of Dr. Reynaud Serrette, Before the Patent Trial and Appeal Board, Case No. PGR2021-00109, Aug. 22, 2022, vol. 1, 270 pp.
Brick Industry Association, Technical Notes on Brick Construction: Fire Resistance of Brick Masonry, Mar. 16, 2008, 16 pp.
W. Andrew Fennell, Declaration in Support of Petitioner's Reply to Patent Owner's Response and Petitioner's Opposition to Patent Owner's Contingent Motion to Amend, Before the Patent Trial and Appeal Board, Case No. PGR2021-00109, Sep. 1, 2022, 87 pp.
PABCO Gypsum, QuietRockES product specifications, 2013, 1 page.
National Timber Development Council and Forest and Wood Products Research and Development Corporation (FWPRDC), Multi-Residential Timber Framed Construction, Design Construction Manual, Class1a Buildings, Jun. 2000, 44 pp.
United States Gypsum Company (USG), Sheetrock Brand MH UltraLight Panels TUF-BASE, 2013, 2 pp.
Sterling Publishing, Woodframe Houses: Construction and Maintenance, 1981, excerpt from pp. 68, 115, and 127, 5 pp.
Scott A. Daniels, Neil T. Powell and Stephen E. Belisle, Administrative Law Judges, Preliminary Guidance Patent Owner's Motion to Amend, Before the Patent Trial and Appeal Board, Case No. PGR2021-00109, undated, 17 pp.
Columbia Insurance Company, Revised Contingent Motion to Amend Under 35 C.F.R. 42.221, Before the Patent Trial and Appeal Board, Case No. PGR2021-00109, Oct. 13, 2022, 53 pp.
Columbia Insurance Company, Sur-Reply to the Petition for Post Grant Review, Before the Patent Trial and Appeal Board, Case No. PGR2021-00109, Oct. 13, 2022, 39 pp.
Deposition Transcript of W. Andrew Fennell, Before the Patent Trial and Appeal Board, Case No. PGR2021-00109, Oct. 5, 2022, 78 pp.

(56) References Cited

OTHER PUBLICATIONS

Dr. Reynaud Serrette, Third Declaration, Before the Patent Trial and Appeal Board, Case No. PGR2021-00109, Oct. 13, 2022, 14 pp.
Simpson Strong-Tie Company, Inc., Responsive Brief and Opening Cross-Appeal Brief, United States Court of Appeals for the Federal Circuit, Case Nos. 21-2145 and 21-2157, Feb. 3, 2022, 101 pp.
Columbia Insurance Company, Appellant's Response and Reply Brief, United States Court of Appeals for the Federal Circuit, Case Nos. 21-2145, 21-2157, Apr. 29, 2022, 70 pp.
Simpson Strong-Tie Company, Inc., Reply Brief, United States Court of Appeals for the Federal Circuit, Case Nos. 21-2145, 21-2157, Jun. 10, 2022, 41 pp.
Columbia Insurance Company, Patent Owner's Revised Contingent Motion to Amend Under 37 CFR 42.221, Before the Patent Trial and Appeal Board, Case No. PGR2021-00109, Oct. 13, 2022, 53 pages (including Appendix).
Columbia Insurance Company, Patent Owner's Sur-Reply to the Petition for Post-Grant Review, Before the Patent Trial and Appeal Board, Case No. PGR2021-00109, Oct. 13, 2022, 39 pages.
Deposition Transcript of W. Andrew Fennell, Before the Patent Trial and Appeal Board, Case No. PGR2021-00109, Oct. 5, 2022, 78 pages.
Dr. Reynaud Serrette, Third Declaration, Before the Patent Trial and Appeal Board, Case No. PGR2021-00109, Oct. 13, 2022, 14 pages.
Simpson Strong-Tie Company Inc., Petitioner's Opposition to Patent Owner's Revised Contingent Motion to Amend, Before the Patent Trial and Appeal Board, Case No. PGR2021-00109, Nov. 23, 2022, 34 pages.
W. Andrew Fennell's Declaration in Support of Petitioner's Opposition to Patent Owner's Revised Contingent Motion to Amend, Before the Patent Trial and Appeal Board, Case No. PGR2021-00109, Nov. 23, 2022, 65 pages.
Preliminary Guidance, Columbia Insurance Company, Patent Owner's Motion to Amend, Before the Patent Trial and Appeal Board, Case No. PGR2021-00109, Sep. 26, 2022, 17 pages.
Decision Granting Institution of Post-Grant Review issued in Case No. PGR2019-00063 on Mar. 12, 2020, 63 pages.
Patent Owner's Sur-Reply filed in Case No. PGR2019-00063 on Feb. 20, 2020, 10 pages.
Patent Owner's Corrected Sur-Reply filed in Case No. PGR2019-00063 on Mar. 3, 2020, 9 pages.
Supplemental Declaration of W. Andrew Fennell in Support of Petitioner's Reply to Patent Owner's Preliminary Response filed as Exhibit 1036 in Case No. PGR2019-00063 on Feb. 10, 2020, 6 pages.
Supplemental Declaration of Dr. Reynaud Serrette, filed as Exhibit 2034 in Case No. PGR2019-00063 on Feb. 19, 2020, 5 pages.
Trimber, K. A., et al., "Measuring Moisture in Walls," Interface, Apr. 2012, filed as Exhibit 2035 in Case No. PGR2019-00063 on Feb. 19, 2020, 8 pages.
U.S. Department of Housing and Urban Development, Office of Policy Development and Research, Building Concrete Masonry Homes: Design and Construction Issues, filed as Exhibit 2036 in Case No. PGR2019-00063 on Feb. 19, 2020, 43 pages.
CGC Inc., The Gypsum Construction Handbook, Centennial Edition, 2005, filed as Exhibit 2037 in Case No. PGR2019-00063 on Feb. 19, 2020, 34 pages.
Clarkwestern Dietrich Building Systems LLC, Furring Channel/Hat Channel, filed as Exhibit 2038 in Case No. PGR2019-00063 on Feb. 19, 2020, 3 pages.
ASTM International, Standard Specification for Testing and Establishing Allowable Loads of Joist Hangers, Designation: D7147-11, filed as Exhibit 2039 in Case No. PGR2019-00063 on Feb. 19, 2020, 10 pages.
APA, Floor Construction, an Excerpt of the Engineered Wood Construction Guide, Dec. 2019, filed as Exhibit 2040 in Case No. PGR2019-00063 on Feb. 19, 2020, 16 pages.
International Code Council, 2012 International Building Code, 2011, filed as Exhibit 2041 in Case No. PGR2019-00063 on Feb. 19, 2020, 17 pages.
Supplemental Declaration of Dr. Reynaud Serrette, filed as Exhibit 2042 in Case No. PGR2019-00063 on Feb. 26, 2020, 5 pages.
Petitioner Simpson Strong Tie Company Incs Opposition to Patent Owners Contingent Motion to Amend, Case PGR2019-00063, U.S. Pat. No. 10,316,510, Aug. 27, 2020, 30 pages.
Petitioner Simpson Strong Tie Company Incs Reply to Patent Owners Response, Case PGR2019-00063, U.S. Pat. No. 10,316,510, Aug. 27, 2020, 35 pages.
Exhibit 1038 Serrette Deposition Transcript, Case PGR2019-00063, Jul. 29, 2020, 272 pages.
Exhibit 1039 Fennell Declaration, Case PGR2019-00063, U.S. Pat. No. 10,316,510, Aug. 27, 2020, 28 pages.
Exhibit 1040 Definition, 7 pages.
*Simspon Strong-Tie Company Inc.* v. *Columbia Insurance Company* Case PGR2019-00063, Exhibit 1044—Deposition of Dr. Reynaud Serrette, Dec. 22, 2020, 116 pages.
*Simspon Strong-Tie Company Inc.* v. *Columbia Insurance Company* Case PGR2019-00063, Petitioner's Sur-Reply to Patent Owner's Reply to Petitioner's Opposition to Patent Owner's Revised Contingent Motion to Amend, Dec. 31, 2020, 17 pages.
*Simspon Strong-Tie Company Inc.* v. *Columbia Insurance Company* Case PGR2019-00063, Exhibit 2058—Patent Owner's Notice of Submission of Demonstrative Exhibits for Jan. 14, 2021 Oral Hearing, Jan. 11, 2021, 83 pages.
*Simspon Strong-Tie Company Inc.* v. *Columbia Insurance Company* Case PGR2019-00063, Exhibit 1045—Petitioner's Demonstratives for Oral Argument, Jan. 14, 2021, 77 pages.
Patent Owner's Response to the Petition for Post Grant Review filed in Case No. PGR2019-00063 on Jun. 4, 2020, 115 pages.
Patent Owner's Contingent Motion to Amend Under 37 C.F.R. Section 42.221 filed in Case No. PGR2019-00063 on Jun. 4, 2020, 41 pages.
Videoconference Deposition of W. Andrew Fennell filed as Exhibit 2043 in Case No. PGR2019-00063 on Jun. 4, 2020, 61 pages.
Third Supplemental Declaration of Dr. Reynaud Serrette filed as Exhibit 2044 in Case No. PGR2019-00063 on Jun. 4, 2020, 44 pages.
International Code Council, 2012 International Building Code, 2011, filed as Exhibit 2045 in Case No. PGR2019-00063 on Jun. 4, 2020, 6 pages.
Buchanan, A. H., Structural Design for Fire Safety, 2001, filed as Exhibit 2046 in Case No. PGR2019-00063 on Jun. 4, 2020, 99 pages.
ASTIM International, Standard Test Methods for Fire Tests of Building Construction and Materials, E119-19, filed as Exhibit 2047 in Case No. PGR2019-00063 on Jun. 4, 2020, 37 pages.
American Wood Council, Calculating the Fire Resistance of Exposed Wood Members, Technical Report 10, American Forest & Paper Association, filed as Exhibit 2048 in Case No. PGR2019-00063 on Jun. 4, 2020, 55 pages.
New Oxford American Dictionary, Second Edition, Definition of "through," filed as Exhibit 2049 in Case No. PGR2019-00063 on Jun. 4, 2020, 2 pages.
McEntee, P., "What You Should Know About the New DGH Fire Wall Hanger Options," Feb. 2018, filed as Exhibit 2050 in Case No. PGR2019-00063 on Jun. 4, 2020, 3 pages.
Memorandum of Points and Authorities in Opposition to Motion for Preliminary Injunction filed as Exhibit 2051 in Case No. PGR2019-00063 on Jun. 4, 2020, 31 pages.
*Simspon Strong-Tie Company Inc.* v. *Columbia Insurance Company* Case PGR2019-00063, Preliminary Guidance Patent Owner's Motion to Amend, Sep. 21, 2020, 12 pages.
*Simspon Strong-Tie Company Inc.* v. *Columbia Insurance Company* Case PGR2019-00063, Patent Owner's Sur-Reply, Oct. 8, 2020, 37 pages.
*Simspon Strong-Tie Company Inc.* v. *Columbia Insurance Company* Case PGR2019-00063, Revised Motion to Amend, Oct. 8, 2020, 43 pages.
*Simspon Strong-Tie Company Inc.* v. *Columbia Insurance Company* Case PGR2019-00063, Petitioner Simpson Strong-Tie Company Inc.'s Opposition to Patent Owner's Revised Contingent Motion to Amend, Nov. 19, 2020, 31 pages.

(56) References Cited

OTHER PUBLICATIONS

*Simspon Strong-Tie Company Inc.* v. *Columbia Insurance Company* Case PGR2019-00063, Patent Owner's Reply in Support of Its Revised Motion to Amend, Dec. 10, 2020, 21 pages.
*Simspon Strong-Tie Company Inc.* v. *Columbia Insurance Company* Case PGR2019-00063, Exhibit 1042—Declaration of W. Andrew Fennell in Support of Petitioner's Reply and Opposition to Patent Owner's Revised Contingent Motion to Amend, Nov. 19, 2020, 31 pages.
*Simspon Strong-Tie Company Inc.* v. *Columbia Insurance Company* Case PGR2019-00063, Exhibit 1043—Blank Rrendering of Tsukamoto Reference, 1 page.
*Simspon Strong-Tie Company Inc.* v. *Columbia Insurance Company* Case PGR2019-00063, Exhibit 2054—Sheet Metal Stamping 101 Parts I-V, 39 pages.
*Simspon Strong-Tie Company Inc.* v. *Columbia Insurance Company* Case PGR2019-00063, Exhibit 2055—Declaration of Dr. Serrette in Support of the Revised Contingent Motion to Amend, Oct. 7, 2020, 12 pages.
*Simspon Strong-Tie Company Inc.* v. *Columbia Insurance Company* Case PGR2019-00063, Exhibit 2056—ANSI/AISC 360-10 Specification for Structural Steel Buildings, Jun. 22, 2010, 35 pages.
*Simspon Strong-Tie Company Inc.* v. *Columbia Insurance Company* Case PGR2019-00063, Declaration of Dr. Reynaud Serrette in Support of the Reply to the Opposition to the Revised Contingent Motion to Amend, Dec. 10, 2020, 57 pages.
*Simspon Strong-Tie Company Inc.* v. *Columbia Insurance Company* Case PGR2019-00063, Final Written Decision, Mar. 1, 2021, 143 pages.
*Simspon Strong-Tie Company Inc.* v. *Columbia Insurance Company* Case PGR2019-00063, Record of Oral Hearing, Jan. 14, 2021, 73 pages.
Petitioner's Request for Rehearing of The Final Written Decision filed in Case No. PGR2019-00063 on Apr. 12, 2021, 17 pages.
*Simspon Strong-Tie Company Inc.* v. *Columbia Insurance Company* Case PGR2019-00063, Decision Denying Petitioner's Request on Rehearing of Final Written Decision, May 21, 2021, 9 pages.
Post Grant Review Petition of U.S. Pat. No. 11,021,867 dated Aug. 13, 2021, pp. 137.
Declaration of W. Andrew Fennell in Support of Petition for Post-Grant Review of U.S. Pat. No. 11,021,867 dated Aug. 13, 2021, pp. 155.
U.S. Court of Appeals for the Federal Circuit, Opinion dated Mar. 31, 2023, *Columbia Insurance Company* v. *Simpson Strong-Tie Company, Inc.*, Appeal Nos. 2021-2145, 2021-2157, 19 pages.
Declaration of W. Andrew Fennell in Support of Petition for Post-Grant Review of U.S. Pat. No. 11,920,339 dated Aug. 29, 2024, 336 pages.
Woodworks, Design Example, Four-Story Wood-Frame Structure Over Podium Slab, no later than Aug. 29, 2024, 52 pages.
ASTM International, Standard Specification for Gypsum Board (Designation: C 1396 / C 1396M-01) Sep. 2001, 3 pages.
Ferguson, Myron R., Revised & Updated Drywall, Professional Techniques for Great Results, 4th Edition, 2012, 241 pages.
Architectural Record, "Mass Timber and Wood Framing", Nov. 2021, vol. 200, No. 11, 9 pages.
ASTM International, Standard Specification for Application and Finishing of Gypsum Board (Designation: C 840-00) May 2001, 6 pages.
Merriam Webster's Collegiate Dictionary, 10th Edition, 1993, pp. 135 and 891, 6 pages.
The Gypsum Construction Handbook, 6th Edition, USG Corporation, 2009, 36 pages.
Mass Timber and Wood Framing, New and traditional approaches reduce cost and meet code for mid-rise construction, Architectural Record, Nov. 2012, 2 pages.
Architectural Record, Wikipedia, Aug. 2012, (http://web.archive.org/web/20121205045301/http://www.architecturalrecord.com/) 1 page.
Columbia Insurance Company's Response to the Petition for Post Grant Review, U.S. Patent Trial and Appeal Board, Case No. PGR2023-00047, dated Jun. 14, 2024, 48 pages.
Columbia Insurance Company's Response to the Petition for Post Grant Review, U.S. Patent Trial and Appeal Board, Case No. PGR2023-00048, dated Jun. 21, 2024, 48 pages.
Columbia Insurance Company's Response to the Petition for Post Grant Review, U.S. Patent Trial and Appeal Board, Case No. PGR2023-00049, dated Jun. 14, 2024, 51 pages.
Declaration of W. Andrew Fennell in Support of Petitioner's Reply to Patent Owner Response, U.S. Patent Trial and Appeal Board, Case No. PGR2023-00047, Sep. 5, 2024, 41 pages.
Simpson Strong-Tie Company, Inc.'s Reply to Patent Owner's Response, U.S. Patent Trial and Appeal Board, Case No. PGR2023-00047, dated Sep. 6, 2024, 36 pages.
Declaration of W. Andrew Fennell in Support of Petitioner's Reply to Patent Owner Response, U.S. Patent Trial and Appeal Board, Case No. PGR2023-00048, Sep. 5, 2024, 41 pages.
Simpson Strong-Tie Company, Inc.'s Reply to Patent Owner's Response, U.S. Patent Trial and Appeal Board, Case No. PGR2023-00048, dated Sep. 6, 2024, 36 pages.
Declaration of W. Andrew Fennell in Support of Petitioner's Reply to Patent Owner Response, U.S. Patent Trial and Appeal Board, Case No. PGR2023-00049, Sep. 5, 2024, 47 pages.
Simpson Strong-Tie Company, Inc.'s Reply to Patent Owner's Response, U.S. Patent Trial and Appeal Board, Case No. PGR2023-00049, dated Sep. 6, 2024, 39 pages.
Simpson Strong-Tie Company, Inc.'s Petition for Post-Grant Review of U.S. Pat. No. 11,920,339, U.S. Patent Trial and Appeal Board, Case No. PGR2024-00050, Aug. 30, 2024, 209 pages.
Columbia Insurance Company's Sur-Reply to the Petition for Post Grant Review, U.S. Patent Trial and Appeal Board, Case No. PGR2023-00047, dated Oct. 18, 2024, 10 pages.
Columbia Insurance Company's Sur-Reply to the Petition for Post Grant Review, U.S. Patent Trial and Appeal Board, Case No. PGR2023-0048, dated Oct. 18, 2024, 10 pages.
Columbia Insurance Company's Sur-Reply to the Petition for Post Grant Review, U.S. Patent Trial and Appeal Board, Case No. PGR2023-00049, dated Oct. 18, 2024, 14 pages.
Columbia Insurance Company's Preliminary Response to the Petition for Post Grant Review, U.S. Patent Trial and Appeal Board, Case No. PGR2024-00050, dated Dec. 20, 2024, 166 pages.
Declaration of Richard T. Kaczkowski, U.S. Patent Trial and Appeal Board, Case No. PGR2024-00050, dated Dec. 20, 2024, 181 pages.
Curriculum Vitae of Richard Kaczkowski, 2024, 6 pages.
Simpson Strong-Tie Company Inc., Wood Construction Connectors, "DGT/DGHT, Fire Wall Hangers," 2024, pp. 245-247.
Simpson Strong-Tie Company Inc., Engineered Wood & Structural Composite Lumber Connectors, "Top Flange Hangers LBV/BA/B/HB I-Joist & Structural Composite Lumber Hangers," 2011, p. 110.
Merriam-Webster's Collegiate Dictionary, 11th Ed., 2003, Definition of "Bound", p. 146.
New Oxford American Dictionary, 2nd Ed., 2005, Definition of "Bound", pp. 199-200.
Simpson Strong-Tie Company Inc., "New Fire Wall Hangers Optimized for Power Nailers," 2023, pp. 1-4.
Simpson Strong-Tie Company Inc., "DGHT Top-Flange Fire Wall Hanger," specifically for Wall Hangers for Plated Truss (Material: 10 gauge), 2024, https://www.strongtie.com/firewallhangers_hangersforplatedtruss/dght_hanger/p/dght, 8 pages.
Simpson Strong-Tie Company Inc., "DGT Top-Flange Fire Wall Hanger," specifically for Wall Hangers for Plated Truss (Material: 12 gauge), 2024, https://www.strongtie.com/firewallhangers_hangersforplatedtruss/dght_hanger/p/dght, 8 pages.
Simpson Strong-Tie Co., Inc. Design No. SST/WPCF 120-01, Fire Resistant Joist Hanger, DG Series Fire Wall Hanger, Astm E814, Rating: 2 Hour F & T Rating, Jul. 25, 2017, 1 page.
Simpson Strong-Tie Company Inc., "Your Go-To, Load-Rated Fire Wall Hanger," 2018, 4 pages.
Simpson Strong-Tie Company Inc., "Allowable Loads for the DG and DGH hanger installed on walls over wood structural panel sheathing," Jun. 4, 2018, 1 page.

(56) References Cited

OTHER PUBLICATIONS

Simpson Strong-Tie Company Inc., " DGH Fire Wall Hanger Now Available Skewed or with Offset Top Flange," Dec. 1, 2017, 1 page.
Simpson Strong-Tie Company Inc., Wood Construction Connectors, "DG/DGB/DGH Fire Wall Hangers," 2019, 3 pages.
Merriam-Webster's Collegiate Dictionary, 11th Ed., 2003, Definition of "Outwardly", 4 pages.
New Oxford American Dictionary, 2nd Ed., 2005, Definition of "Outward," 4 pages.
Merriam-Webster's Collegiate Dictionary, 11th Ed., 2003, Definition of "Close", 4 pages.
New Oxford American Dictionary, 2nd Ed., 2005, Definition of "Close," 4 pages.
Merriam-Webster's Collegiate Dictionary, 11th Ed., 2003, Definition of "Conform", 4 pages.
New Oxford American Dictionary, 2nd Ed., 2005, Definition of "Conformance", 4 pages.
International Code Council, 2012 International Building Code, 2011, Definition of "Fire Wall," p. 21, 10 pages.
MiTek Press Releases, 2022-2013, https://www.mitek-US.com/about/press-releases/, 11 pages.
Business Wire, MiTek USA, Jul. 22, 2014, "MiTek's new FWH Fire Wall Hanger Attaches Floor Framing to 2-hour Fire Rated Wall Assemblies in Wood-Frame Construction," 3 pages.
Mitek, USP Structural Connectors 2015-2016 Product Catalog, 10 pages.
U.S. Dept. of Agriculture, Forest Service, Agriculture Handbook 73, "Wood-Frame House Construction," Chapter 6—Working Inside, Sep. 1989, pp. 166-189, 28 pages.
Decision Granting Institute of Post-Grant Review, *Simpson Strong-Tie Company, Inc.* v. *Columbia Insurance Company*, Case No. PGR2024-00050, U.S. Patent and Trademark Office, Patent Trial and Appeal Board, Feb. 26, 2025, 100 pages.
Judgment, Final Written Decision Determining Some Challenged Claims Unpatentable 35 U.S.C. 328(a), *Simpson Strong-Tie Company Inc.* v. *Columbia Insurance Company*, No. PGR2023-00047, No. PGR2023-00048, No. PGR2023-00049, Feb. 28, 2025, 81 pages.
Redacted Second Declaration of Richard T. Kaczkowski, Exhibit 2050, *Simpson Strong-Tie Company Inc.* v. *Columbia Insurance Company*, U.S. Patent and Trademark Office, Patent Trial and Appeal Board, Case No. PGR2024-0050, May 27, 2025, 287 pages.
Redacted Declaration of Paul D. Tucker, Exhibit 2051, *Simpson Strong-Tie Company* v. *Columbia Insurance Company*, U.S. Patent and Trademark Office, Patent Trial and Appeal Board, Case No. PGR2024-00050, May 27, 2025, 306 pages.
Declaration of Thomas J. Irmiter, Exhibit 2052, *Simpson Strong-Tie Company* v. *Columbia Insurance Company*, U.S. Patent and Trademark Office, Patent Trial and Appeal Board, Case No. PGR2024-00050, May 27, 2025, 41 pages.
Declaration of Andrea T. Baranyk, Exhibit 2053, *Simpson Strong-Tie Company* v. *Columbia Insurance Company*, U.S. Patent and Trademark Office, Patent Trial and Appeal Board, Case No. PGR2024-00050, May 27, 2025, 27 pages.
Expert Report of Michael Alley Regarding MiTek Patented Features, Exhibit 2054, *Simpson Strong-Tie Company* v. *Columbia Insurance Company*, U.S. Patent and Trademark Office, Patent Trial and Appeal Board, Case No. PGR2024-00050, May 16, 2025, 89 pages.
Redacted Declaration of Dwight J. Duncan, CFA, Exhibit 2055, *Simpson Strong-Tie Company* v. *Columbia Insurance Company*, U.S. Patent and Trademark Office, Patent Trial and Appeal Board, Case No. PGR2024-00050, May 26, 2025, 32 pages.
Declaration of Matthew Church, Exhibit 2056, *Simpson Strong-Tie Company* v. *Columbia Insurance Company*, U.S. Patent and Trademark Office, Patent Trial and Appeal Board, Case No. PGR2024-00050, May 22, 2025, 5 pages.
Declaration of Joe Dunkle, Exhibit 2057, Simpson Strong-Tie Company v. Columbia Insurance Company, U.S. Patent and Trademark Office, Patent Trial and Appeal Board, Case No. PGR2024-00050, May 21, 2025, 5 pages.
Declaration of Ryan Holmes, Exhibit 2058, *Simpson Strong-Tie Company* v. *Columbia Insurance Company*, U.S. Patent and Trademark Office, Patent Trial and Appeal Board, Case No. PGR2024-00050, May 23, 2025, 4 pages.
Redacted Declaration of Michael Nelson, Exhibit 2059, *Simpson Strong-Tie Company* v. *Columbia Insurance Company*, U.S. Patent and Trademark Office, Patent Trial and Appeal Board, Case No. PGR2024-00050, May 23, 2025, 96 pages.
Declaration of Chris Horwitz, Exhibit 2060, *Simpson Strong-Tie Company* v. *Columbia Insurance Company*, U.S. Patent and Trademark Office, Patent Trial and Appeal Board, Case No. PGR2024-00050, May 27, 2025, 37 pages.
Transcript of Deposition of W. Andrew Fennell, Exhibit 2061, *Simpson Strong-Tie Company* v. *Columbia Insurance Company*, U.S. Patent and Trademark Office, Patent Trial and Appeal Board, Case No. PGR2024-00050, May 14, 2025, 98 pages.
Transcript of Videotaped Deposition of Sam Hensen, Exhibit 2065, *Columbia Insurance Company, et al.* v. *Simpson Strong-Tie Company, Inc.*, U.S. District Court, N.D. of California, Case No. 3:19-CV-04683-TSH, Mar. 17, 2025, 130 pages.
Transcript of Videotaped Deposition of Bryan Wert, Exhibit 2067, *Columbia Insurance Company, et al.* v. *Simpson Strong-Tie Company, Inc.*, U.S. District Court, N.D. of California, Case No. 3:19-CV-04683-TSH, Apr. 16, 2025, 86 pages.
Transcript of Videotaped Deposition of Mark Rolf, Exhibit 2070, *Columbia Insurance Company, et al.* v. *Simpson Strong-Tie Company, Inc.*, U.S. District Court, N.D. of California, Case No. 3: 19-CV-04683-TSH, Jan. 31, 2025, 65 pages.
Declaration of Sam Hensen in Support of Defendant's Opposition to Plaintiffs' Motion for Preliminary Injunction, Exhibit 2074, *Columbia Insurance Company, et al.* v. *Simpson Strong-Tie Company, Inc.*, U.S. District Court, N.D. of California, Case No. 3:19-CV-04683-TSH, Sep. 5, 2019, 8 pages.
Expert Report of Nathan Hoffmann, PE, Exhibit 2076, *Columbia Insurance Company, et al.* v. *Simpson Strong-Tie Company, Inc.*, U.S. District Court, N.D. of California, Case No. 3:19-CV-04683-TSH, Feb. 14, 2025, 19 pages.
Oxford University Press, The New Oxford American Dictionary, Second Ed., Definition of "Open", 2005, Exhibit 2084, *Columbia Insurance Company, et al.* v. *Simpson Strong-Tie Company, Inc.*, U.S. District Court, N.D. of California, Case No. 3: 19-CV-04683-TSH, 5 pages.
Merriam-Webster, Incorporated, Merriam Webster's Collegiate Dictionary, 11th Ed., Definition of "Opening", 2003, Exhibit 2085, *Columbia Insurance Company, et al.* v. *Simpson Strong-Tie Company, Inc.*, U.S. District Court, N.D. of California, Case No. 3:19-CV-04683-TSH, 4 pages.
USP Structural Connectors, FWH Fire Wall Hanger, Exhibit 2091, *Columbia Insurance Company, et al.* v. *Simpson Strong-Tie Company, Inc.*, U.S. District Court, N.D. of California, Case No. 3:19-CV-04683-TSH, Apr. 21, 2014, 7 pages.
MiTek USP Structural Connectors, Fire Wall Hangers, FWH Series, Exhibit 2132, *Columbia Insurance Company, et al.* v. *Simpson Strong-Tie Company, Inc.*, U.S. District Court, N.D. of California, Case No. 3:19-CV-04683-TSH, Oct. 2019, 2 pages.
Simpson Emails re MiTek Usp Fwh Fire Wall Hanger, Exhibit 2140, *Columbia Insurance Company, et al.* v. *Simpson Strong-Tie Company, Inc.*, U.S. District Court, N.D. of California, Case No. 3:19-CV-04683-TSH, 2015, 2 pages.
Transcript of Deposition of William Andrew Fennell, Exhibit 2143, *Columbia Insurance Company, et al.* v. *Simpson Strong-Tie Company, Inc.*, U.S. District Court, N.D. of California, Case No. 3:19-CV-04683-TSH, Apr. 15, 2025, 45 pages.
International Code Council, 2012 International Building Code, Exhibit 2144, *Columbia Insurance Company, et al.* v. *Simpson Strong-Tie Company, Inc.*, U.S. District Court, N.D. of California, Case No. 3:19-CV-04683-TSH, May-Jun. 2011, 70 pages.
MiTek USP Product Catalog, FWH Fire Wall Hangers Top Mount, pp. 194-199, Exhibit 2146, *Columbia Insurance Company, et al.* v.

(56) References Cited

OTHER PUBLICATIONS

*Simpson Strong-Tie Company, Inc.*, U.S. District Court, N.D. of California, Case No. 3:19- CV-04683-TSH, 2020, 6 pages.
International Conference of Building Officials, Uniform Building Code 1967 Ed., vol. I, Exhibit 2149, *Columbia Insurance Company, et al.* v. *Simpson Strong-Tie Company, Inc.*, U.S. District Court, N.D. of California, Case No. 3:19- CV-04683-TSH, 1967, 591 pages.
APA—The Engineered Wood Association, Voluntary Product Standard, PS2-92, Performance Standard for Wood-Based Structural-Use Panels, Exhibit 2150, *Columbia Insurance Company, et al.* v. *Simpson Strong-Tie Company, Inc.*, U.S. District Court, N.D. of California, Case No. 3:19-CV-04683-TSH, Aug. 1992, 35 pages.
Fisette, P., University of Massachusetts-Amherst , Building and Construction Technology, The Evolution of Engineered Wood I-Joists, Exhibit 2152, *Columbia Insurance Company, et al.* v. *Simpson Strong-Tie Company, Inc.*, U.S. District Court, N.D. of California, Case No. 3:19-CV-04683-TSH, 2000, 12 pages.
Yeh, B., et al., APA-The Engineered Wood Association, Performance Standard Considerations for I-Joists Used in Residential Floor Construction, pp. 115-122, Exhibit 2153, *Columbia Insurance Company, et al.* v. *Simpson Strong-Tie Company, Inc.*, U.S. District Court, N.D. of California, Case No. 3:19-CV-04683-TSH, 8 pages.
APA-The Engineered Wood Association, Design/Construction Guide, Fire-Rated Systems, Exhibit 2154, *Columbia Insurance Company, et al.* v. *Simpson Strong-Tie Company, Inc.*, U.S. District Court, N.D. of California, Case No. 3:19- CV-04683-TSH, 1999, 24 pages.
ICC Evaluation Service, ICC-ES Evaluation Report, ESR-3444, Exhibit 2155, *Columbia Insurance Company, et al.* v. *Simpson Strong-Tie Company, Inc.*, U.S. District Court, N.D. of California, Case No. 3:19-CV-04683-TSH, rev. Dec. 2024, 37 pages.
ICC Evaluation Service, ICC-ES Evaluation Report, ESR-4464, Exhibit 2156, *Columbia Insurance Company, et al.* v. *Simpson Strong-Tie Company, Inc.*, U.S. District Court, N.D. of California, Case No. 3:19-CV-04683-TSH, rev. Apr. 2024, 12 pages.
ASTM International, Standard Test Method for Fire Tests of Through-Penetration Fire Stops, Designation E 814-06, Exhibit 2157, *Columbia Insurance Company, et al.* v. *Simpson Strong-Tie Company, Inc.*, U.S. District Court, N.D. of California, Case No. 3:19-CV-04683-TSH, 10 pages.
Mitek, Inc., MiTek FWH Fire Wall Hanger Installation Instructions, Exhibit 2158, *Columbia Insurance Company, et al.* v. *Simpson Strong-Tie Company, Inc.*, U.S. District Court, N.D. of California, Case No. 3:19-CV-04683-TSH, May 2023, 1 page.
Redacted Patent Owner's Response to the Petition for Post Grant Review, *Simpson Strong-Tie Company Inc.* v. *Columbia Insurance Company*, U.S. Patent and Trademark Office, Patent Trial and Appeal Board, Case No. PGR2024-00050, May 27, 2025, 156 pages.
Patent Owner's Contingent Motion to Amend Under 37 C.F.R. 42.221, *Simpson Strong-Tie Company Inc.* v. *Columbia Insurance Company*, U.S. Patent and Trademark Office, Patent Trial and Appeal Board, Case No. PGR2024-00050, May 27, 2025, 76 pages.
Nonprecedential Opinion, U.S. Court of Appeals for the Federal Circuit, *Simpson Strong-Tie Company, Inc.* v. *Columbia Insurance Company*, Case No. 2023-1944, Jan. 7, 2025, 17 pages.
ASTM International, Standard Test Method for Fire Tests of Penetration Firestop Systems, Designation: E814-13, Exhibit 2196, Nov. 1, 2013, 12 pages.
Redacted Third Declaration of Richard T. Kaczkowski, Exhibit 2198, *Simpson Strong-Tie Company Inc.* v. *Columbia Insurance Company*, U.S. Patent and Trademark Office, Patent Trial and Appeal Board, Case No. PGR2024-00050, Sep. 26, 2025, 34 pages.
Redacted Transcript of Deposition of William Andrew Fennell, Exhibit 2197, *Simpson Strong-Tie Company Inc.* v. *Columbia Insurance Company*, U.S. Patent and Trademark Office, Patent Trial and Appeal Board, Case No. PGR2024-00050, Sep. 18, 2025, 179 pages.
Petitioner's Opposition to Patent Owner's Revised Contingent Motion to Amend, *Simpson Strong-Tie Company Inc.* v. *Columbia Insurance Company*, U.S. Patent and Trademark Office, Patent Trial and Appeal Board, Case No. PGR2024-00050, Aug. 18, 2025, 54 pages.
Revised Preliminary Guidance, *Simpson Strong-Tie Company Inc.* v. *Columbia Insurance Company*, U.S. Patent and Trademark Office, Patent Trial and Appeal Board, Case No. PGR2024-00050, Sep. 11, 2025, 20 pages.
Preliminary Guidance, *Simpson Strong-Tie Company Inc.* v. *Columbia Insurance Company*, U.S. Patent and Trademark Office, Patent Trial and Appeal Board, Case No. PGR2024-00050, Sep. 10, 2025, 20 pages.
Redacted Petitioner's Reply to Patent Owner's Response, *Simpson Strong-Tie Company Inc.* v. *Columbia Insurance Company*, U.S. Patent and Trademark Office, Patent Trial and Appeal Board, Case No. PGR2024-00050, Aug. 18, 2025, 45 pages.
Transcript of Deposition of Sam Hensen, Exhibit 2199, *Simpson Strong-Tie Company Inc.* v. *Columbia Insurance Company*, U.S. Patent and Trademark Office, Patent Trial and Appeal Board, Case No. PGR2024-00050, Sep. 16, 2025, 137 pages.
ASTM International, Standard Test Methods for Fire Tests of Building Construction and Materials, Designation: E119-12a, Exhibit 2195, *Simpson Strong-Tie Company Inc.* v. *Columbia Insurance Company*, U.S. Patent and Trademark Office, Patent Trial and Appeal Board, Case No. PGR2024-00050, Jun. 17, 2020, 34 pages.

* cited by examiner

HANGER FOR FIRE SEPARATION WALL

CROSS-REFERENCE TO RELATED APPLICATIONS

This application is a continuation of U.S. application Ser. No. 18/112,843, filed Feb. 22, 2023, which is a continuation of U.S. application Ser. No. 17/235,349, filed Apr. 20, 2021, which is a continuation of U.S. application Ser. No. 16/433,799 filed Jun. 6, 2019, issued as U.S. Pat. No. 11,021,867 on Jun. 21, 2021, U.S. application Ser. No. 16/225,517 filed on Dec. 19, 2018, issued as U.S. Pat. No. 10,316,510 on Jun. 11, 2019, which is a continuation of U.S. application Ser. No. 15/675,409, filed Aug. 11, 2017, issued as U.S. Pat. No. 10,184,242 on Jan. 22, 2019, which is a continuation of U.S. application Ser. No. 14/555,049, filed Nov. 26, 2014, issued as U.S. Pat. No. 10,024,049 on Jul. 17, 2018, which claims priority to U.S. Provisional Application No. 61/922,531, filed Dec. 31, 2013, the entirety of which are incorporated herein by reference.

FIELD OF THE INVENTION

The present invention generally relates to connections for structures, and more specifically, a truss hanger for connecting a truss to a wall including fire retardant sheathing.

BACKGROUND

The use of fire separation walls in structures, such as in multifamily housing, is commonplace. Often, fire separation is required to be continuous along the walls between adjoining units to prevent fire from spreading between the adjoining units in a multifamily structure. For some types of construction, the building codes also require exterior walls to be fire rated. Typically, gypsum board is used as a fire retardant sheathing along these walls. Floor trusses or joists are attached to or hung from the walls including the gypsum board, but cannot be hung from the gypsum board itself. The trusses or joists must therefore be attached to the wall framing. A cutout for the entire cross section of the truss leaves a large discontinuity in the fire retardant sheathing. However, building codes require that the fire separation wall maintain a certain fire resistant rating. Thus, the integrity of the fire retardant sheathing should be maintained and interruptions of the sheathing kept to a minimum.

SUMMARY

In one aspect of the present invention, a hanger for connecting a structural component to a wall having sheathing mounted thereon includes a channel-shaped portion configured to receive the structural component. The channel shaped portion includes a bottom wall, side walls extending from opposite edges of the bottom wall and a back wall. The bottom wall, side walls and back wall are sized and arranged to receive an end of the structural component for supporting the end of the structural component. A connection portion includes a top flange extending away from the back wall of the channel-shaped portion in a direction opposite to the bottom wall of the channel-shaped portion. The top flange is configured for attachment to a top surface of a top plate of the wall. The connection portion further includes a back flange extending from an edge of the top flange in a direction toward the bottom wall of the channel-shaped portion. The back flange of the connection portion faces the back wall of the channel-shaped portion and the back flange and back wall define a space sized to receive the sheathing between the back flange and the back wall. An extension portion extends from the channel-shaped portion to the connection portion and interconnects the channel-shaped portion and the connection portion. The extension portion separates the back wall of the channel-shaped portion from the back flange of the connection portion to define the space sized to receive the sheathing.

In another aspect pf the present invention a hanger for connecting a structural component to a wall adapted to have sheathing mounted thereon generally comprises a channel-shaped portion configured to receive the structural component. An extension portion extends from the channel-shaped portion and is configured to extend through the sheathing to engage the wall at a first location. The extension portion includes extension flanges extending from the channel-shaped portion forming a bend between each extension flange and the channel-shaped portion. Each of the extension flanges is configured to extend through the sheathing. A connection portion is fixed in position relative to the channel-shaped portion such that that channel-shaped portion does not rotate relative to the connection portion. The connection portion is configured for attachment to the wall at a second location spaced from the first location. The extension flanges define planar surfaces disposed in opposed face-to-face relation between the connection portion and the channel-shaped portion.

In another aspect of the present invention, a truss hanger for connecting a truss to a wall adapted to have fire resistant sheathing mounted thereon generally comprises a channel-shaped portion configured to receive the truss. The channel-shaped portion includes a base sized and shaped for receiving a truss chord of the truss thereon, side panels extending upward from the base, and a back panel. The back panel extends orthogonally from one of the side panels. An extension portion extends from the channel-shaped portion and is configured to extend through the fire resistant sheathing. The extension portion includes extension flanges. Each of the extension flanges extends away from the base of the channel-shaped portion. A connection portion includes a top flange extending away from the back panel of the channel-shaped portion in a direction opposite to the base of the channel-shaped portion. The top flange is configured for attachment to a top surface of a top plate of the wall. The connection portion further includes a back flange extending from an edge of the top flange in a direction toward the base of the channel-shaped portion.

A hanger for connecting a structural component to a wall having sheathing mounted thereon generally comprises a channel-shaped portion configured to receive the structural component. An extension portion is configured to be disposed at least partially in the sheathing. A connection portion is configured for attachment to the wall.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
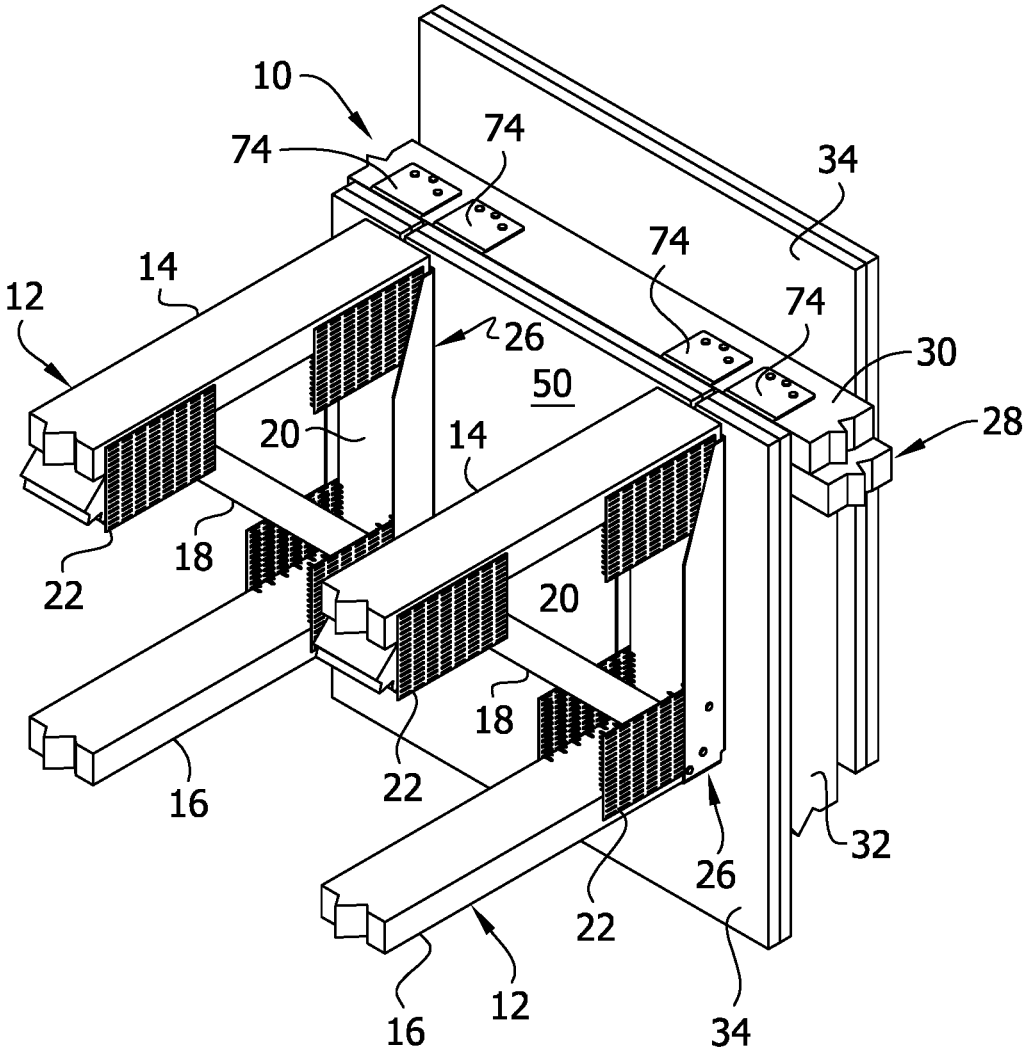
FIG. 1 is a fragmentary perspective of adjacent floor trusses connected to a wall having fire retardant sheathing by truss hangers that extend through the sheathing.
Figure 2:
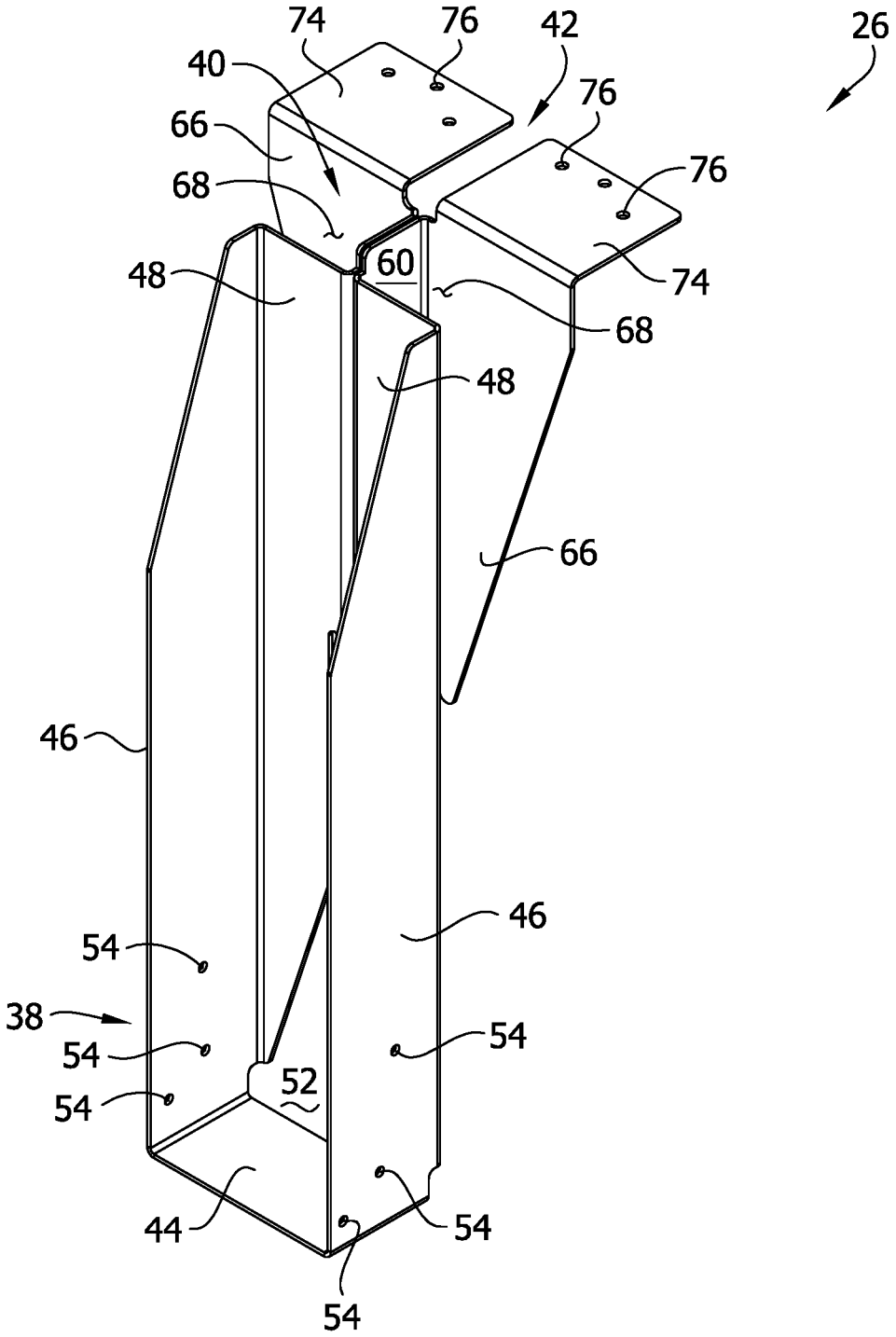
FIG. 2 is a perspective of a truss hanger according to a first embodiment of the present invention.
Figure 2A:
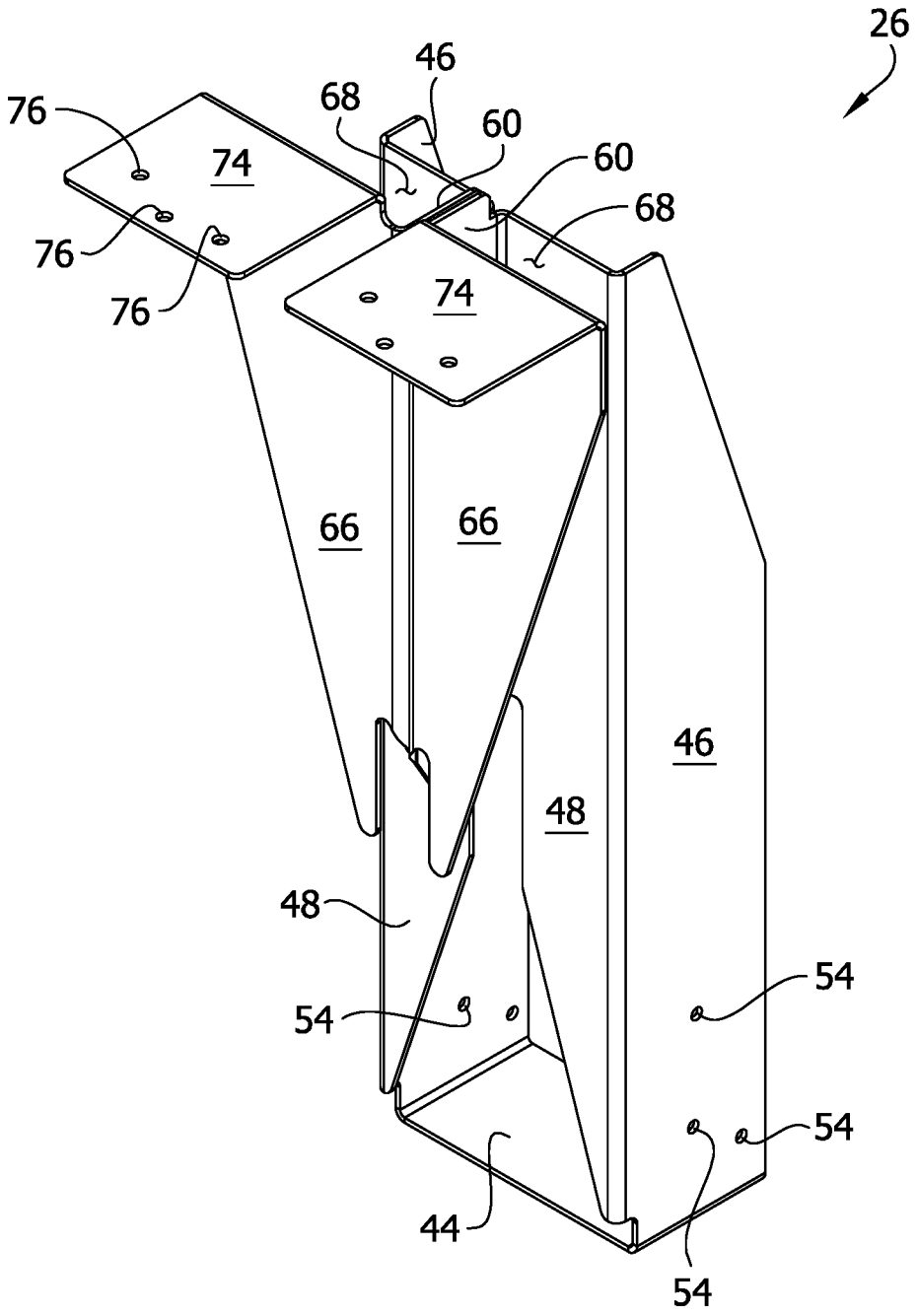
FIG. 2A is a rear perspective of the truss hanger.

Referring to FIG. 1, a first embodiment of a connection system for a fire separation wall is shown generally at 10. Floor trusses generally indicated at 12 each include truss members (broadly, "wooden structural members") including a top chord 14, a bottom chord 16, and web members 18 joining the top and bottom chords. Each floor truss also includes end members 20 at each end joining the top and bottom chords 14, 16 (only one end of each truss is shown). The truss members can be joined by nail plates 22 or by any other suitable fastening structure. The number and orientations of the web members 18 and chords 14, 16 may vary from the illustrated embodiment without departing from the scope of the invention, as a truss hanger 26 according to the present invention is readily applicable to other truss configurations (e.g. a roof truss). Moreover, the hanger 26 may be used to connect structural components other than trusses to a wall or other part of a structure. The hanger can be used to support other wood framing members such as solid sawn or structural composite lumber.

As seen in FIG. 1, a wall 28 includes a top member or plate 30 and support members or studs 32 (only one stud may be seen in FIG. 1). As illustrated, the top plate 30 is formed by two 2×4's in stacked relation. Fire retardant sheathing 34 is mounted on both sides of the wall 28, as illustrated. In one embodiment, the fire retardant sheathing is gypsum board, such as two layers of ⅝" gypsum board mounted on each side of the wall 28 as illustrated, although other configurations of fire retardant sheathing are within the scope of the present invention. Other wall configurations, including different wall constructions and materials, are within the scope of the present invention. For example, the truss hangers 26 can be used with any wall assembly or fire-rated wall assembly, such as a 2-hour fire-resistive wall assembly. The floor trusses 12 are mounted on the wall 28 adjacent the fire retardant sheathing 34 by the truss hangers 26. The truss hangers 26 extend through a narrow slot in the fire retardant sheathing 34 to maintain the integrity and fire retardant characteristics of the fire separation wall.

Referring to FIGS. 2-8, the truss hanger 26 includes a channel-shaped portion 38, an extension portion 40, and a connection portion 42. The channel-shaped portion 38 is configured to receive the floor truss 12. The channel-shaped portion 38 includes a seat or base 44 and a pair of side panels 46 extending upward from the base. When installed, the base 44 is generally horizontal, and the side panels 46 extend generally vertical from the base. A back panel 48 extends from each of the side panels 46. Each back panel 48 is generally perpendicular to both the side panels 46 and the base 44. When installed, each back panel 48 extends generally parallel to an interior face 50 of the fire retardant sheathing 34. The base 44, side panels 46, and back panels 48 form a channel 52 configured to receive the floor truss 12.

As seen in FIGS. 1 and 12-14A, the floor truss 12 is received in the channel 52 to attach the floor truss to the wall 28. The bottom chord 16 of the floor truss 12 engages and rests upon (i.e., is supported by) the base 44. The end member 20 of the floor truss 12 is positioned against the back panels 48 between the side panels 46. The truss hanger 26 includes fastening structure for attaching the floor truss 12 to the truss hanger. Fastening structure can be of any type known in the art for attaching a connector to a wooden structural member, such as nailing teeth (not shown) struck from the material of the hanger. In the illustrated embodiment, the fastening structure comprises a hole to allow for insertion of a fastening member. More specifically, in one embodiment the fastening structure comprises nail holes 54 in the side panels 46 of the truss hanger 26, and the fastening member comprises a nail 56 (see FIG. 12). In the illustrated embodiment, nail holes 54 are positioned on each of the side panels 46 so that nails 56 can be inserted into both the bottom chord 16 and the end member 20 of the floor truss 12 to attach the hanger 26 to the floor truss 12.

Figure 3:
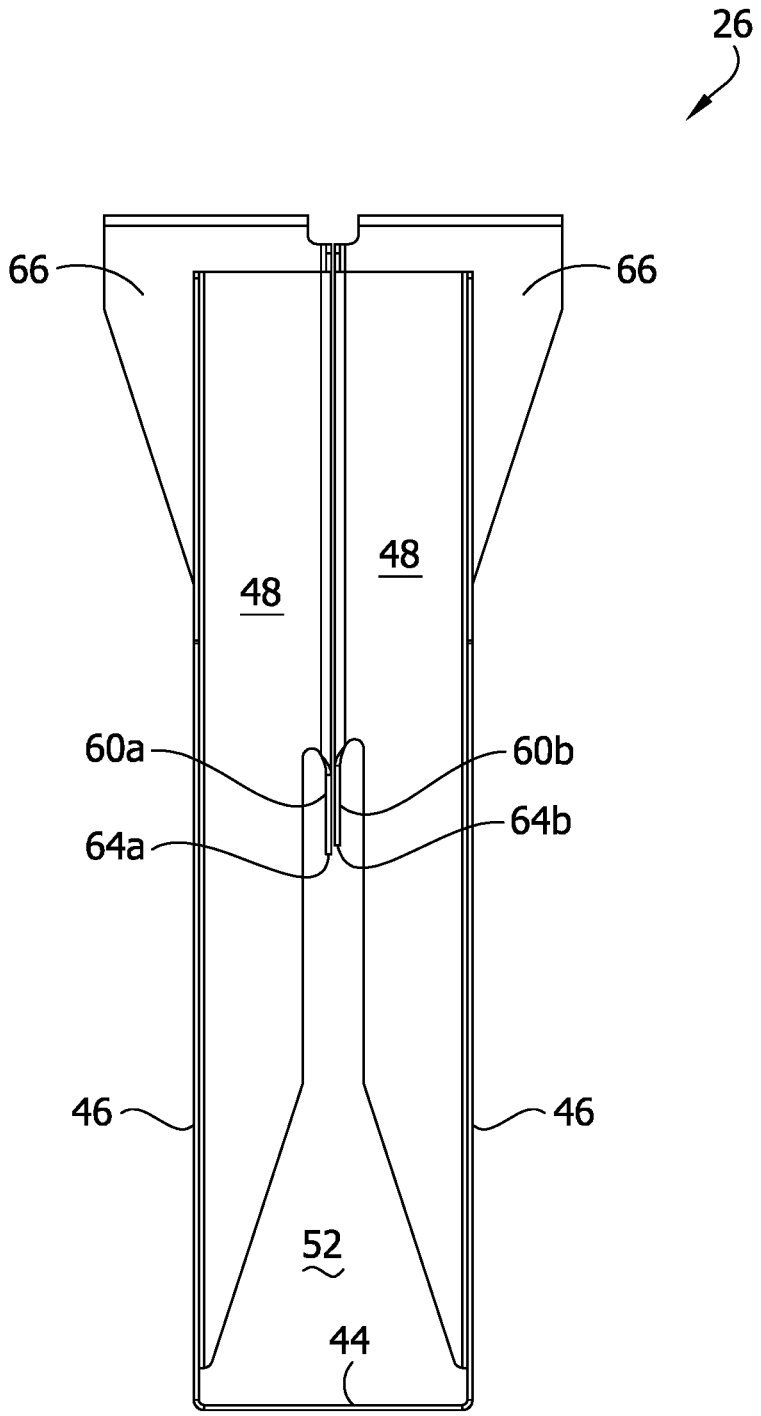
FIG. 3 is a front elevation thereof.
Figure 4:
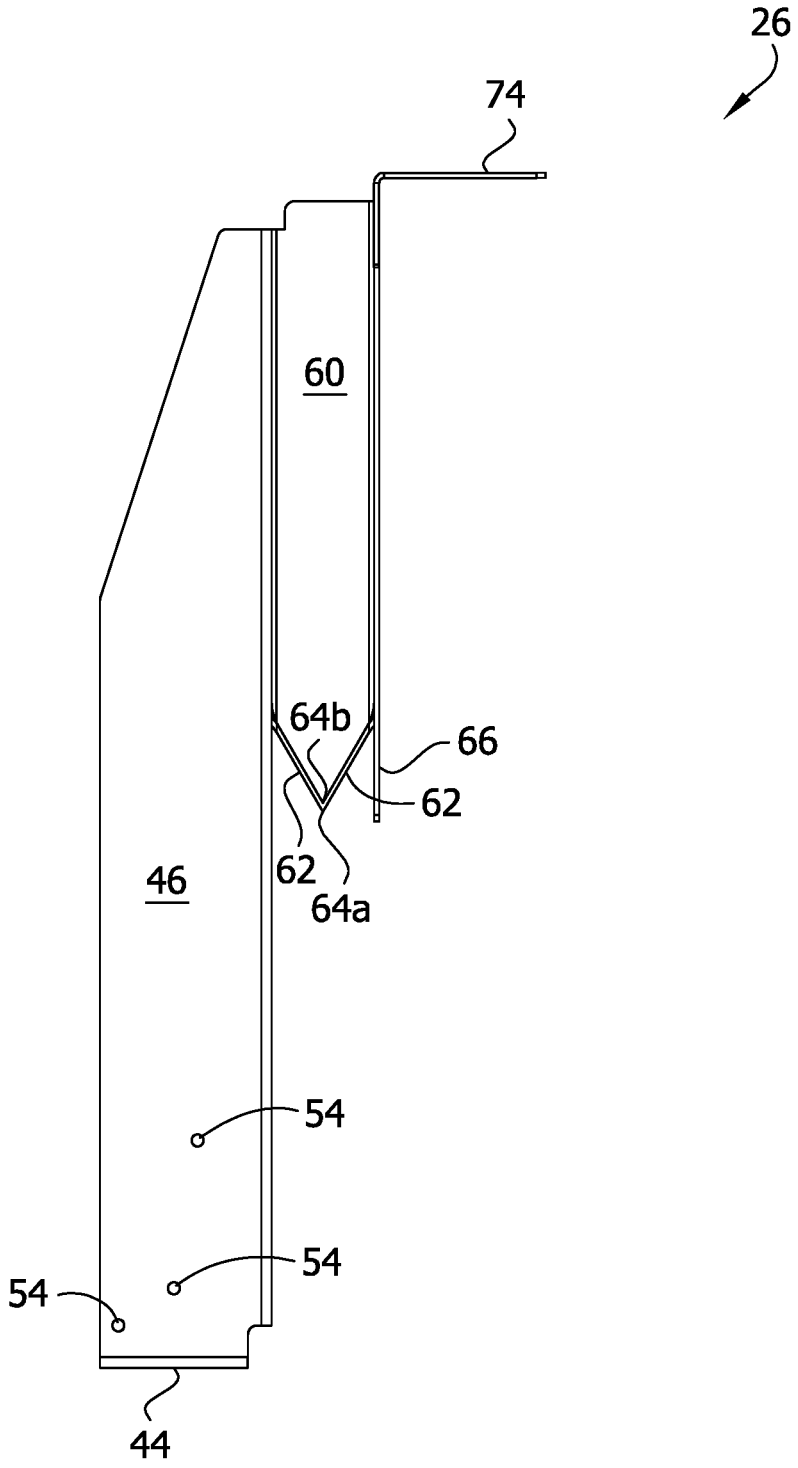
FIG. 4 is a right side elevation thereof.
Figure 5:
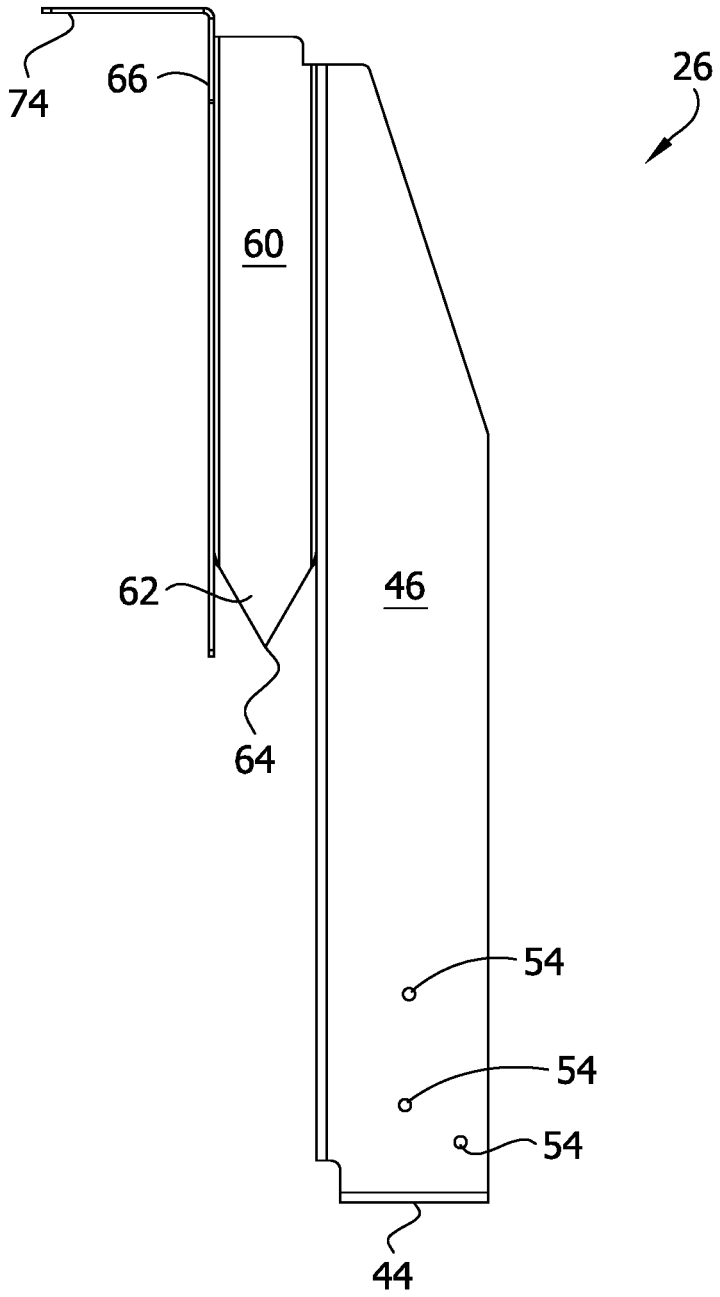
FIG. 5 is a left side elevation thereof.
Figure 6:
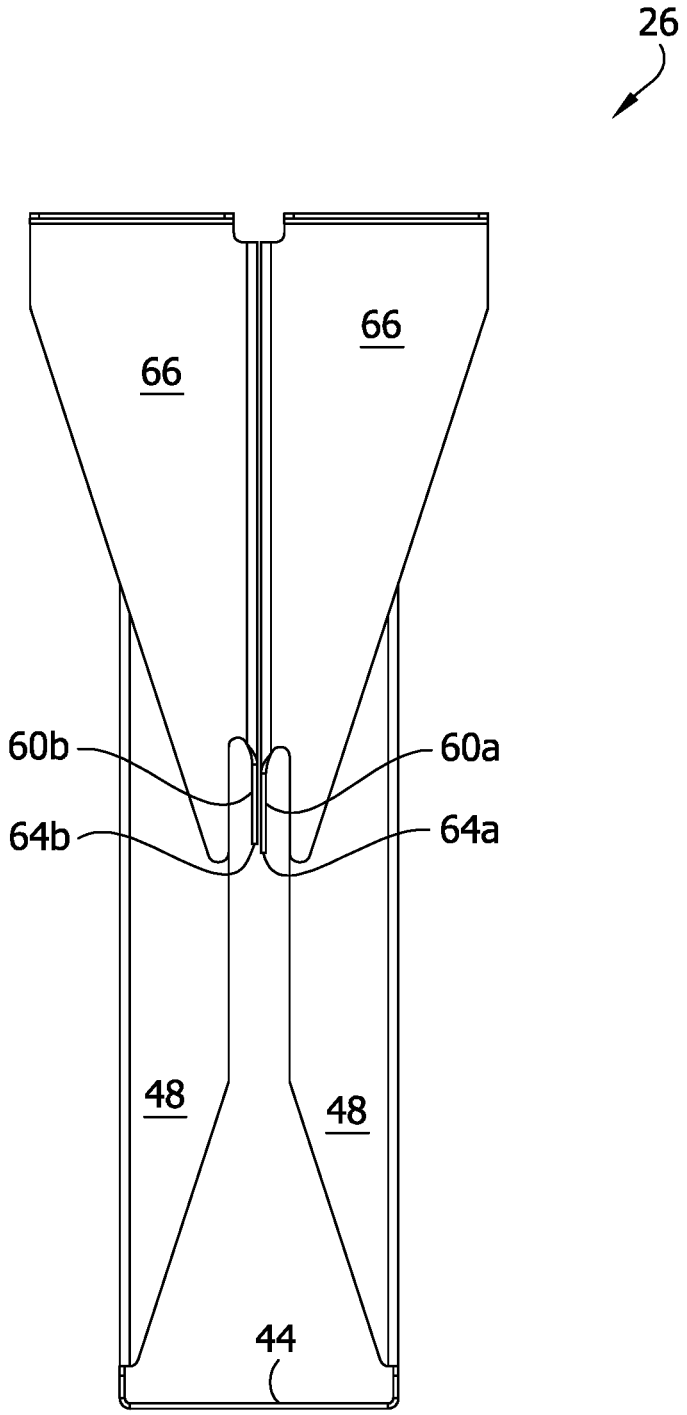
FIG. 6 is a rear elevation thereof.

Referring again to FIGS. 2-8, the extension portion 40 includes two extension flanges 60 configured to extend through the fire retardant sheathing 34. Each flange 60 extends from one of the back panels 48. The flanges 60 are positioned in opposed, face-to-face relation, and preferably engage each other along a juncture. Each flange 60 extends generally perpendicular from the corresponding back panel 48 and generally parallel to the side panels 46. At a bottom edge, each flange 60 includes a driving point 62. Each of the driving points 62 is generally triangular and includes a pointed tip 64. As seen in FIGS. 3 and 6, the tips 64 of the driving points 62 are vertically offset from each other. As illustrated, the tip 64*a* of one flange 60*a* extends vertically below the tip 64*b* of the other flange 60*b*. In one embodiment, the tips 64 are vertically offset from each other about ⅛", although other configurations are within the scope of the present invention, such as tips that are aligned or tips that are offset a smaller or larger amount.

Figure 7:
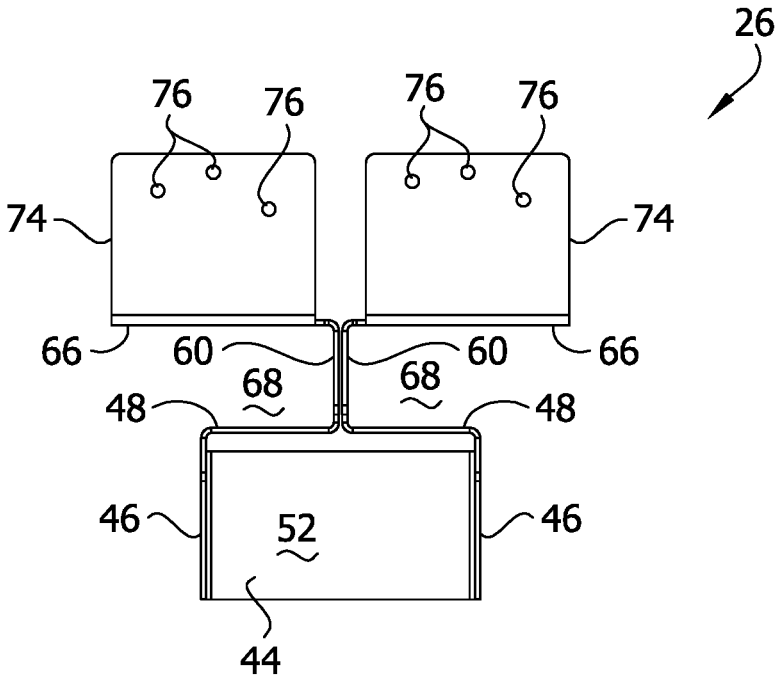
FIG. 7 is a top plan thereof.
Figure 8:
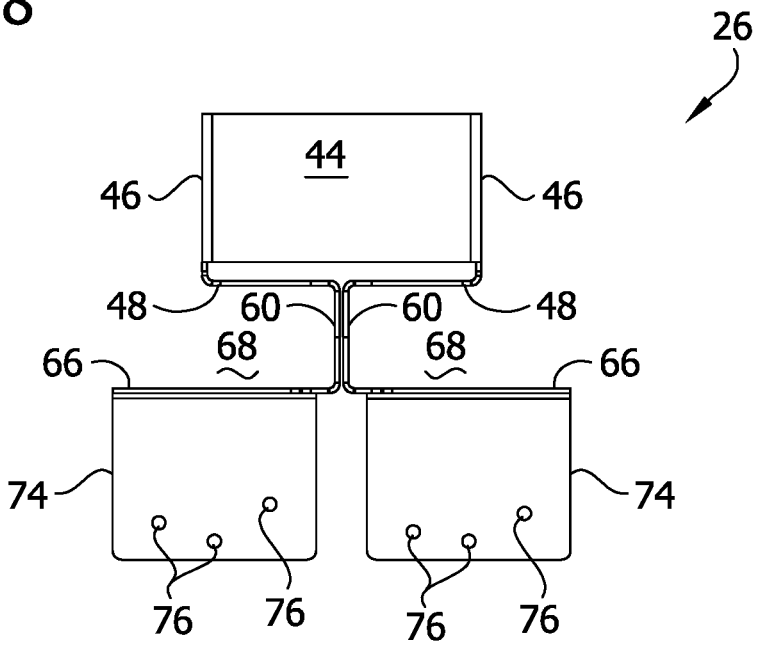
FIG. 8 is a bottom plan thereof.
Figure 9:
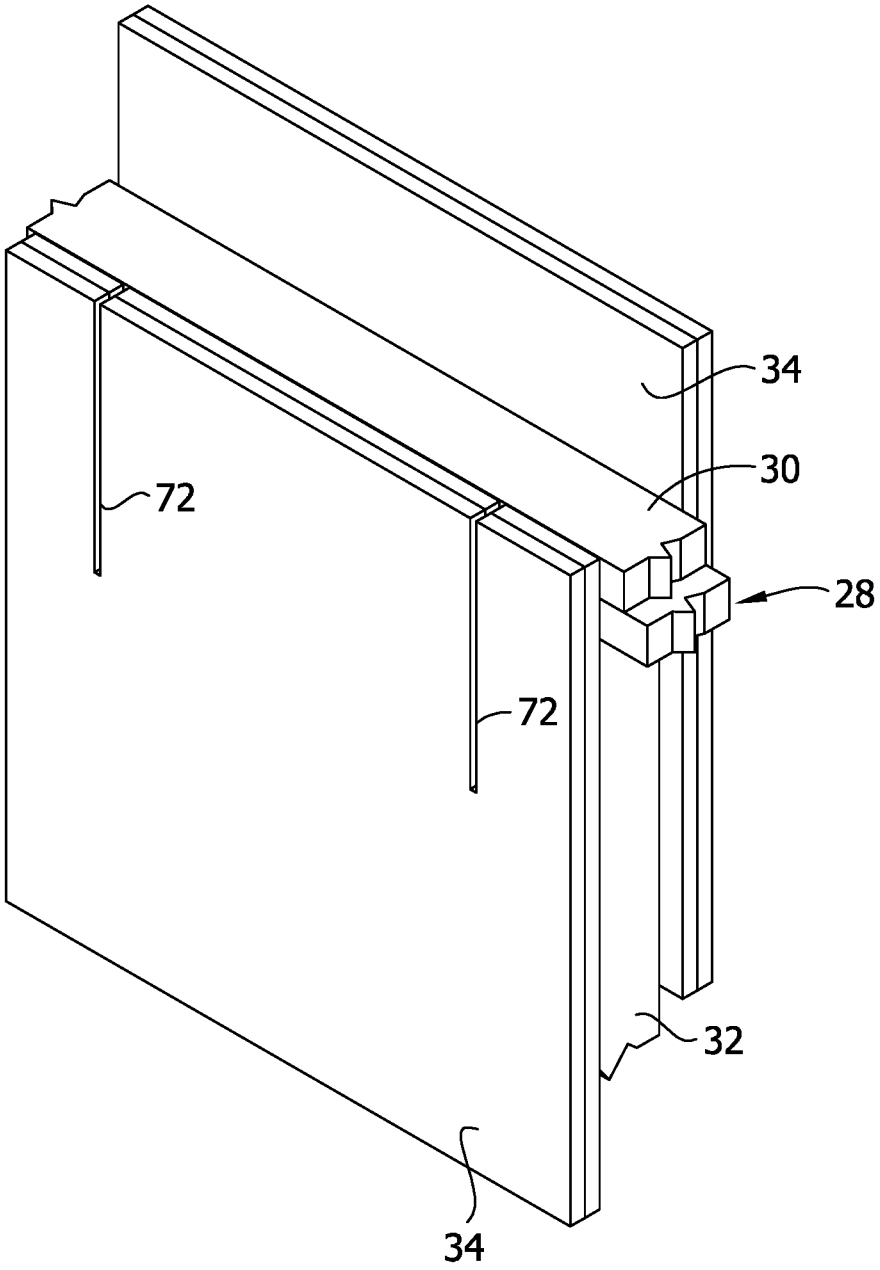
FIG. 9 is a perspective of a wall having fire retardant sheathing with a slot cut in the sheathing to receive the truss hanger.
Figure 13:
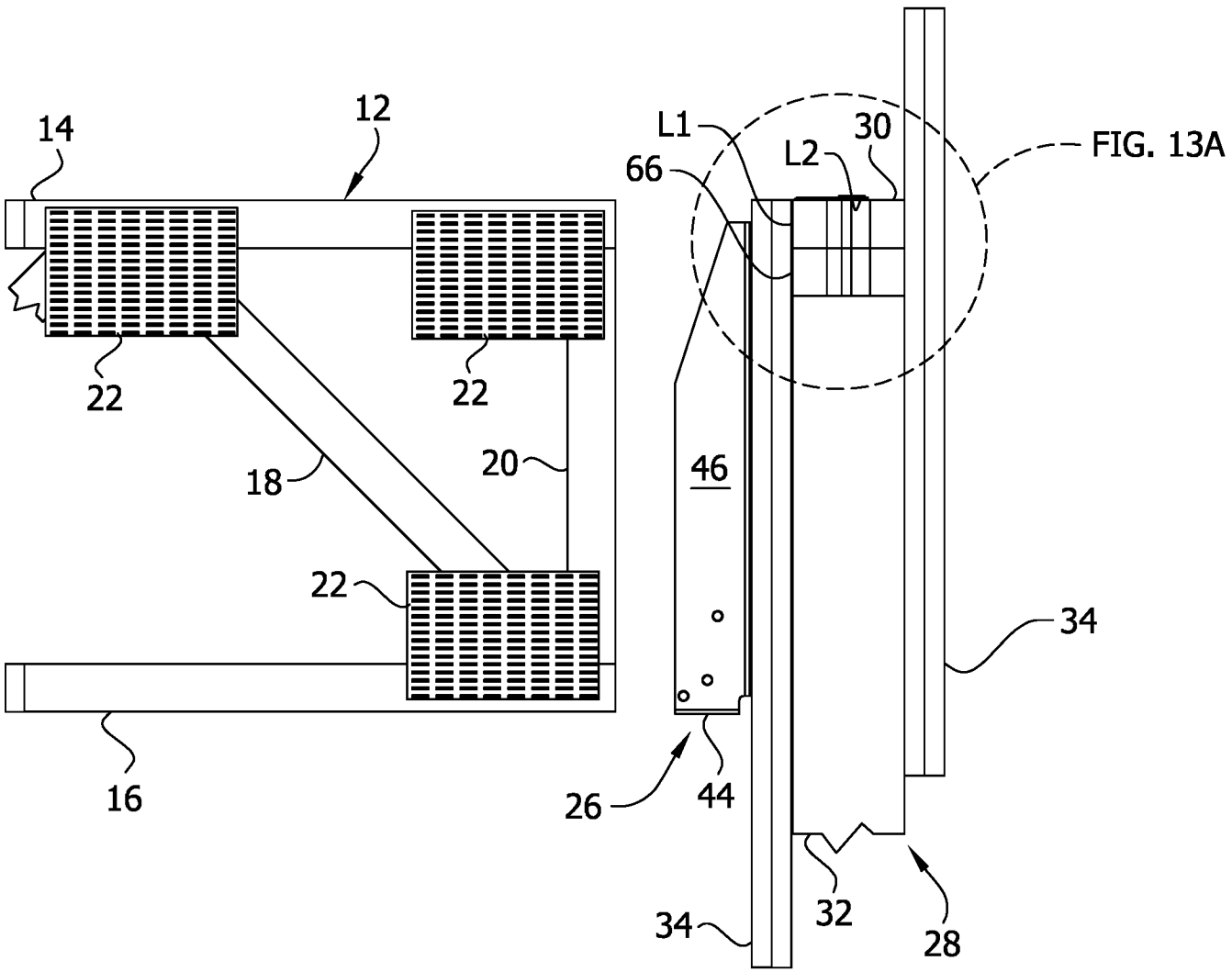
FIG. 13 is a side elevation of FIG. 12.
Figure 13A:
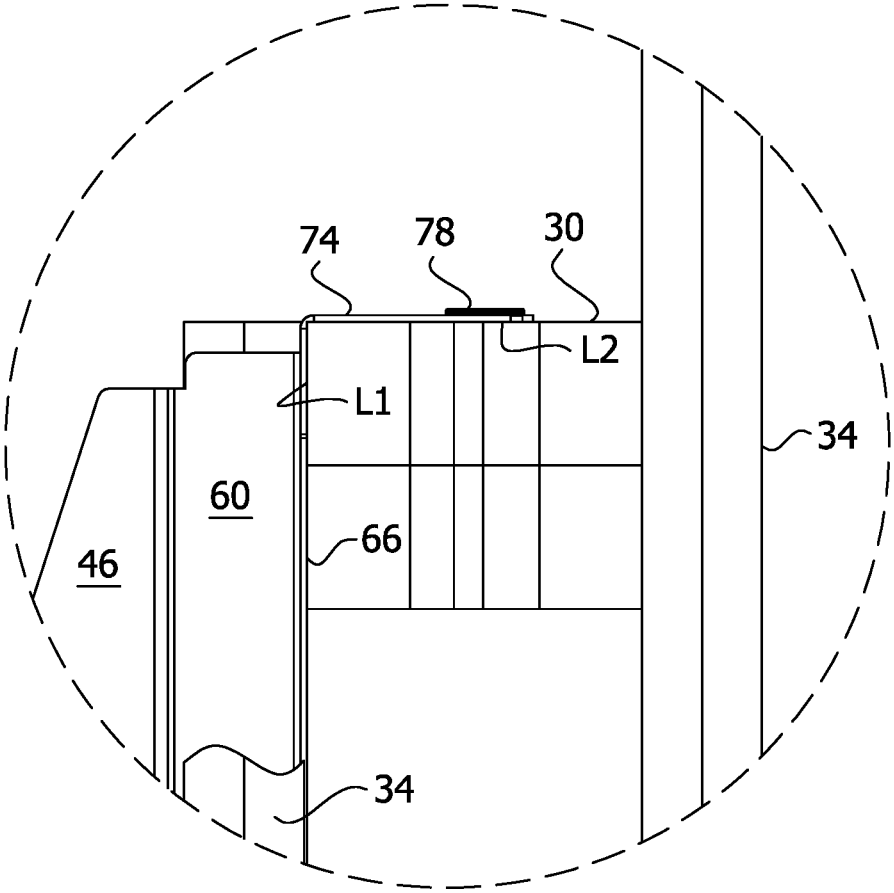
FIG. 13A is an enlarged fragmentary perspective of FIG. 13 with a portion of the fire retardant sheathing broken away.
Figure 14:
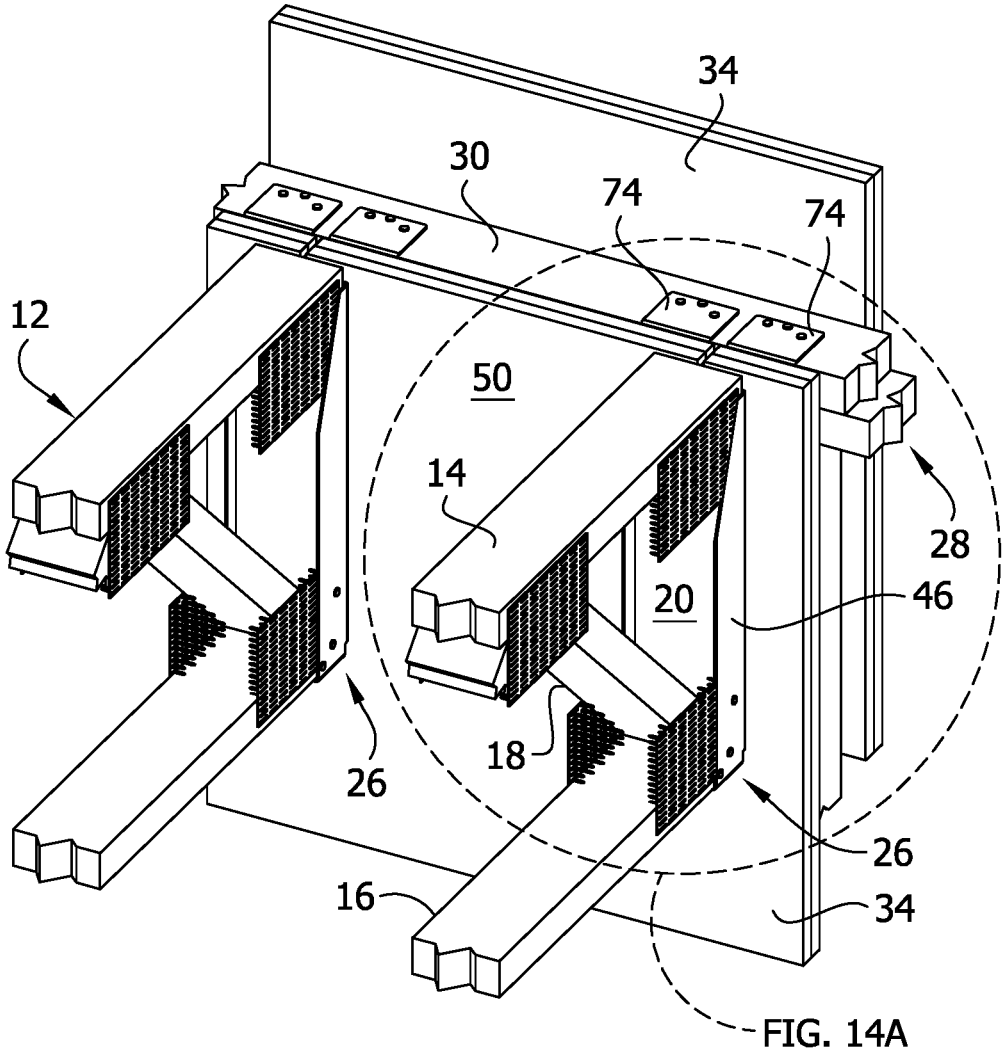
FIG. 14 is the perspective of FIG. 10, but showing floor trusses mounted in the truss hangers.
Figure 14A:
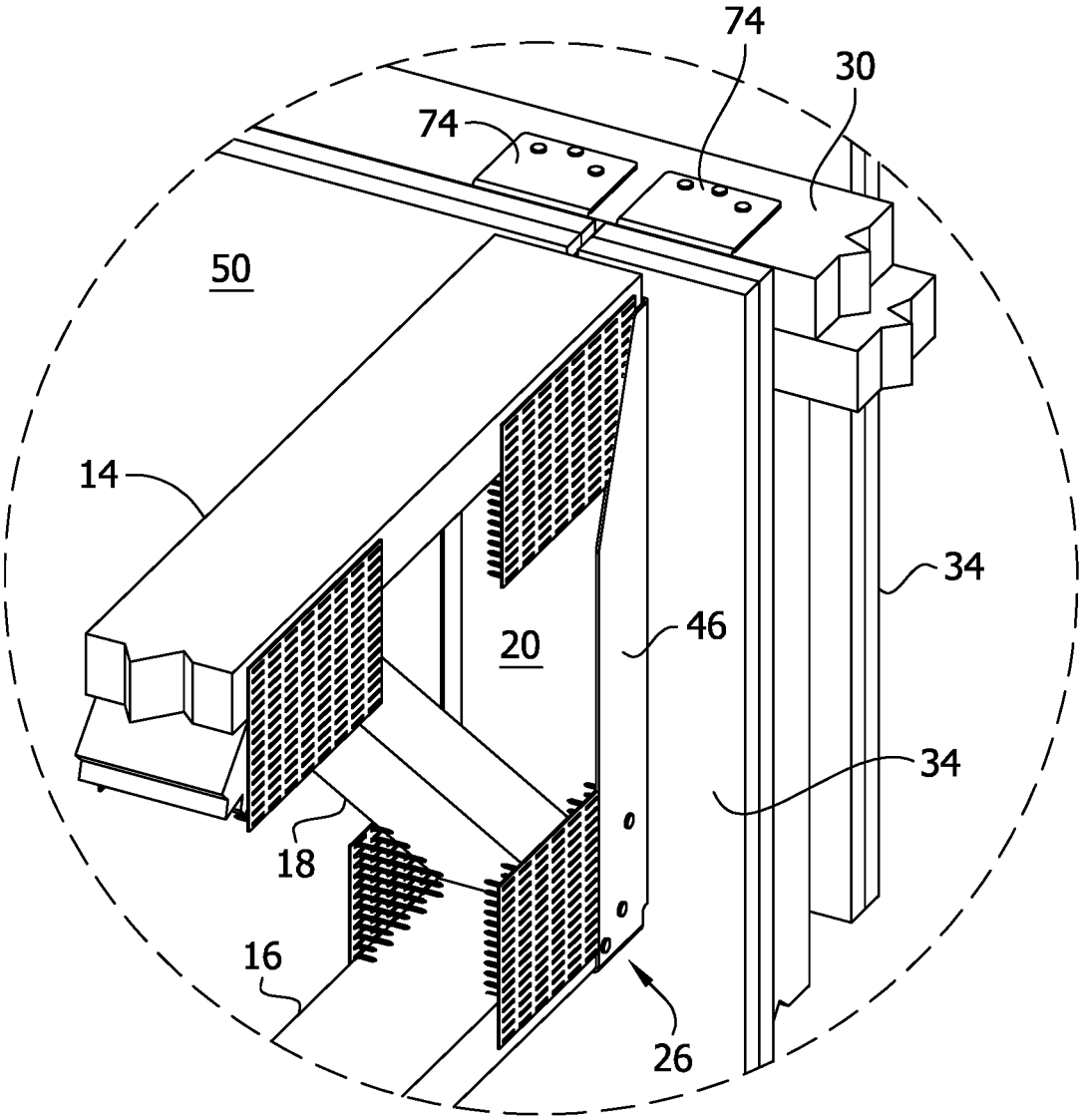
FIG. 14A is an enlarged fragmentary perspective of FIG. 14.

A back flange 66 extends from each of the extension flanges 60. Each back flange 66 extends generally perpendicular from the extension flange 60 and is oriented generally parallel to the back panels 48. Referring to FIG. 13A, the back flanges 66 engage the wall 28 at a first location $L_1$, which in the illustrated embodiment is a vertical face of the top plate 30 of the wall. The back panels 48, extension flanges 60, and back flanges 66 form a pair of sheathing channels 68. Each sheathing channel 68 is configured to receive a portion of the fire retardant sheathing 34 to secure the sheathing between the hanger 26 and the wall 28. As seen in FIG. 7, the sheathing channels 68 extend generally perpendicular to the truss-receiving channel 52.

Figure 10:
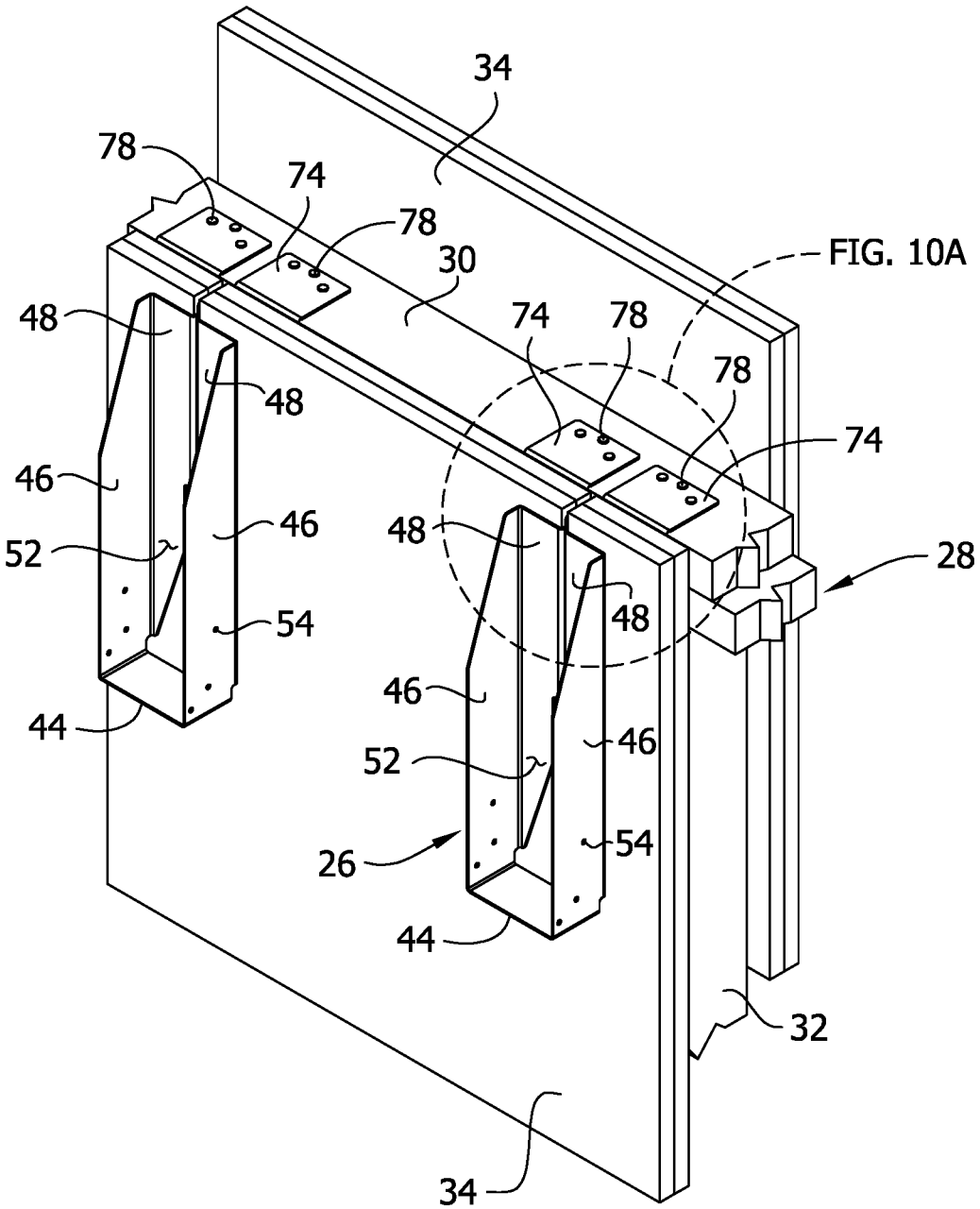
FIG. 10 is the perspective of FIG. 9, but showing two of the truss hangers mounted thereon.
Figure 10A:
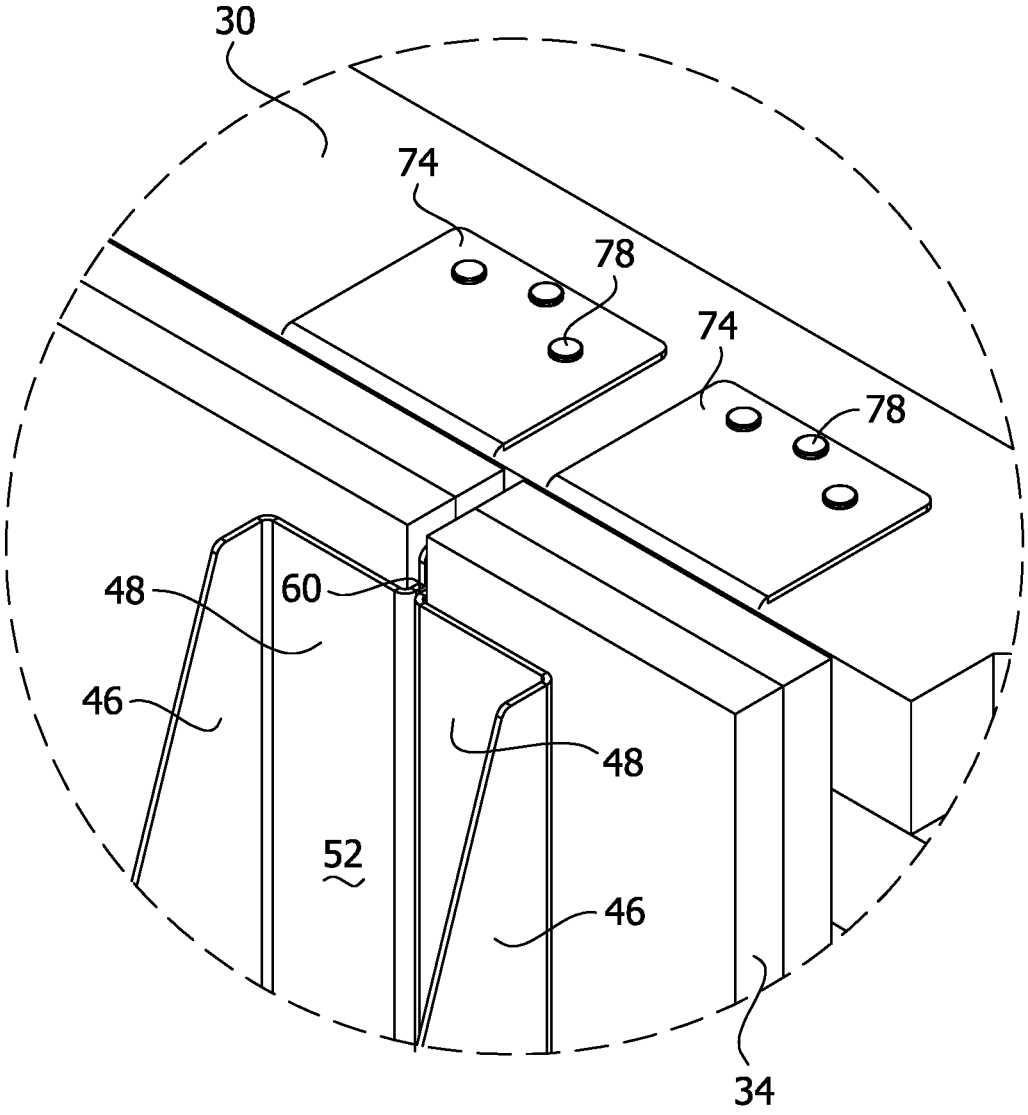
FIG. 10A is an enlarged fragmentary perspective of FIG. 10.
Figure 11:
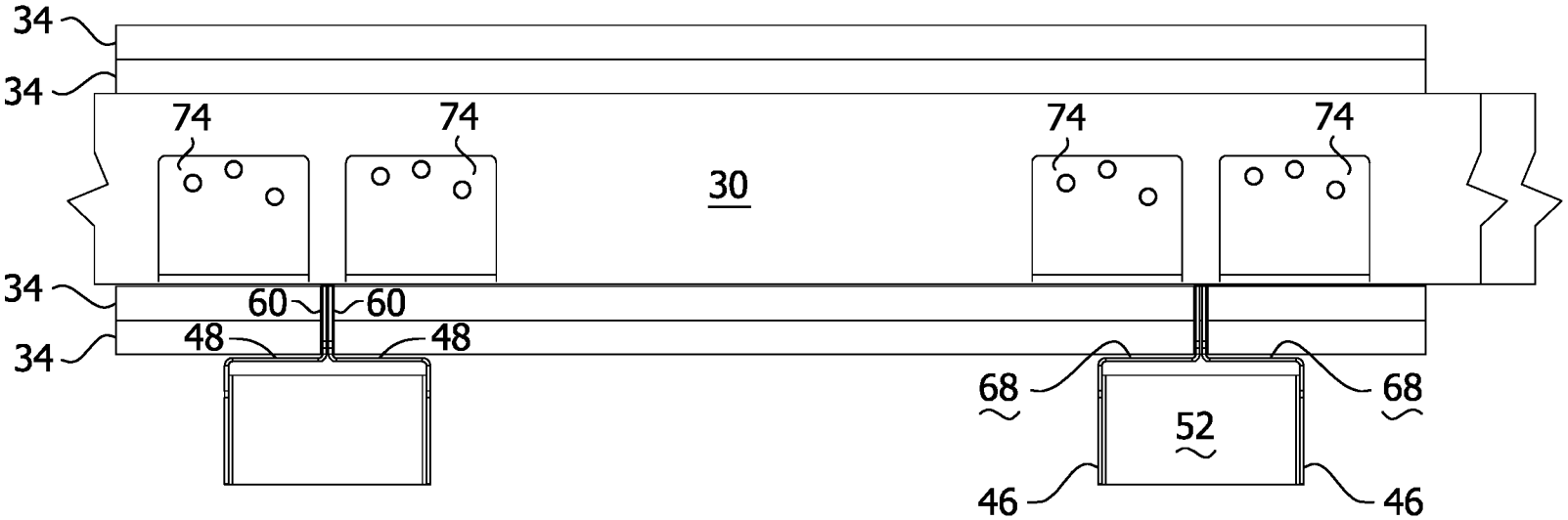
FIG. 11 is a top plan of FIG. 10, illustrating the truss hanger extending through the fire retardant sheathing.
Figure 12:
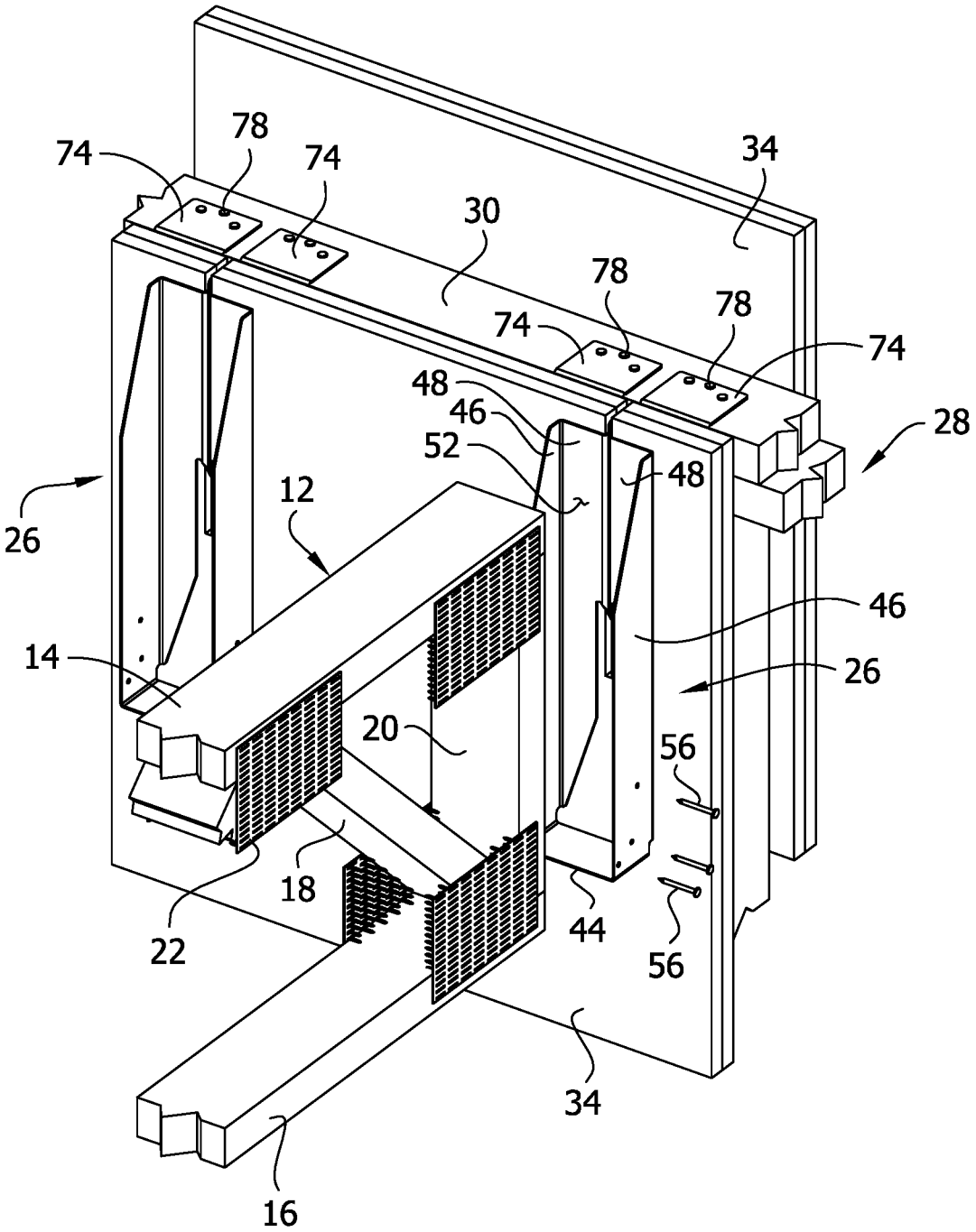
FIG. 12 is a perspective similar to FIG. 10, but showing a floor truss positioned for mounting in the truss hanger.

As seen in FIGS. 10A and 11, the extension flanges 60 extend through a slot 72 in the fire retardant sheathing 34. Preferably, the slot has an area less than or equal to 6 square inches, and the gap between the extension flanges 60 and the edge of the slot 72 is less than or equal to ⅛". The driving points 62 extend down into the sheathing 34 to further secure the sheathing between the hanger 26 and the wall 28. A portion of the fire retardant sheathing 34 extends into each sheathing channel 68 and is secured between the back panels 48 and the back flanges 66.

In one embodiment, the slot 72 in the fire retardant sheathing 34 can be made using a slot template 82 (FIGS. 16-24). The slot template 82 includes a vertical panel 84 having a rear face 86 configured to engage the interior face 50 of the fire retardant sheathing 34 and a horizontal panel 88 having a bottom face 90 configured to engage a top face of the sheathing. The horizontal panel 88 extends generally perpendicular from the vertical panel 84. The slot template 82 is configured to be quickly fixed in position on the sheathing 34 for use in cutting the slot 72 to receive the truss hanger 26. Portions of the slot template 82 are configured to be pressed into the sheathing 34 to locate the template on the sheathing and retain the template in position for cutting the slot 72. In the illustrated embodiment, the horizontal panel includes prongs 92 that are bent downward for insertion into the top face of the sheathing 34. Bottom corners 94 of the vertical panel 84 are bent rearward for insertion into the interior face 50 of the sheathing 34. The prongs 92 and the corners 94 are inserted into the sheathing 34 to retain the template 82 in position for cutting the slot 72. In addition, the vertical panel 84 optionally includes dimples 96 extending toward the rear face 86 of the vertical panel 84. The dimples 96 ensure the vertical panel 84 remains slightly spaced from the interior face 50 of the sheathing 34 so the template 82 can be easily removed from the sheathing after the slot 72 is cut.

The template 82 includes a guide slot 98 to guide a cutting tool in cutting the slot 72 in the sheathing 34. The guide slot 98 extends from a top edge of the vertical panel 84 to a location spaced from a bottom edge of the vertical panel. As illustrated, the guide slot 98 includes a wide, rectangular portion 98*a* in the horizontal panel 88 to ease insertion of a cutting tool into the guide slot. A converging portion 98*b* of the slot 98 in the vertical panel 84 transitions from the wide portion 98*a* to a narrow lower portion 98*c* of the slot. This facilitates entry of the cutting tool into the narrow portion 98*c*. The narrow portion 98*c* of the guide slot 98 is dimensioned to facilitate cutting the slot 72 in the sheathing 34 to a size configured to receive the extension flanges 60 of the truss hanger 26.

Figure 24:
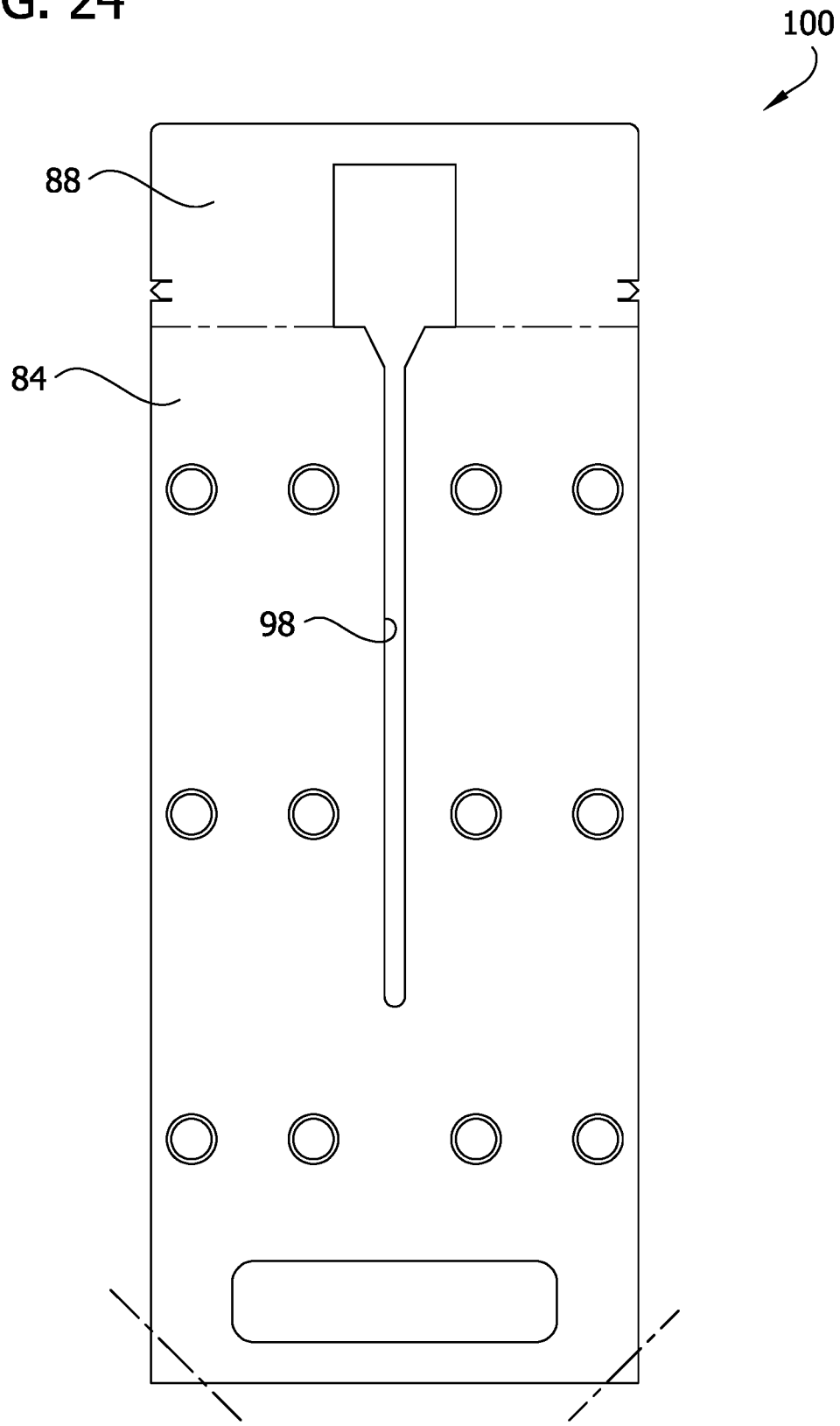
FIG. 24 is a front view of a stamped metal blank for forming the slot template.

As seen in FIG. 24, the template 82 described above can be formed as one piece from a metal blank 100 that is stamped from a sheet metal roll and bent into shape. In one embodiment, the template 82 is stamped from 16 gauge steel, although other thicknesses (e.g., 12-18 gauge) and other suitable materials are within the scope of the present invention.

In use, the template 82 is placed on the sheathing 34 in a selected location for a slot 72. The template can be used to cut the slot 72 in the sheathing 34 either before or after the sheathing is mounted on the wall 28. The prongs 92 and corners 94 are inserted into the sheathing 34 by tapping with a hand or striking with a hammer or other blunt instrument. Once the template 82 is secured in position on the sheathing 34, a cutting tool (e.g., a drywall cutout tool) is inserted into the guide slot 98 to cut a slot 72 in the sheathing at the location of the guide slot. In one embodiment, a drywall cutout tool with a ⅛" or ¼" spiral bit is used to cut the slot 72, although other cutting tools are within the scope of the present invention. After the slot 72 is cut in the sheathing 34, the template 82 is removed from the sheathing. The sheathing 34 is then configured to receive the truss hanger 26.

Referring again to FIGS. 2-8, the connection portion of the hanger includes a pair of connector tabs 74 extending from the back flanges 66. Each connector tab 74 extends generally perpendicular from one of the back flanges 66. The connector tabs 74 are generally horizontal when the hanger 26 is installed. The connector tabs 74 are configured to engage an upper surface of the top plate 30 of the wall 28 at a second location $L_2$ spaced from the first location $L_1$. The connector tabs 74 can be used to attach the truss hanger 26 to the wall, thereby hanging the floor trusses 12 from the wall. As seen in FIG. 1, the connector tabs 74 extend over a portion of the top plate 30 of the wall 28. Each connector tab 74 includes fastening structure, such as nail holes 76, for insertion of a fastening member, such as nails 78 (see FIGS. 10 and 10A), to attach the hanger 26 to the wall 28. In the illustrated embodiment, each connector tab 74 includes three nail holes 76. Other configurations are within the scope of the present invention, such as a different number of nail holes, or alternate fastening structure such as nailing teeth or other appropriate structure for fastening the hanger to the wall.

The base 44 and back flanges 66 of the truss hanger 26 cooperate to stabilize the truss hanger 26 and protect the fire retardant sheathing 34 under the loads transferred from the truss 12 to the wall 28 by way of the hanger. The channel 52 that receives an end portion of the truss 12 is spaced to the interior of the wall 28 and more particularly to the interior of the second location $L_2$ where the connector tabs 74 are attached to an upper surface of the top plate 30. The vertically downward load of the truss 12 applied to the base 44 of the truss hanger 26 urges the truss hanger 26 to pivot so that the base would move toward the wall 28, which could damage the fire retardant sheathing 34 and pry out the nails 78 connecting the connector tabs 74 to the upper surface of the top plate 30. However, this motion is resisted by the engagement of the back flanges 66 with the interior vertical face of the top plate 30 at the first location $L_1$. Thus, there is a force couple between the base 44 of the hanger 26 carrying the vertical load of the truss 12 and the back panels 48 of the hanger (via engagement of the back flanges 66 with the top plate 30) engaging the end face of the truss. Accordingly, the truss hanger 26 and truss 12 are stable with minimal disruption of the fire retardant sheathing 34, even though the truss is held at a distance from the wall 28 by the truss hanger.

Figure 15:
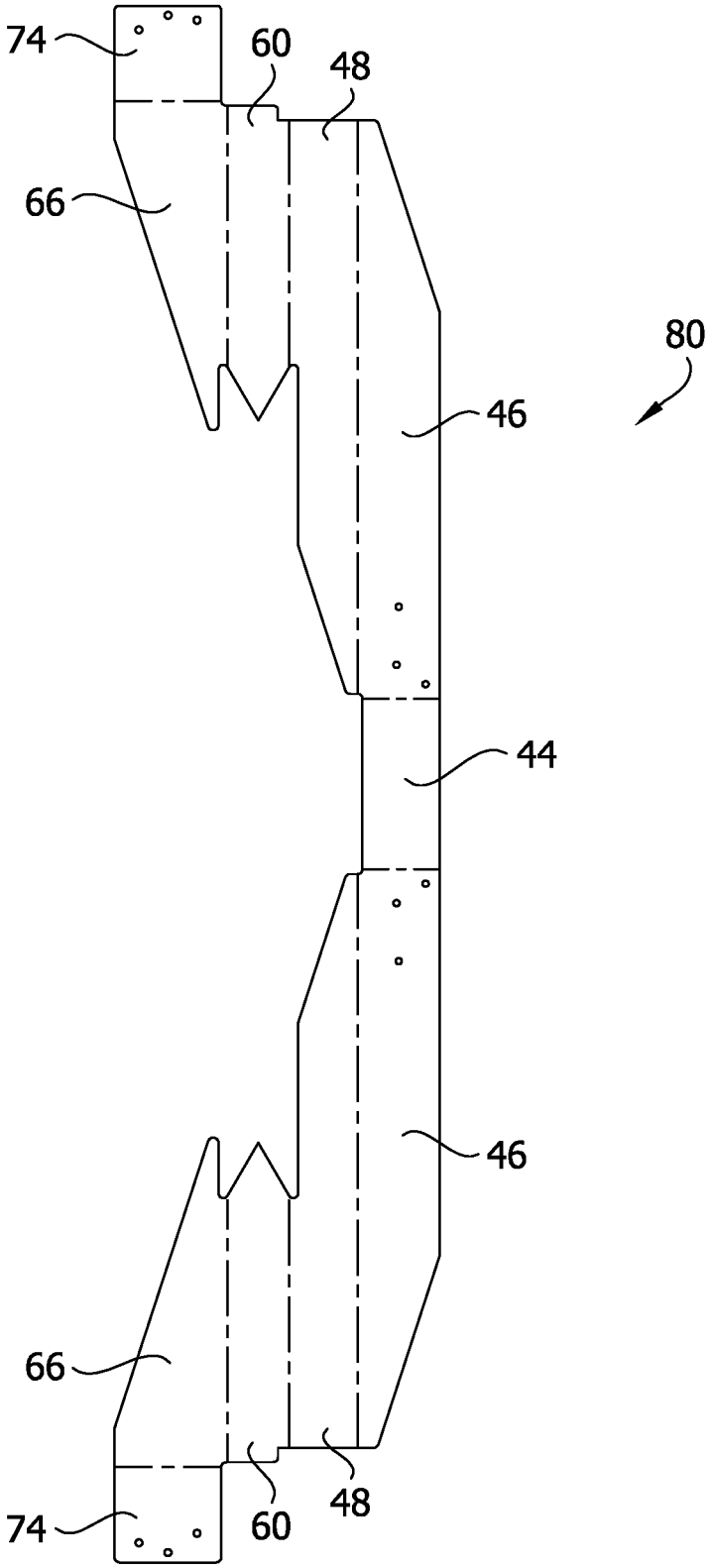
FIG. 15 is a top view of a stamped metal blank for forming a truss hanger according to the present invention.
Figure 16:
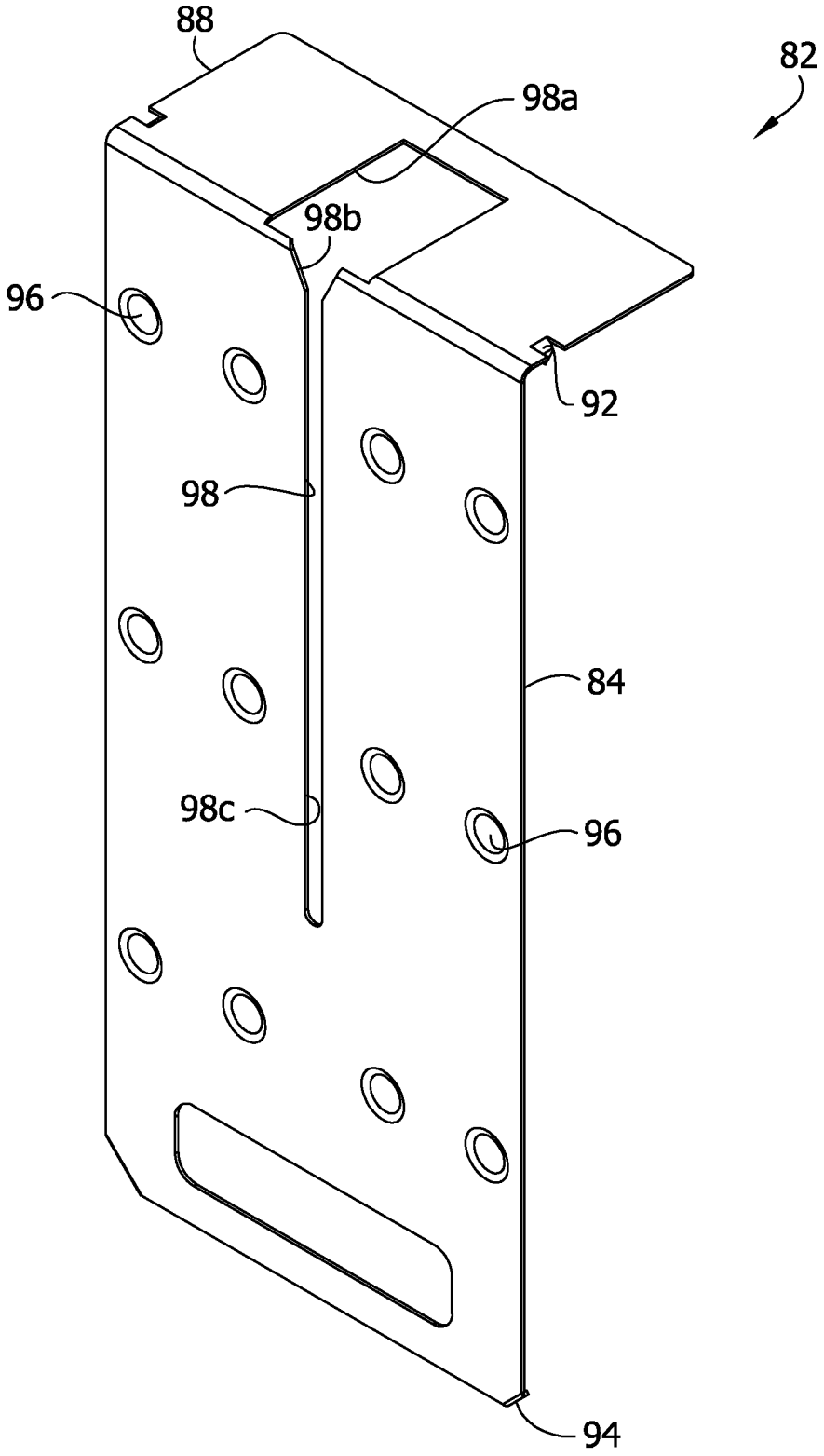
FIG. 16 is a perspective of a slot template for use in cutting the slot in the sheathing to receive the truss hanger.
Figure 17:
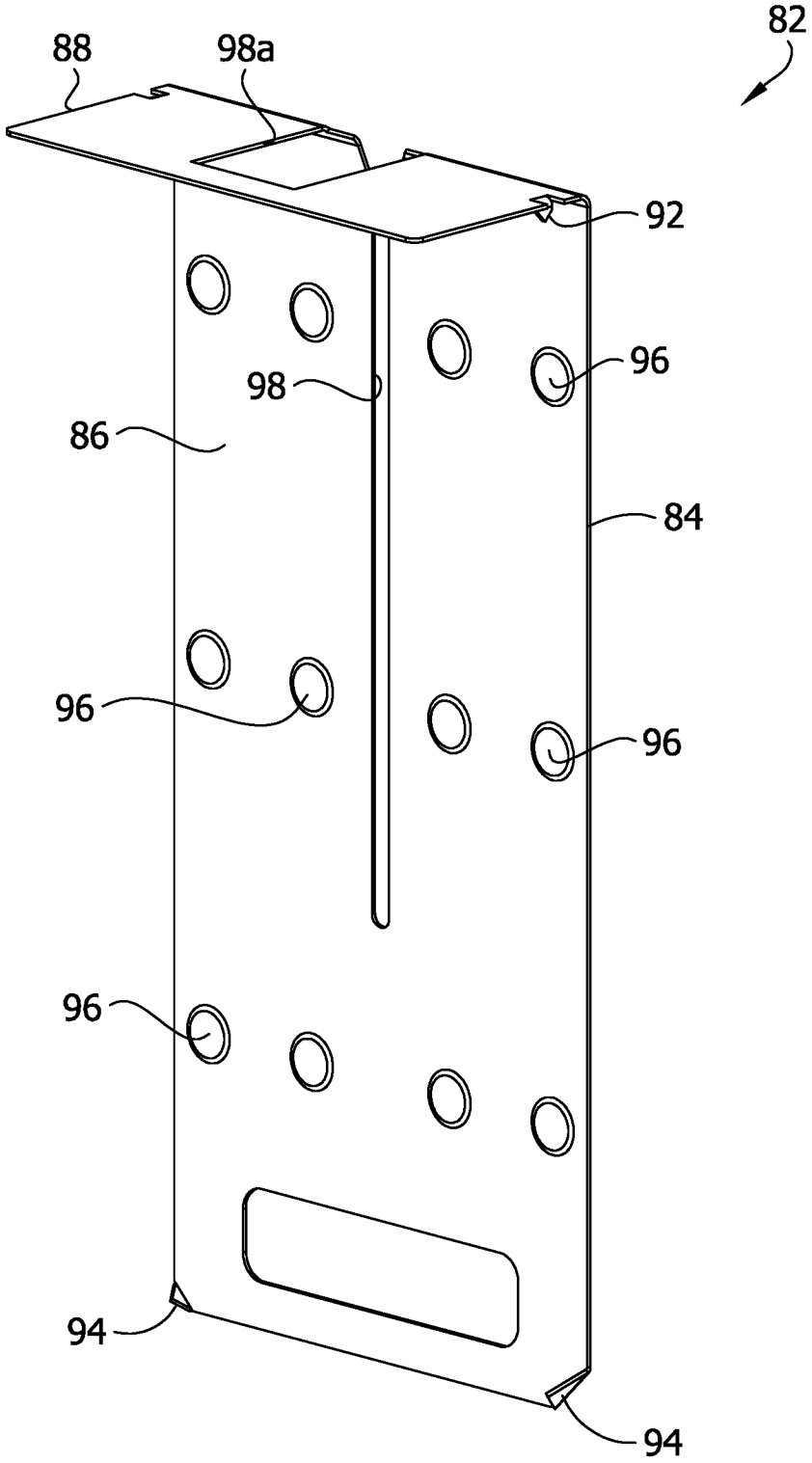
FIG. 17 is a rear perspective of the slot template.
Figure 18:
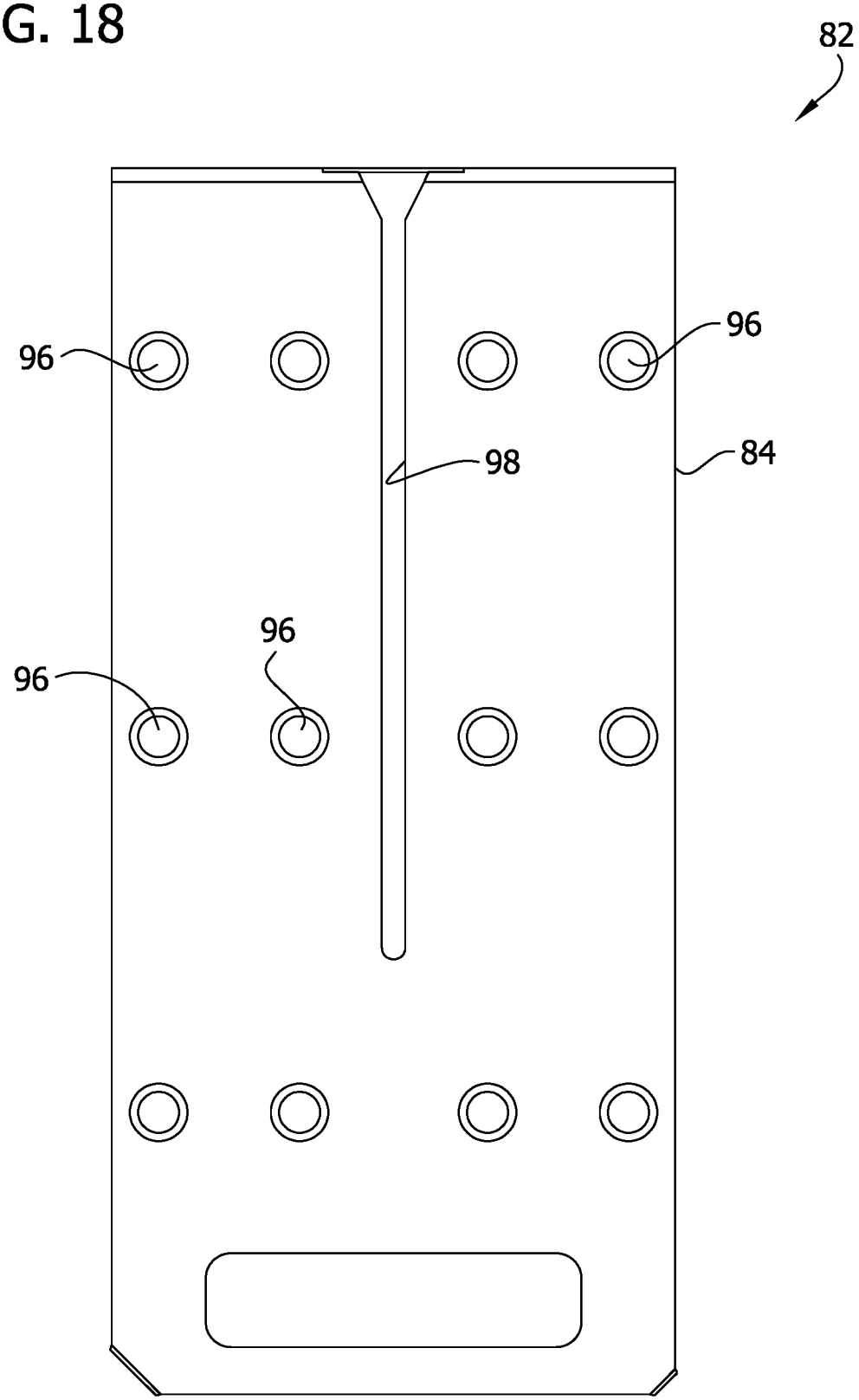
FIG. 18 is a front elevation thereof.
Figure 19:
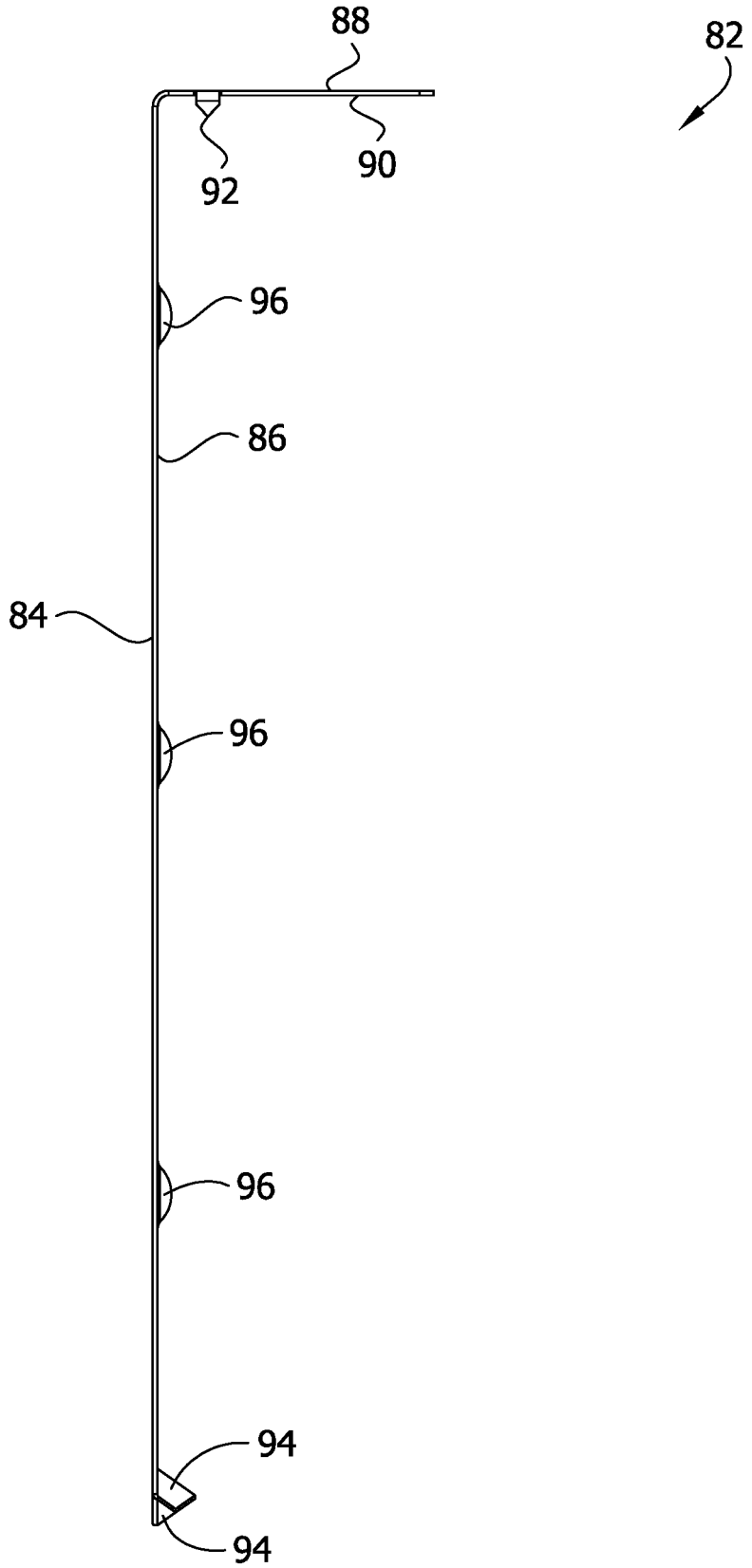
FIG. 19 is a right side elevation thereof.
Figure 20:
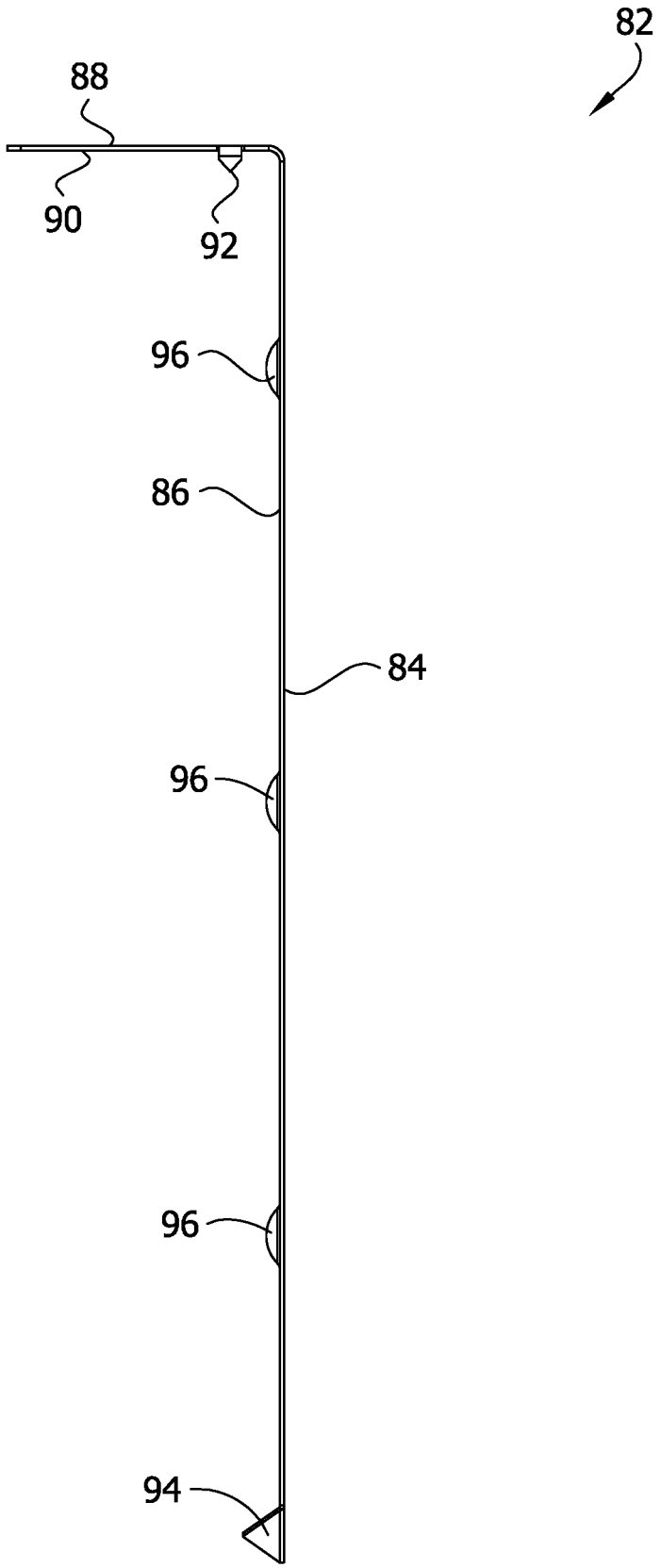
FIG. 20 is a left side elevation thereof.
Figure 21:
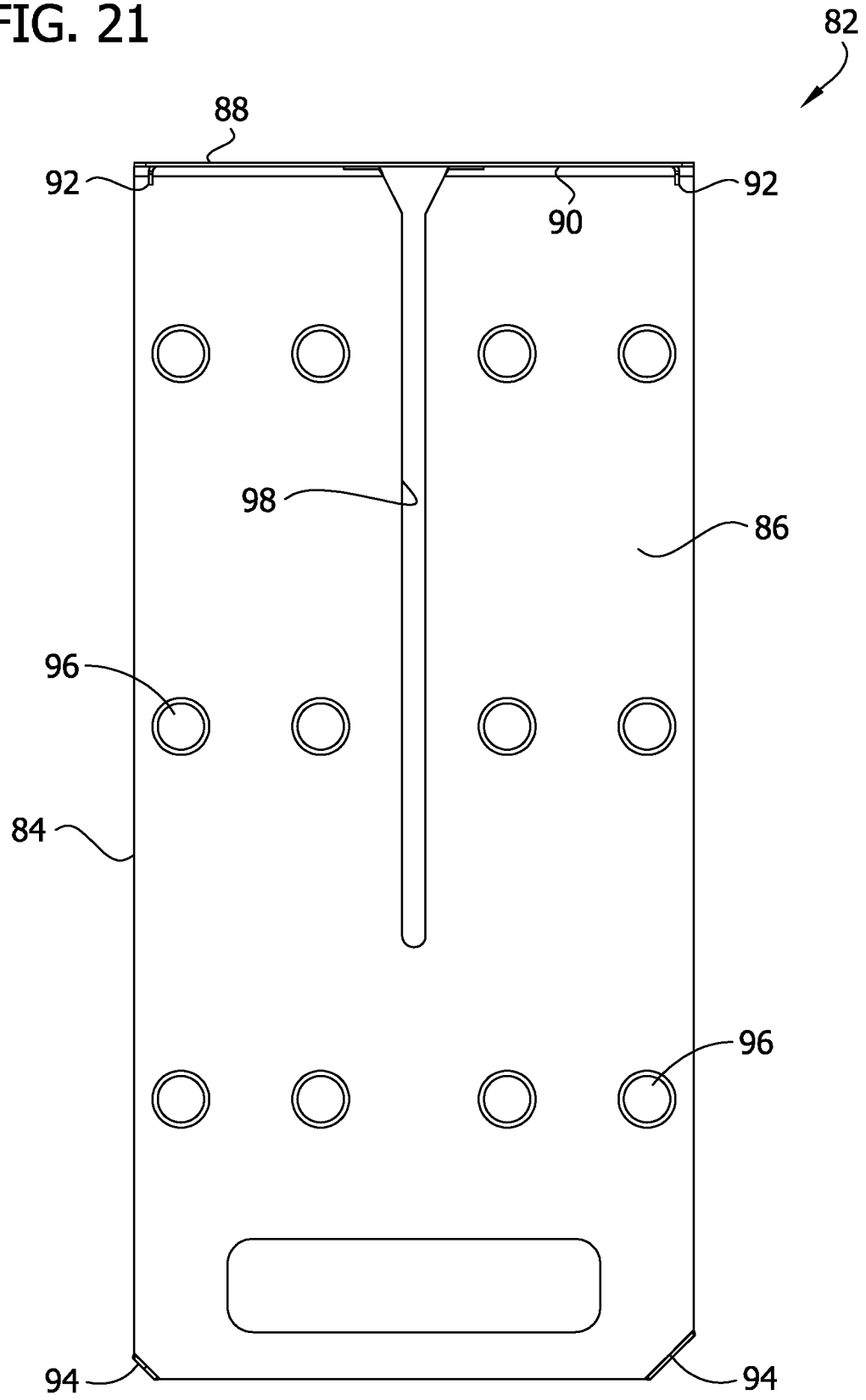
FIG. 21 is a rear elevation thereof.
Figure 22:
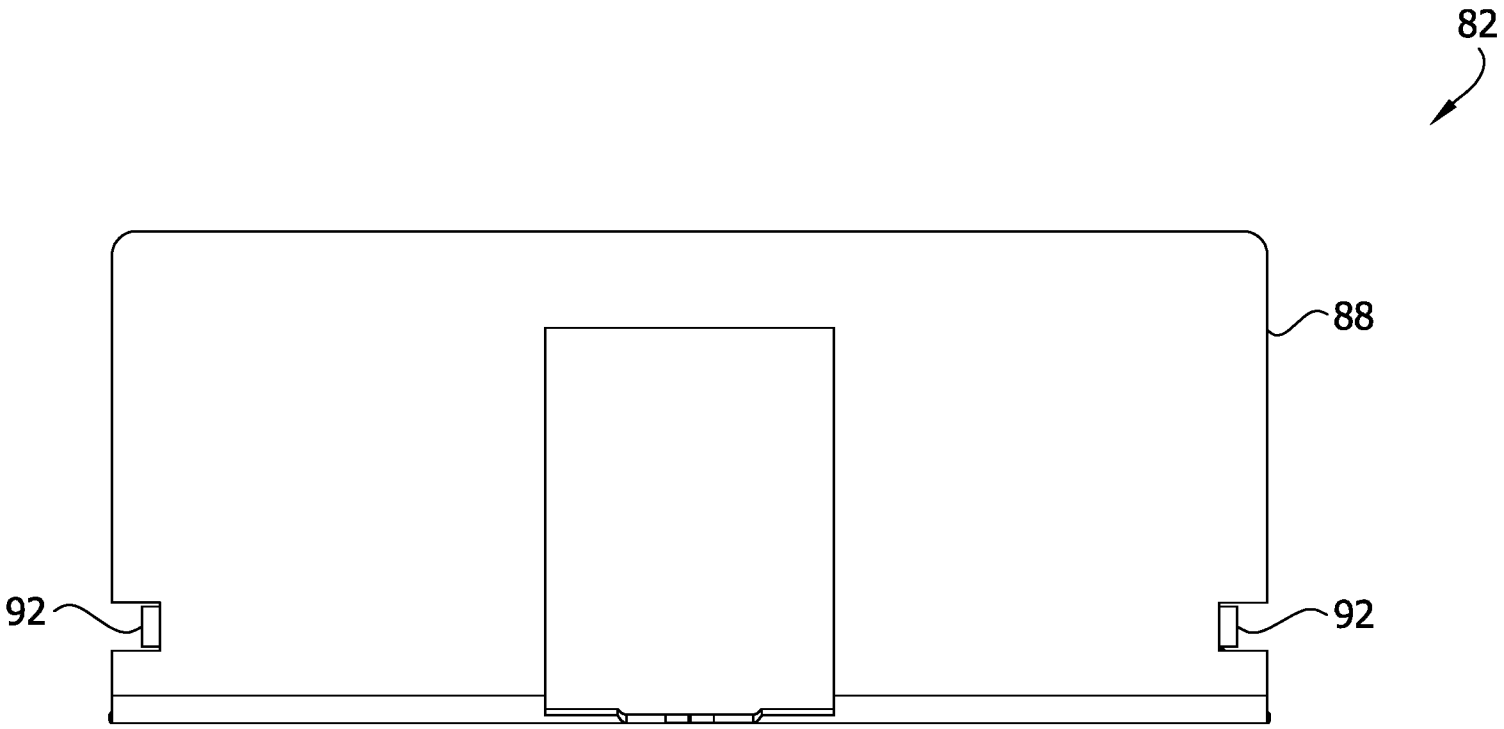
FIG. 22 is a top plan thereof.
Figure 23:
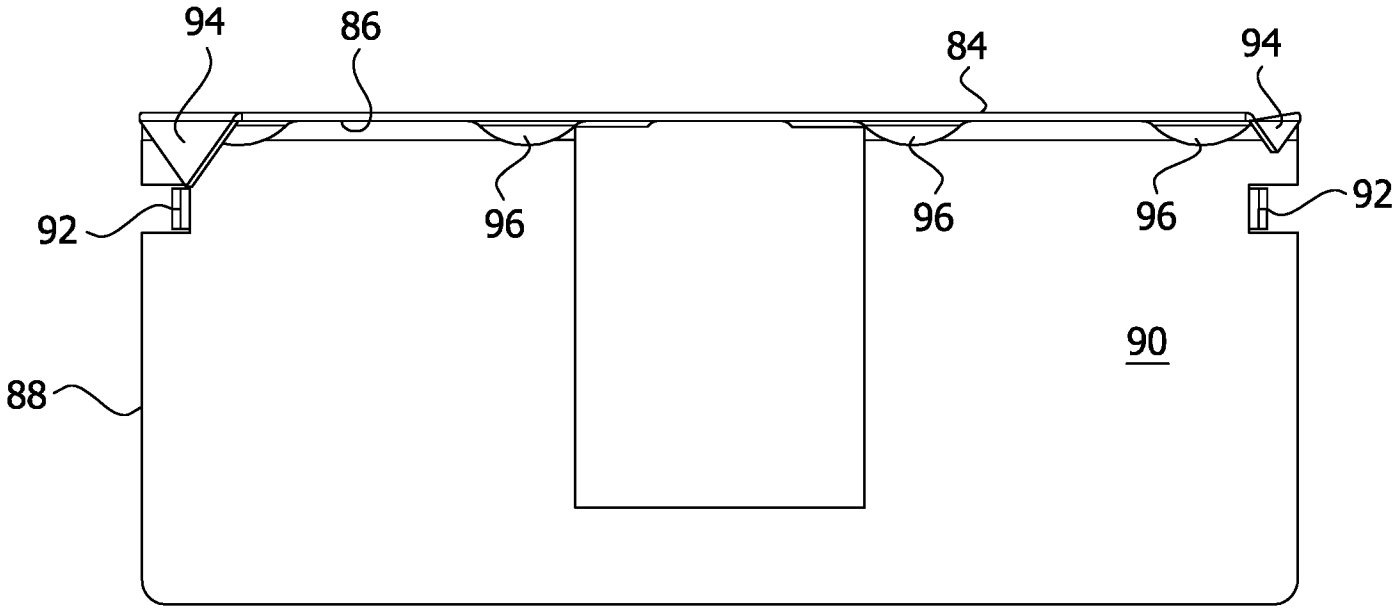
FIG. 23 is a bottom plan thereof.

As seen in FIG. 15, a truss hanger 26 as described above can be formed as one piece from a metal blank 80 that is stamped from a sheet metal roll and bent into shape. In one embodiment, the truss hanger 26 is stamped from 12-14 gauge steel, although other suitable materials are within the scope of the present invention. The configuration of the truss hanger 26 of the present invention allows a lighter gauge metal to be used.

In use, the truss hanger 26 is positioned in the slot 72 of the fire retardant sheathing 34 mounted on the wall 28. As seen in FIGS. 9-14A, one method of using the truss hanger 26 includes cutting the slot 72 in the fire retardant sheathing 34 (either before or after the sheathing is mounted on the wall). In one embodiment, the slot 72 can be cut using the slot template 82 (either before or after the sheathing 34 is mounted to the wall 28). The slot can be any suitable length, and in one embodiment is about 10 inches long. The truss hanger 26 is then positioned against the fire retardant sheathing 34 so that the extension flanges 60 extend through the slot 72. In one embodiment, the hanger 26 is slid downward into place so that the extension flanges 60 extend through the slot 72, the back flanges 66 are positioned adjacent the wall 28, and the fire retardant sheathing 34 is positioned in the sheathing channels 68 between the back flanges and the back panels 48. The hanger connector tabs 74 are fastened to the top plate 30 of the wall 28 by any suitable means, such as by inserting nail 78 through the nail holes 76. Then, a truss member, e.g. truss bottom chord 16, is positioned in the truss channel 52 of the hanger 26 (see FIG. 1), thereby securing the floor truss 12 to the wall 28. The truss hanger 26 is then fastened to the truss 12 by any suitable means, such as by inserting nails 56 through the nail holes 54 in each side panel 46 of the hanger. The hanger 26 is thus secured to both the truss 12 and the wall 28, with the fire retardant sheathing 34 secured between the hanger and the wall.

In another embodiment, the truss hangers 26 can be installed without pre-forming the slot 72 in the fire retardant sheathing 34. More particularly, each hanger 26 can be driven into the sheathing 34. The driving point 62 of the hanger 26 is positioned against a top edge of the fire retardant sheathing. The hanger 26 is then driven downward into the sheathing 34, led by the pointed tip 64. The hanger 26 continues to be driven into the gypsum boards until the connector tabs 74 engage the upper surface of the top plate 30. In this way, the hanger 26 forms the slot in the sheathing 34.

In still another embodiment, the truss hangers 26 can be installed on the wall 28 before the sheathing 34 is mounted on the wall. This simplifies construction by allowing the building to be completely framed and roofed before requiring the sheathing 34 to be installed. Trade workers (e.g., mechanical, electrical) therefore have complete access to the wall cavity to install components without interference from the sheathing 34. The truss hanger 26 is positioned against the wall 28 such that the back flanges 66 engage the wall and the connector tabs 74 engage the top plate 30. The connector tabs 74 are fastened to the top plate 30 of the wall by any suitable means, such as by inserting nails 78 through nail holes 76. Then, a truss 12 is positioned in the truss channel 52 of the hanger 26. The truss hanger is fastened to the truss 12 by any suitable means, such as by inserting nails 56 through the nail holes 54 in each side panel 46 of the hanger 26. The floor truss 12 is thereby secured to the hanger 26 and the wall 28, and access to the wall cavity remains unhindered by sheathing. Subsequently, the sheathing 34 can be mounted on the wall 28 by moving the sheathing upward into place so that the extension flanges 60 of the hanger 26 extend through the slot 72 of the sheathing and the sheathing is positioned in the sheathing channels 68 between the back flanges 66 and the back panels 48.

Referring to FIGS. 25-40, a second embodiment of a truss hanger 126 for use in mounting the floor truss 12 to the wall 28 is illustrated. The truss hanger 126 is similar to the truss hanger 26 described above, with differences as pointed out herein. Where the truss hanger 26 is configured for mounting the floor truss 12 generally orthogonal to the wall 28, the truss hanger 126 is configured for mounting the floor truss 12 in a skewed position relative to the wall.

Referring to FIGS. 26-33, the truss hanger 126 includes a channel-shaped portion 138, an extension portion 140, and a connection portion 142. The channel-shaped portion 138 is configured to receive the floor truss 12. The channel-shaped portion 138 is configured to support the floor truss 12 at a non-orthogonal angle relative to the wall 28. In this skewed embodiment, the channel-shaped portion 138 is offset from the extension portion 140. The channel-shaped portion 138 includes a seat or base 144 and a pair of side panels 146 extending upward from the base. When installed, the base 144 is generally horizontal, and the side panels 146 extend generally vertical from the base. A back panel 148 extends from one of the side panels 146*a* toward the opposing side panel 146*b*. The back panel 148 is generally perpendicular to both the side panels 146 and the base 144. When installed, the back panel 148 extends at a non-orthogonal angle (e.g., about 45°) to the interior face 50 of the fire retardant sheathing 34. The base 144, side panels 146, and back panel 148 form a channel 152 configured to receive the floor truss 12. Other configurations are within the scope of the present invention. For example, the truss hanger 126 can be configured to support the floor truss 12 at a range of different angles with respect to the wall 28.

Figure 25:
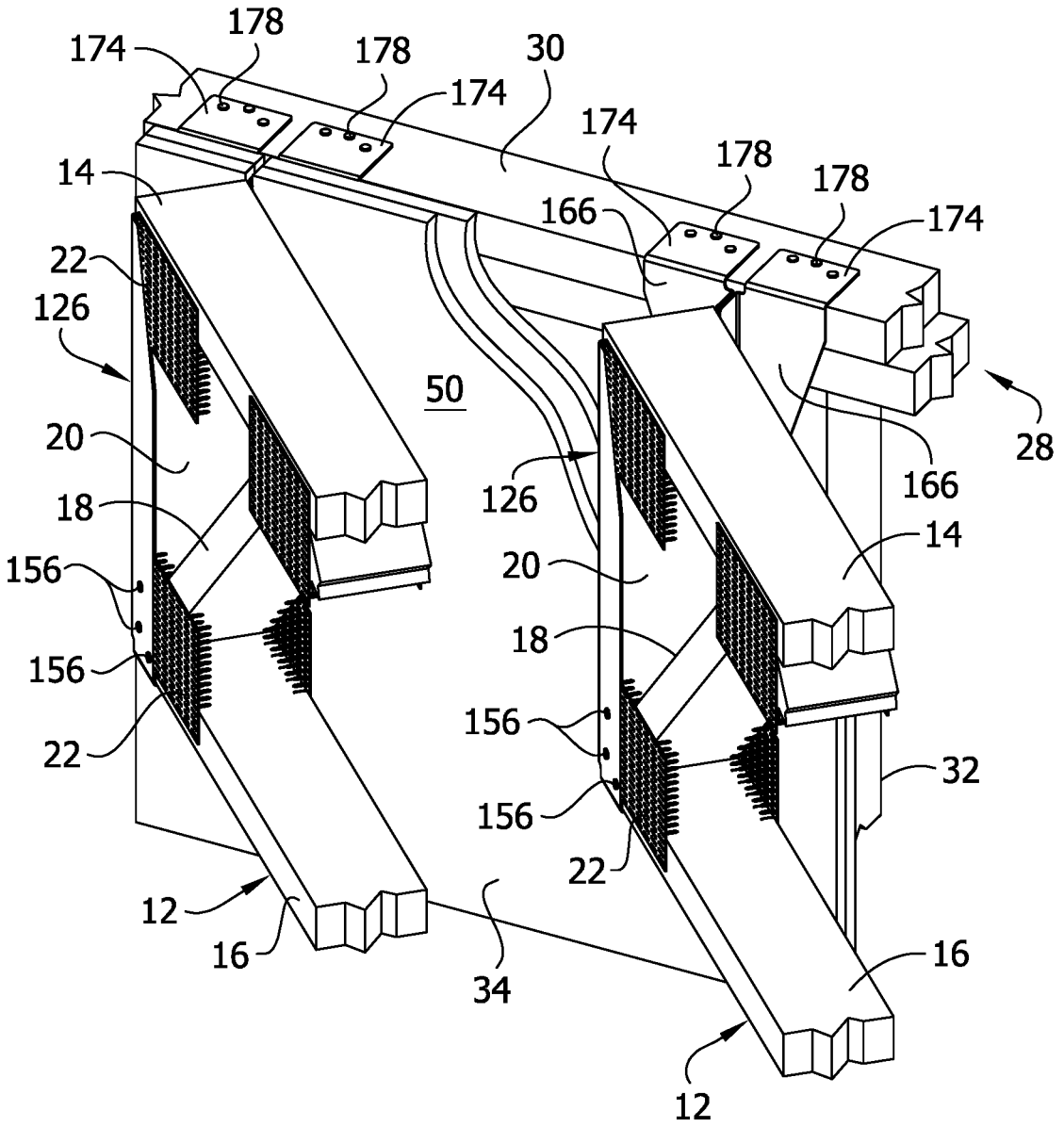
FIG. 25 is a fragmentary perspective of adjacent floor trusses connected at an angle to a wall having fire retardant sheathing by truss hangers of a second embodiment that extend through the sheathing.
Figure 26:
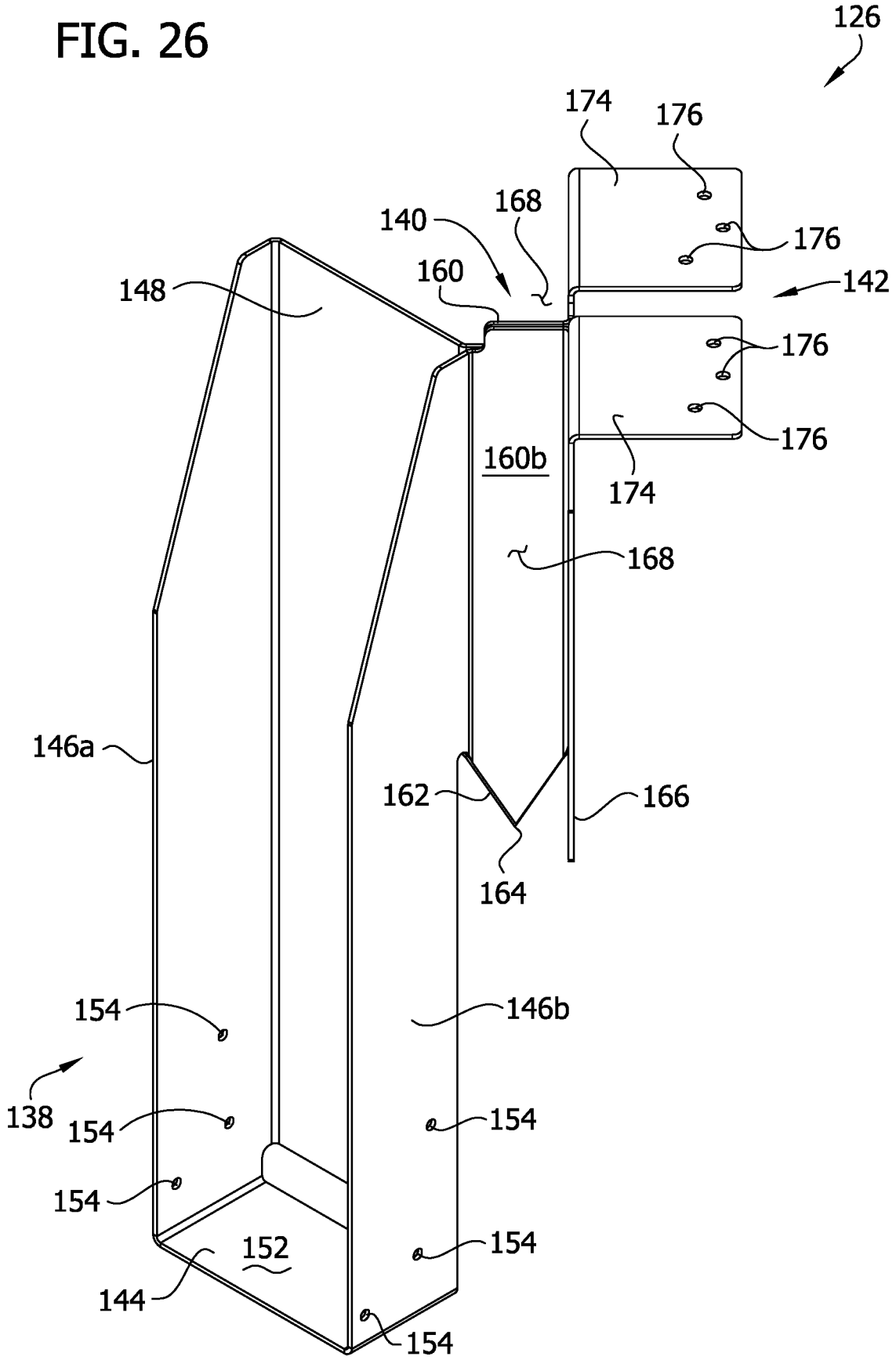
FIG. 26 is a perspective of one of the truss hangers of FIG. 25.
Figure 27:
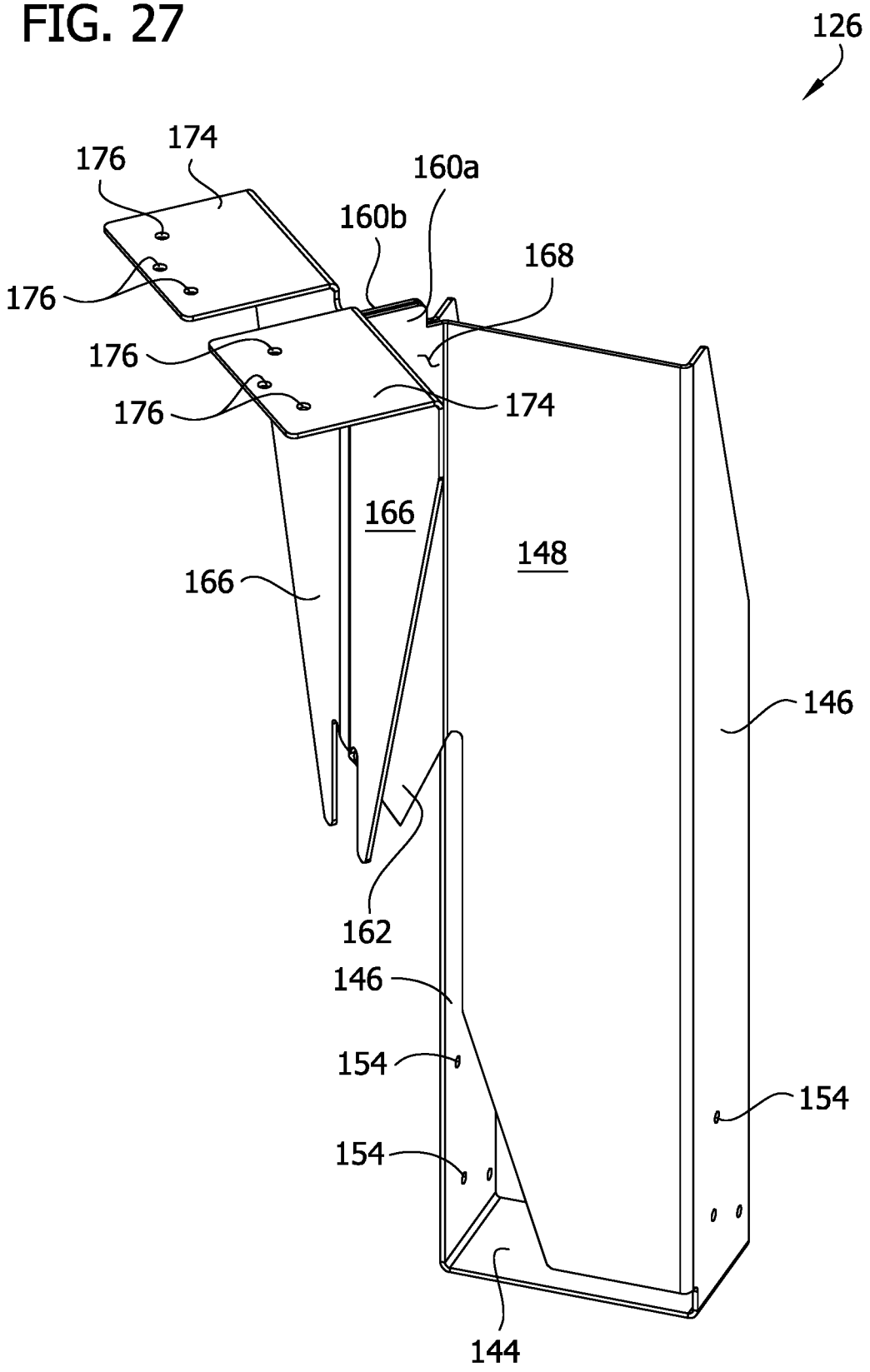
FIG. 27 is a rear perspective thereof.
Figure 39:
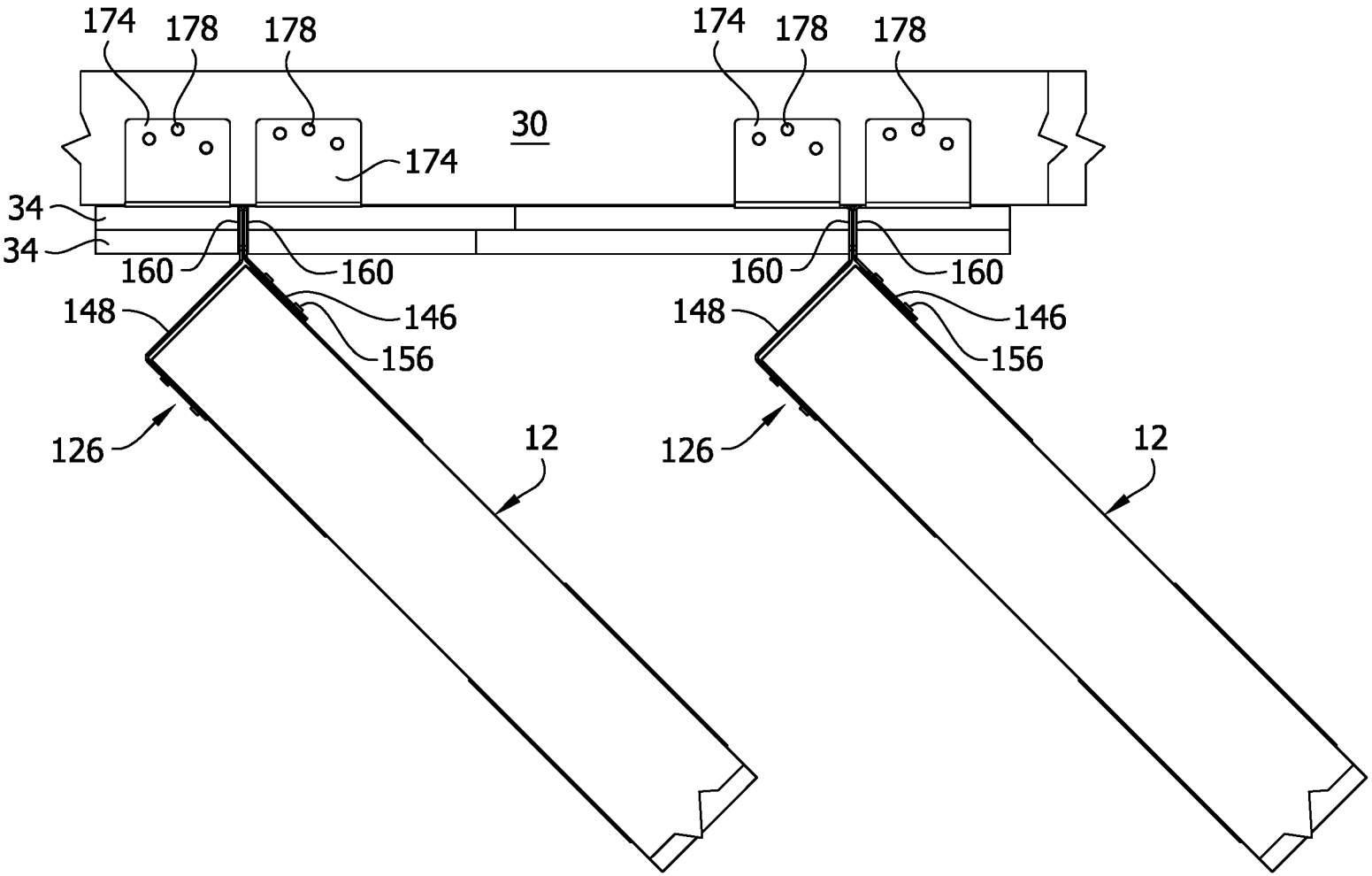
FIG. 39 is a top plan similar to FIG. 36, but showing a floor truss mounted in each truss hanger.

As seen in FIGS. 25 and 39, the floor truss 12 is received in the channel 152 to attach the floor truss to the wall 28 at a skewed angle. The bottom chord 16 of the floor truss 12 engages and rests upon (i.e., is supported by) the base 144. The end member 20 of the floor truss 12 is positioned against the back panel 148 between the side panels 146. The truss hanger 126 includes fastening structure for attaching the floor truss 12 to the truss hanger. Fastening structure can be of any type known in the art for attaching a connector to a wooden structural member, such as nailing teeth (not shown) struck from the material of the hanger. In the illustrated embodiment, the fastening structure comprises a hole to allow for insertion of a fastening member. More specifically, in one embodiment the fastening structure comprises nail holes 154 in the side panels 146 of the truss hanger 126 (see, FIG. 26), and the fastening member comprises a nail 156 (see, FIG. 25). In the illustrated embodiment, nail holes 154 are positioned on each of the side panels 146 so that nails 156 can be inserted into both the bottom chord 16 and the end member 20 of the floor truss 12 to attach the hanger 126 to the floor truss.

Figure 28:
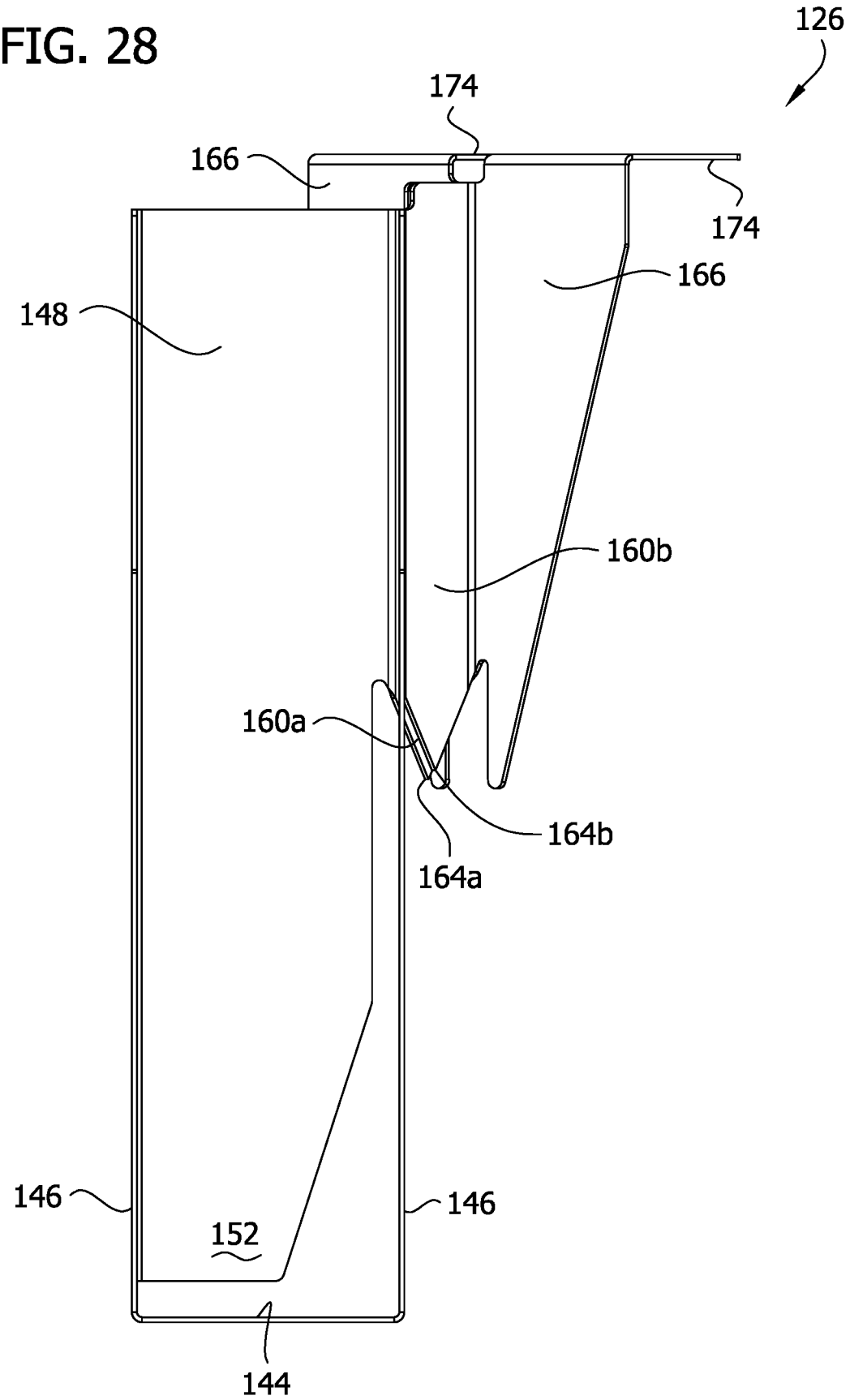
FIG. 28 is a front elevation thereof.
Figure 29:
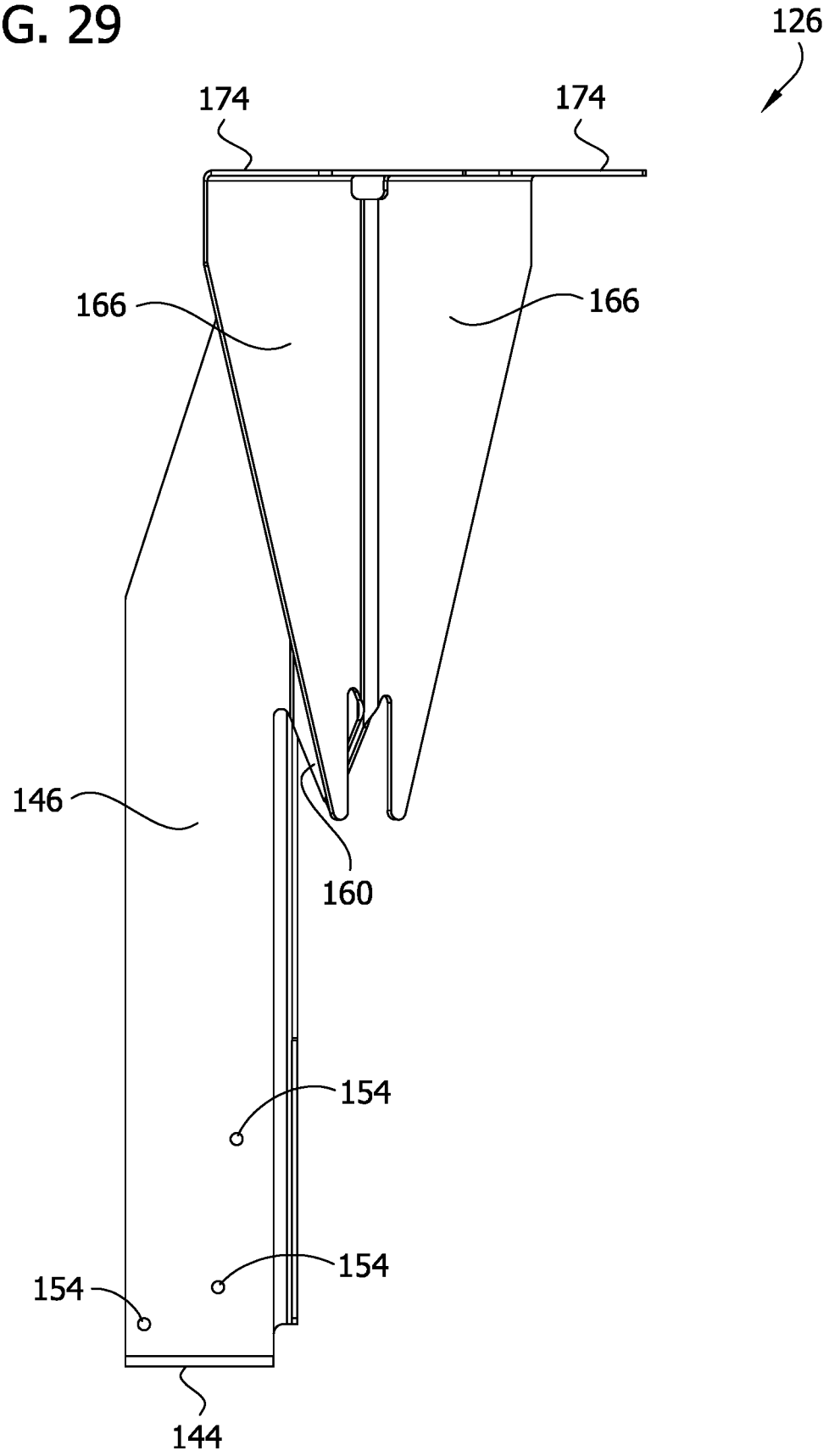
FIG. 29 is a right side elevation thereof.
Figure 30:
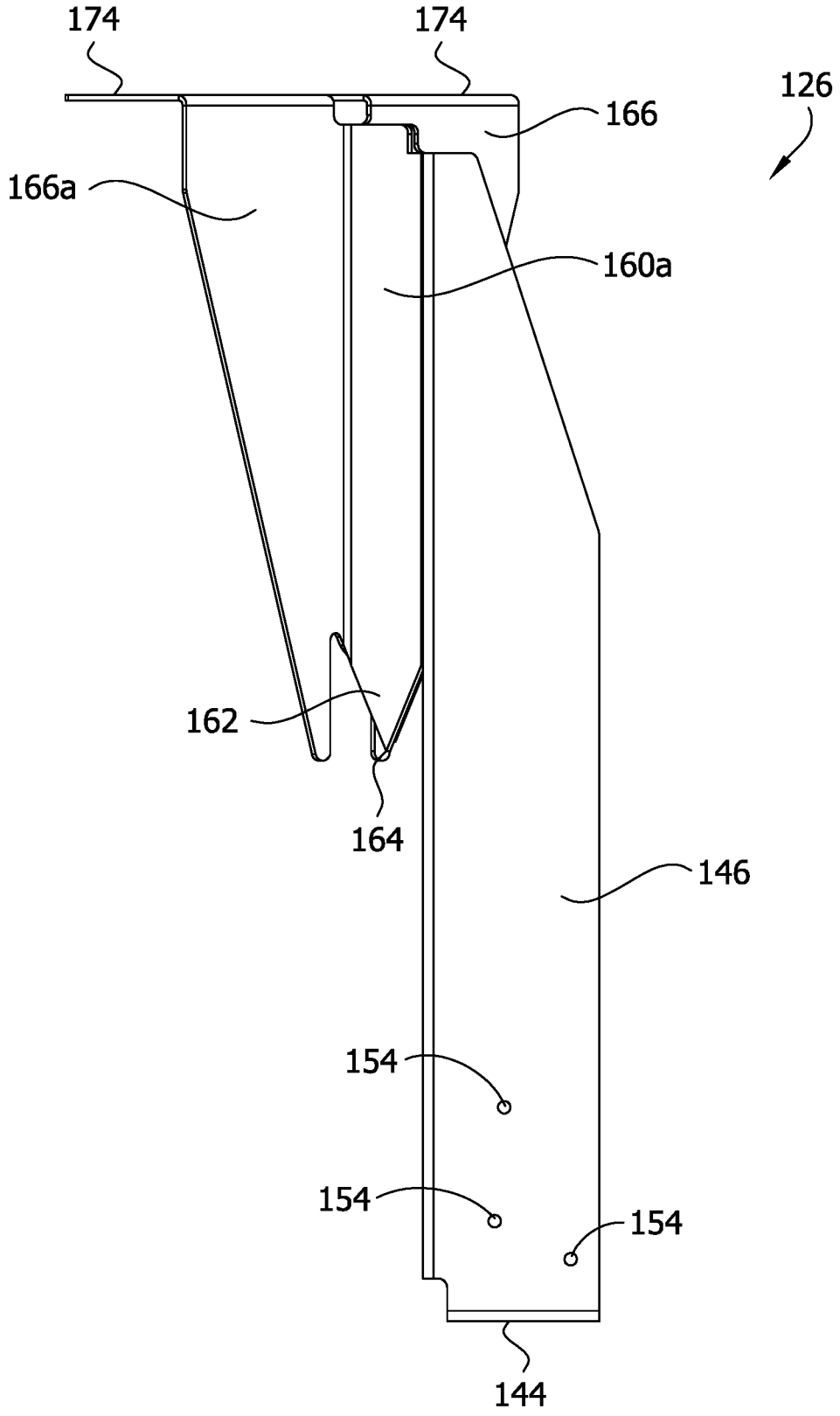
FIG. 30 is a left side elevation thereof.
Figure 31:
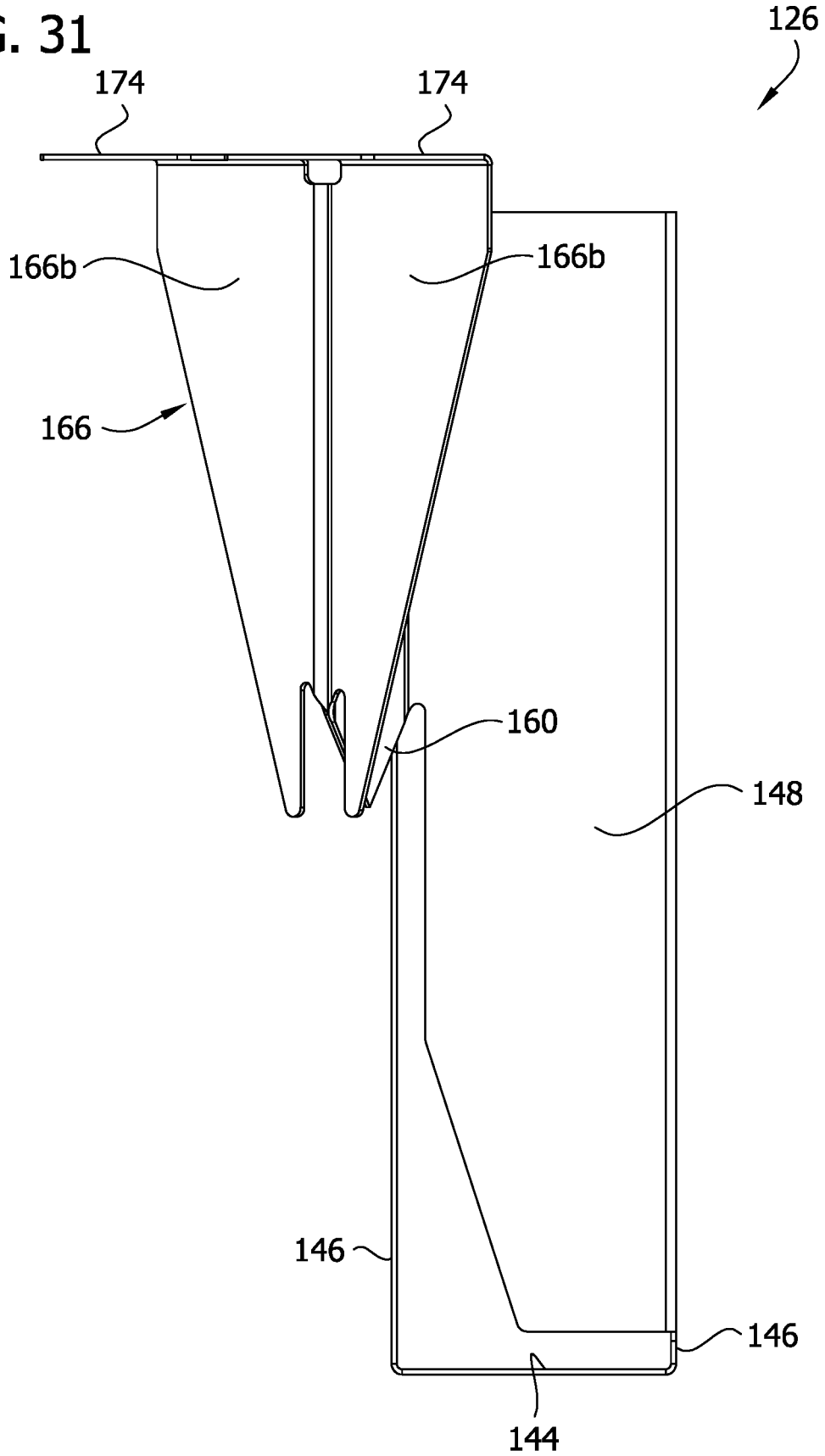
FIG. 31 is a rear elevation thereof.
Figure 32:
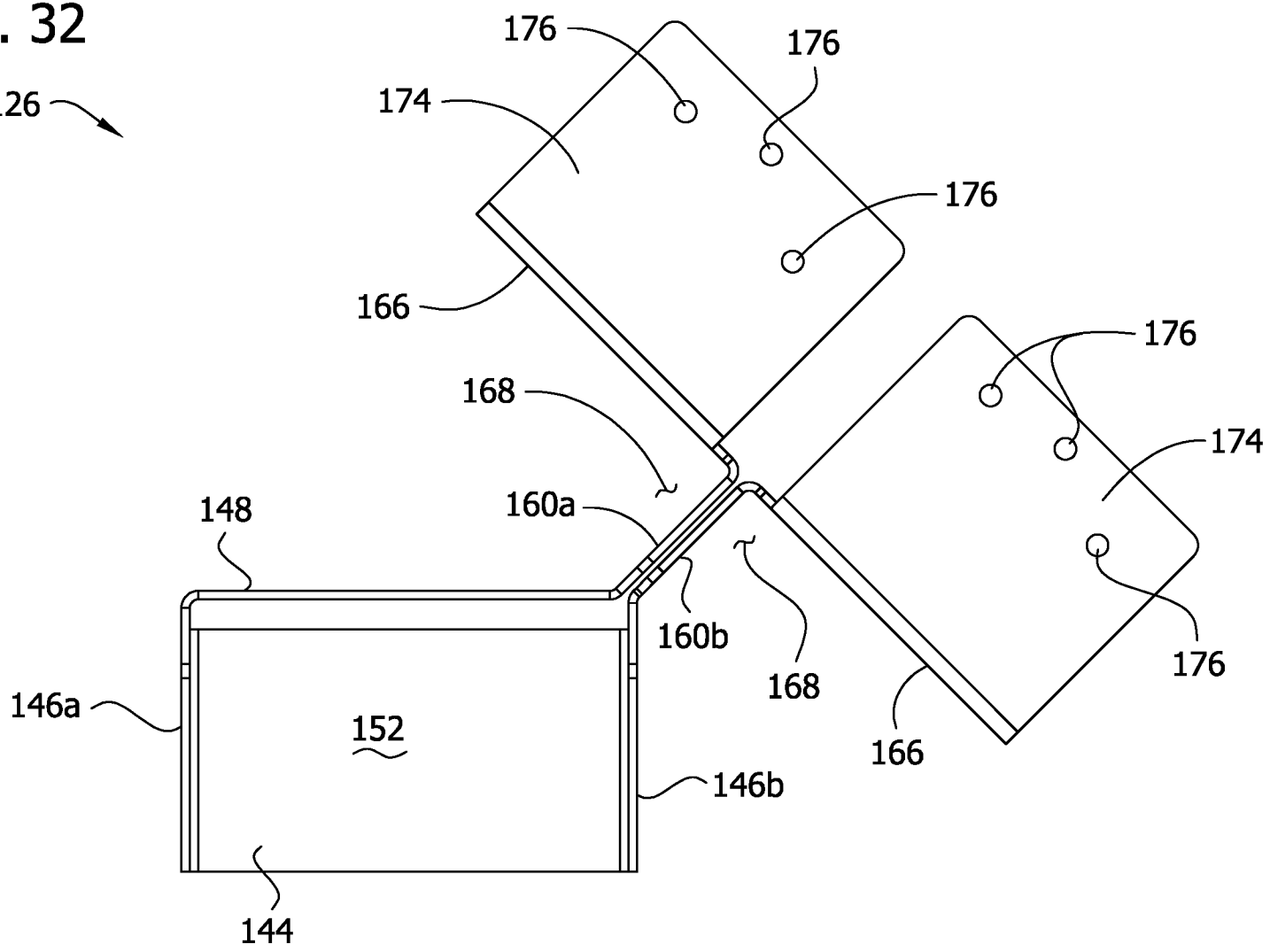
FIG. 32 is a top plan thereof.
Figure 33:
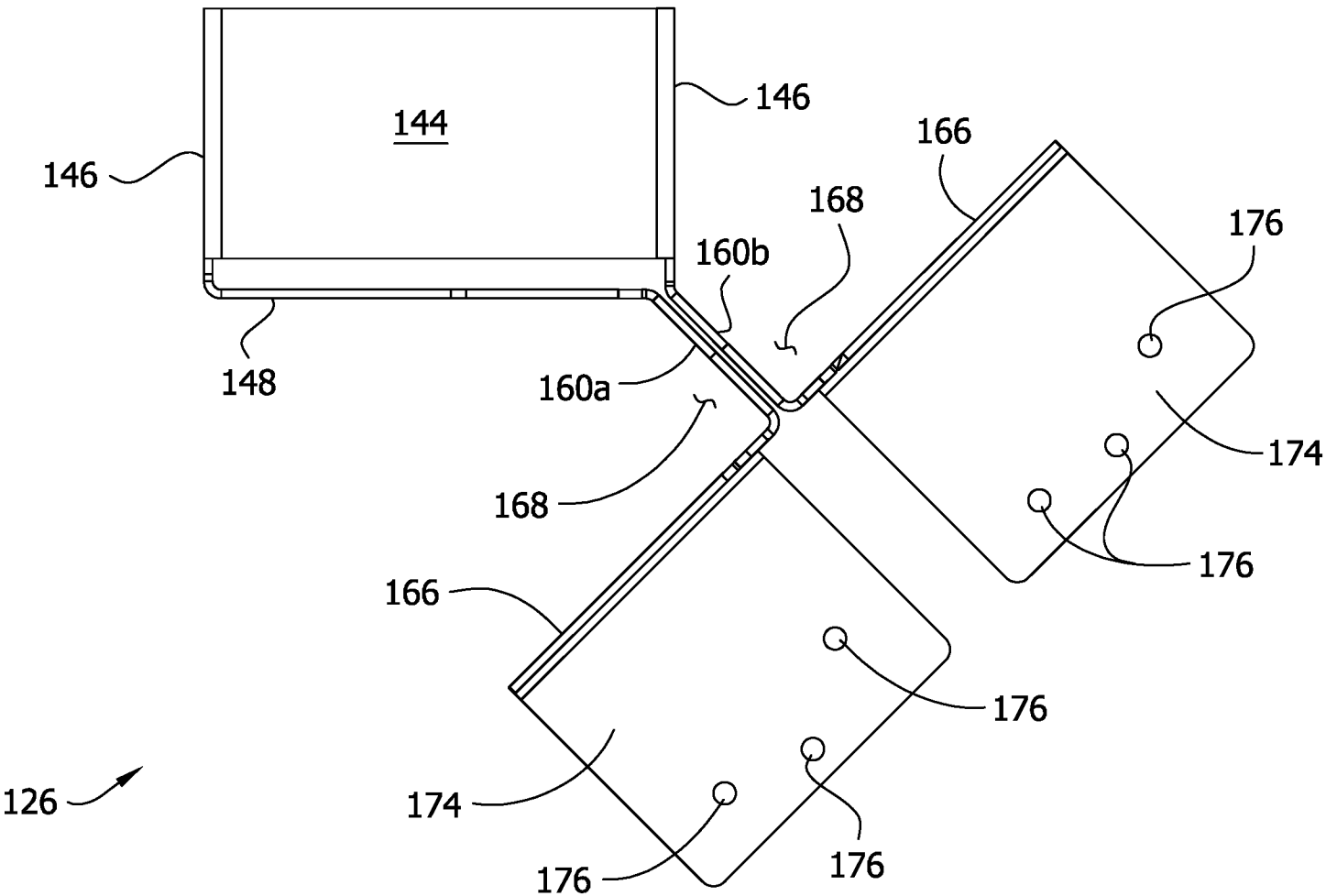
FIG. 33 is a bottom plan thereof.

Referring again to FIGS. 26-33, the extension portion 140 includes two extension flanges 160 configured to extend through the fire retardant sheathing 34. One of the flanges 160*a* extends from the back panel 148. The other flange 160*b* extends from the side panel 146*b*. The flanges 160 are positioned in opposed, face-to-face relation, and preferably engage each other along a juncture. At a bottom edge, each flange 160 includes a driving point 162. Each of the driving points 162 is generally triangular and includes a pointed tip 164. As seen in FIG. 28, the tips 164 of the driving points 162 are vertically offset from each other. As illustrated, the tip 164*a* of one flange 160*a* extends vertically below the tip 164*b* of the other flange 160*b*. In one embodiment, the tips 164 are vertically offset from each other about ⅛", although other configurations are within the scope of the present invention, such as tips that are aligned or tips that are offset a smaller or larger amount.

Figure 38:
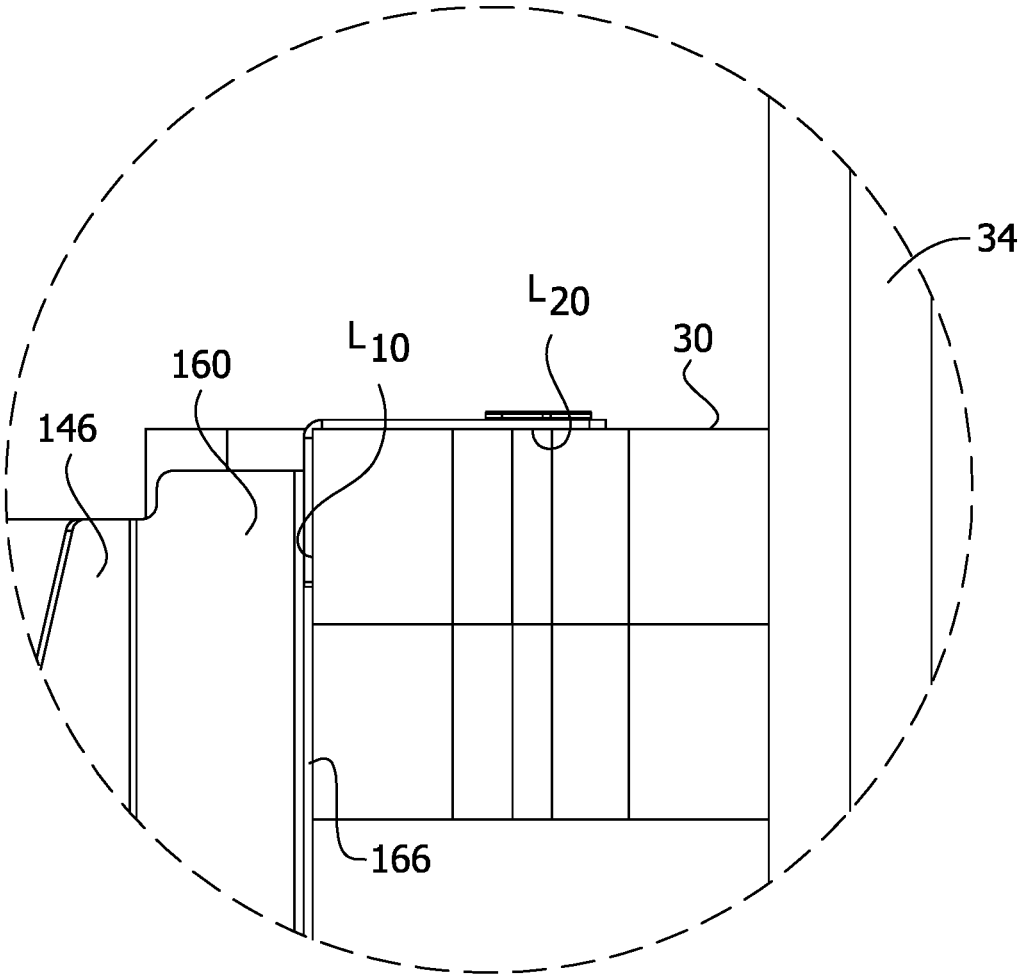
FIG. 38 is an enlarged fragment of FIG. 37.

A back flange 166 extends from the extension flange 160 generally perpendicular from the extension flange. Referring to FIG. 38, the back flange 166 engages the wall 28 at a first location L 10, which in the illustrated embodiment is a vertical face of the top plate 30 of the wall behind the fire retardant sheathing 34. The back flange 166 comprises a back flange portion 166*a* bent from the extension flange 160*a* and a back flange portion 166*b* bent from the extension flange 160*b*. The back panel 148, side panel 146*b*, extension flanges 160, and back flange 166 form a pair of sheathing channels 168 (see, FIG. 32). Each sheathing channel 168 is configured to receive a portion of the fire retardant sheathing 34.

Figure 34:
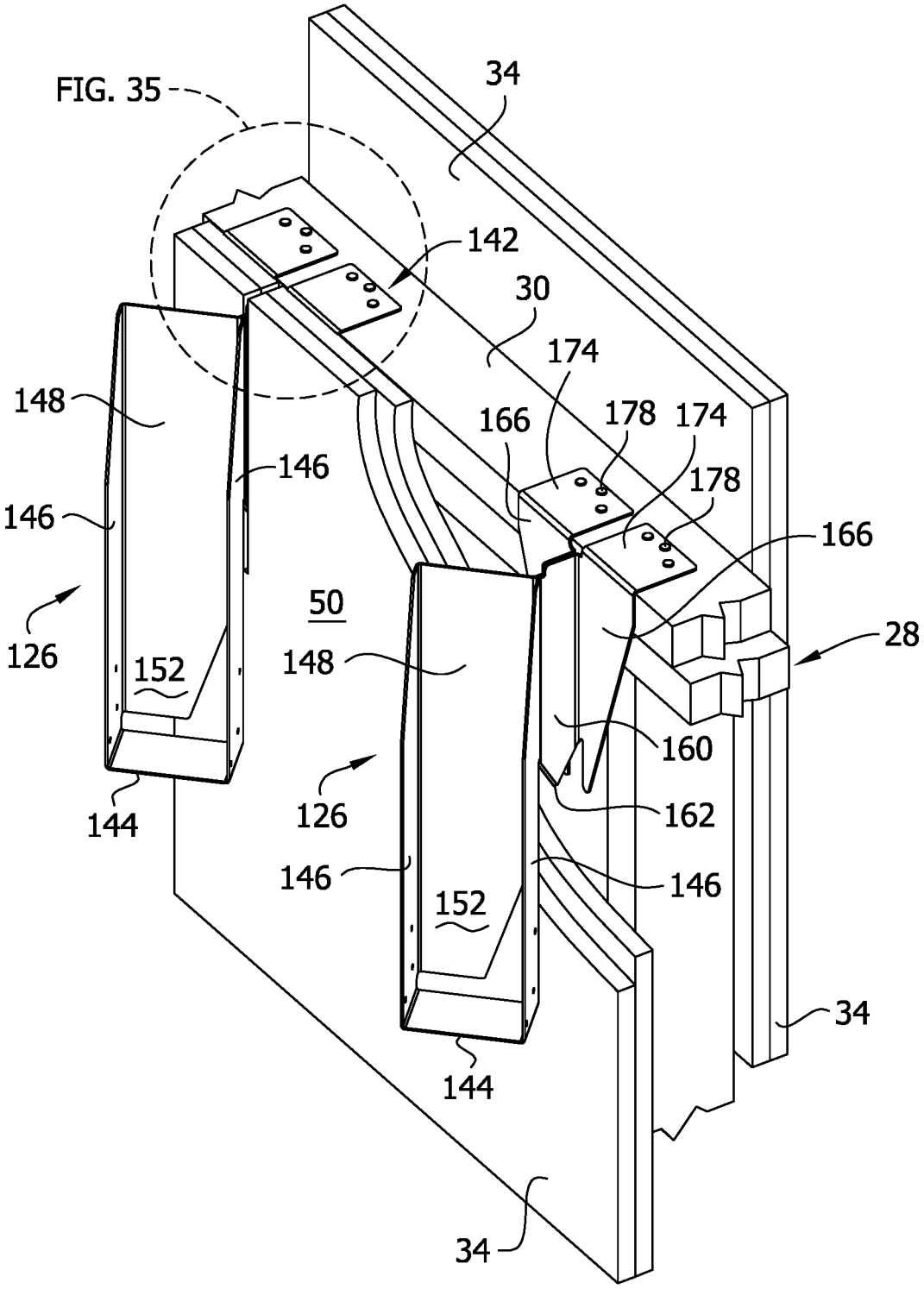
FIG. 34 is a perspective of a wall and the two truss hangers mounted thereon with parts broken away.
Figure 35:
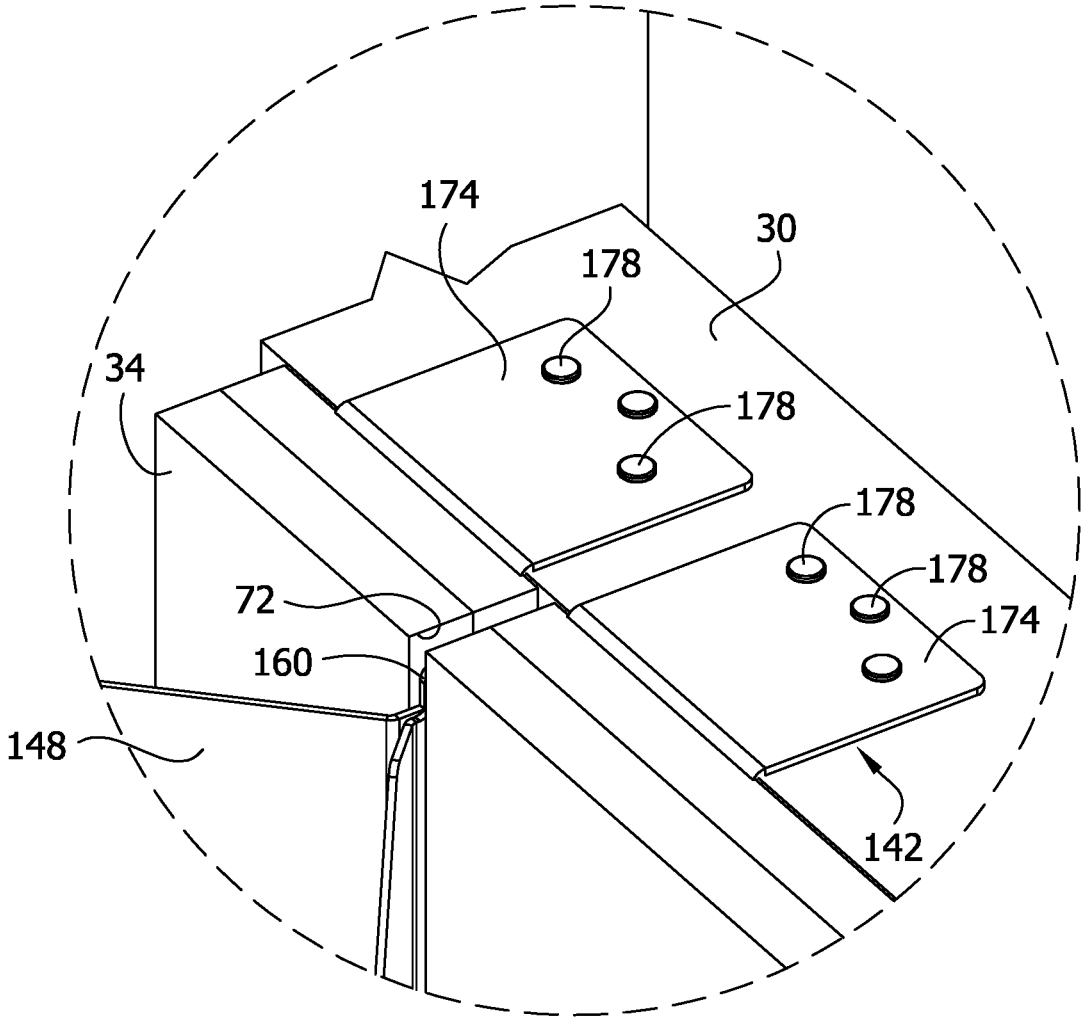
FIG. 35 is an enlarged fragmentary perspective of FIG. 34.
Figure 36:
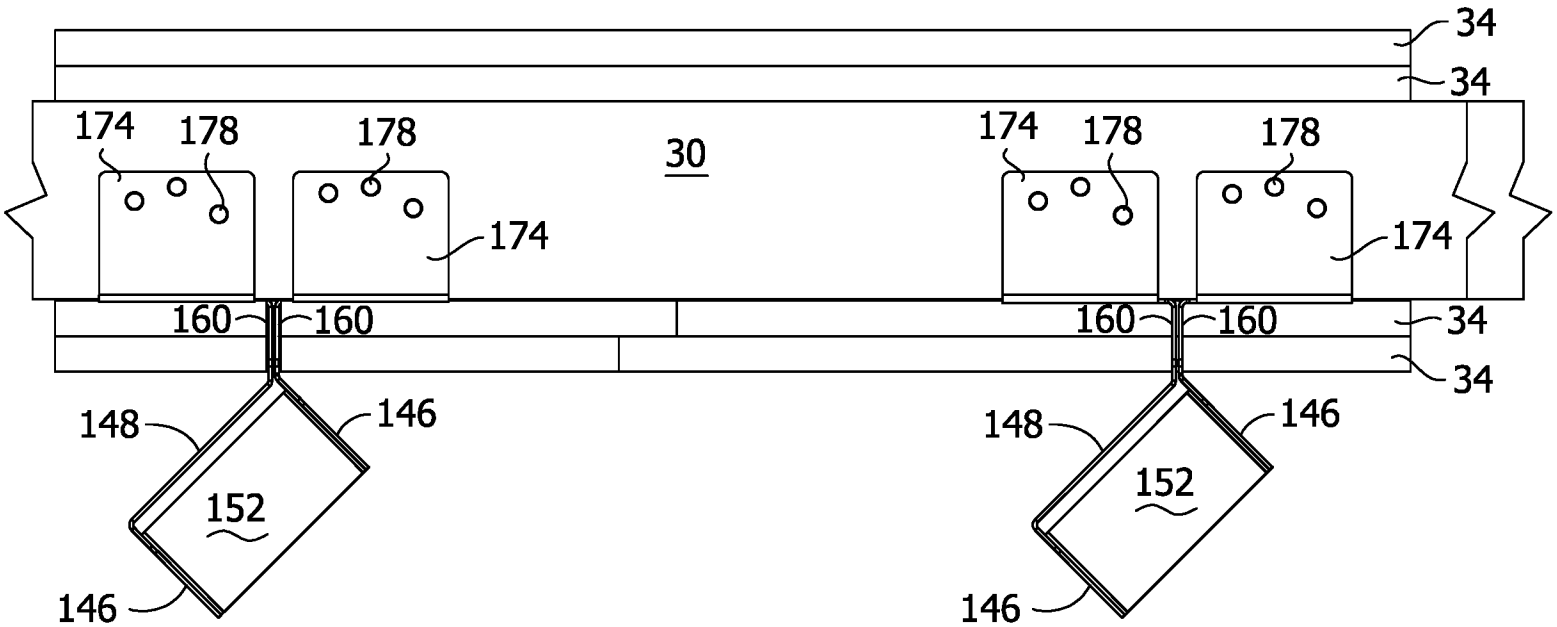
FIG. 36 is a top plan of FIG. 34, illustrating the truss hangers extending through the fire retardant sheathing.
Figure 37:
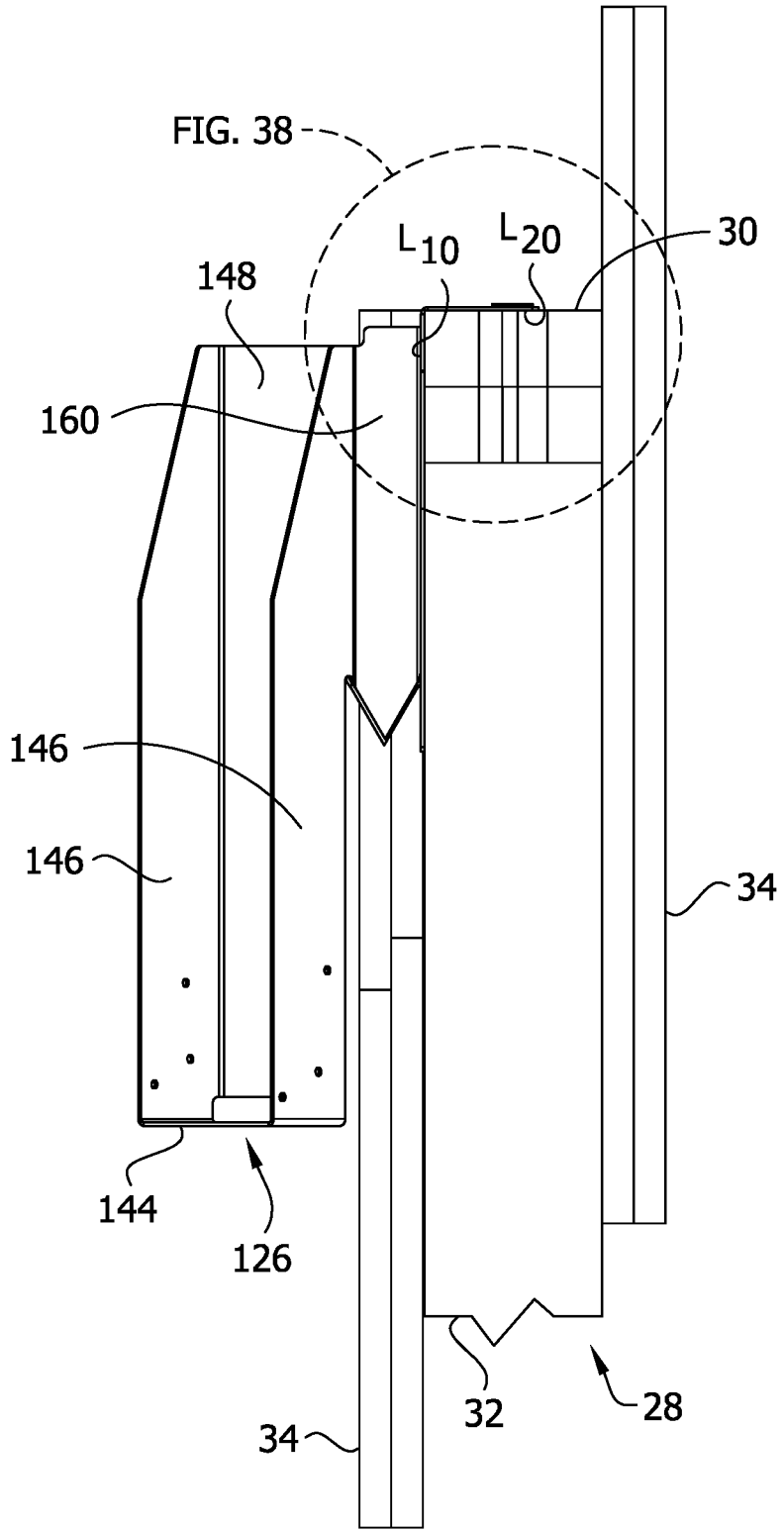
FIG. 37 is a side elevation of FIG. 34.

As seen in FIGS. 34-36, the extension flanges 160 extend through the slot 72 in the fire retardant sheathing 34. Preferably, the slot has an area less than or equal to 6 square inches, and the gap between the extension flanges 60 and the edge of the slot 72 is less than or equal to ⅛". The driving points 162 extend down into the sheathing 34 to engage the sheathing and further secure the sheathing between the hanger 126 and the wall 28. A portion of the fire retardant sheathing 34 extends into each sheathing channel 168 and is secured against the back flange 166.

Referring again to FIGS. 26-33, the connection portion 142 of the hanger 126 includes a pair of connector tabs 174 extending from the back flange portions 166*a*, 166*b*. Each connector tab 174 extends generally perpendicular from a respective one of the back flanges 166*a*, 166*b*. The connector tabs 174 are generally horizontal when the hanger 126 is installed. The connector tabs 174 are configured to overlie and engage an upper surface of the top plate 30 of the wall 28 at a second location La) spaced from the first location $L_{10}$ (see, FIGS. 37 and 38). The connector tabs 174 can be used to attach the truss hanger 126 to the wall 28, thereby hanging the floor trusses 12 from the wall. As seen in FIG. 25, the connector tabs 174 extend over a portion of the top plate 30 of the wall 28. Each connector tab 174 includes fastening structure, such as nail holes 176, for insertion of a fastening member, such as nails 178 (see FIGS. 34 and 35), to attach the hanger 126 to the wall 28. In the illustrated embodiment, each connector tab 174 includes three nail holes 176. Other configurations are within the scope of the present invention, such as a different number of nail holes, or alternate fastening structure such as nailing teeth or other appropriate structure for fastening the hanger to the wall.

The base 144 and back flanges 166 cooperate to stabilize the truss hanger 126 and protect the fire retardant sheathing 34 from exposure to the loads transferred from the truss 12 to the wall 28 by way of the truss hanger 126. The channel 152 that receives an end portion of the truss 12 is spaced to the interior of the wall 28 and more particularly to the interior of the second location $L_{20}$ where the connector tabs 174 are attached to an upper surface of the top plate 30 (see FIG. 38). The vertically downward load of the truss 126 applied to the base 144 of the truss hanger 126 urges the truss hanger to pivot so that the base would move toward the wall 28, which could damage the fire retardant sheathing 34 and pry out the nails 178 connecting the connector tabs 174 to the upper surface of the top plate 30. However, this motion is resisted by the engagement of the back flanges 166 with the interior vertical face of the top plate 30 at the first location $L_{10}$. Thus, there is a force couple between the base 144 and back panel 148 of the hanger 126 (via engagement of the back flanges 166 with the top plate 30) engaging the end fact of the truss. Accordingly, the truss hanger 126 and truss 12 are stable with minimal disruption of the fire retardant sheathing 34, even though the truss is held at a distance from the wall 28.

Figure 40:
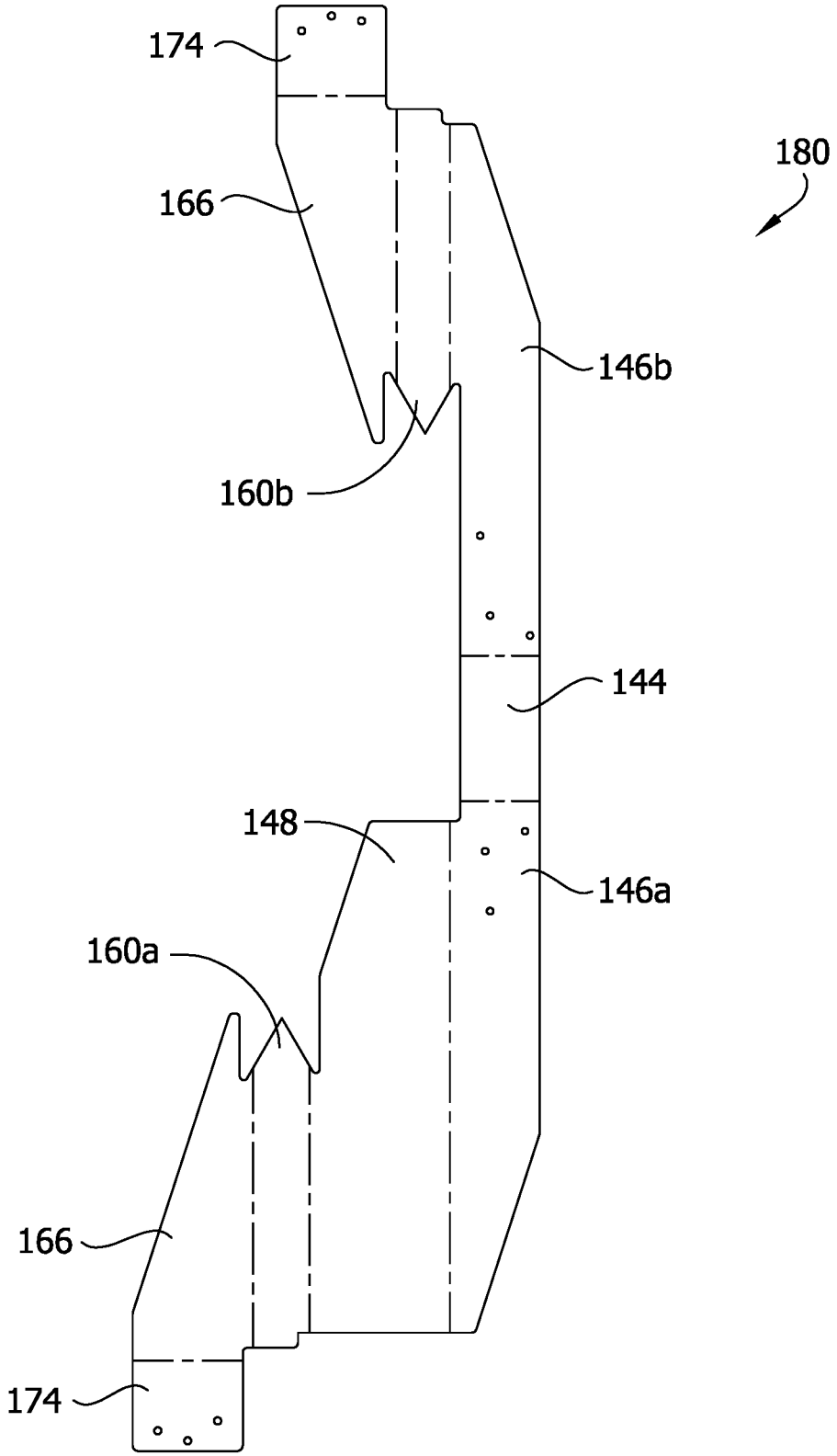
FIG. 40 is a front view of a stamped metal blank for forming a truss hanger according to the present invention.

As seen in FIG. 40, a truss hanger 126 as described above can be formed as one piece from a metal blank 180 that is stamped from a sheet metal roll and bent into shape. Parts of the blank 180 are labelled with reference numerals corresponding to the various parts of the formed truss hanger 126. In one embodiment, the truss hanger 126 is stamped from 12-14 gauge steel, although other suitable materials are within the scope of the present invention. The configuration of the truss hanger 126 of the present invention allows a lighter gauge metal to be used.

The truss hanger 126 is used as described above with reference to the truss hanger 26. In use, the truss hanger 126 is positioned in the slot 72 of the fire retardant sheathing 34 mounted to the wall 28. One method of using the truss hanger 126 includes cutting the slot 72 in the fire retardant sheathing 34 (either before or after the sheathing is mounted on the wall). In one embodiment, the slot 72 can be cut using the slot template 82 (either before or after the sheathing 34 is mounted to the wall 28). The slot 72 can be any suitable length, and in one embodiment is about 10 inches long. The truss hanger 126 is then positioned against the fire retardant sheathing 34 so that the extension flanges 160 extend through the slot 72. In one embodiment, the hanger 126 is slid downward into place so that the extension flanges 160 extend through the slot 72, the driving point 162 engages the fire retardant sheathing 34, the back flange 166 is positioned adjacent the wall 28, and the fire retardant sheathing is positioned in the sheathing channels 168 of the hanger. The hanger connector tabs 174 are fastened to the top plate 30 of the wall 28 by driving nails 178 through the nail holes 176 into the top plate 30. Then, a truss member, e.g. truss bottom chord 16 is positioned in the truss channel 152 of the hanger 126. Nails 156 are driven through holes 154 in the side panels 146 to secure the floor truss 12 to the wall 28. The hanger 126 is thus secured to both the truss 12 and the wall 28, with the fire retardant sheathing 34 between the hanger and the wall.

In another embodiment, the truss hangers 126 can be installed without pre-forming the slot 72 in the fire retardant sheathing 34. More particularly, each hanger 126 can be driven into the sheathing 34. The pointed tip 164 of the driving point 162 of the hanger 126 is positioned against a top edge of the fire retardant sheathing 34. The hanger 126 is then driven downward into the sheathing 34, led by the pointed tip 164. The hanger 126 continues to be driven into the gypsum boards until the connector tabs 174 engage the upper surface of the top plate 30. In this way, the hanger 126 forms the slot in the sheathing 34.

In another embodiment, the truss hangers 126 can be installed on the wall 28 before the sheathing 34 is mounted on the wall. This simplifies construction by allowing the building to be completely framed and roofed before requiring the sheathing 34 to be installed. Trade workers (e.g., mechanical, electrical) therefore have complete access to the wall cavity to install components without interference from the sheathing 34. The truss hanger 126 is positioned against the wall 28 such that the back flange 166 engages the wall and the connector tabs 174 engage the top plate 30. The connector tabs 174 are fastened to the top plate 30 of the wall by any suitable means, such as by inserting nails 178 through nail holes 176. Then, a truss 12 is positioned in the truss channel 152 of the hanger 126. The truss hanger 126 is fastened to the truss 12 by any suitable means, such as by inserting nails 156 through the nail holes 154 in each side panel 146 of the hanger. The floor truss 12 is thereby secured to the hanger 126 and the wall 28, and access to the wall cavity remains unhindered by sheathing. Subsequently, the sheathing 34 can be mounted on the wall 28 by moving the sheathing upward into place so that the extension flanges 160 of the hanger 126 extend through the slot 72 of the sheathing and the sheathing is positioned in the sheathing channels 168 of the hanger.

The truss hanger 26, 126 permits a floor truss 12 to be secured to a wall 28 through fire retardant sheathing 34 with minimal interruption to the sheathing. Installation of the truss hanger minimally disrupts the continuity of the sheathing and therefore does not reduce the fire resistive rating of a fire rated assembly. The extension flanges 60, 160 extend through the fire retardant sheathing 34 so that the sheathing is interrupted only by the slot 72 required to receive the flanges. The back flanges 66, 166 engage the wall 28 behind the sheathing 34 to stabilize the hanger 26, 126 and protect the sheathing. The truss hanger 26, 126 can be mounted on a wall already having sheathing mounted thereon, or can be mounted on a wall before the sheathing (i.e., the sheathing does not have to be mounted on the wall before the truss hanger), thereby simplifying construction. The truss hanger 26, 126 can be formed from a metal blank 80, 180, which reduces the number of parts required to hang the floor truss 12 and simplifies the manufacturing process.

In an independent test performed by an outside firm, the truss hanger was installed as part of a wall assembly including 2×6 wood studs, 24" on center, with two layers of ⅝" Type X gypsum attached to each side. The gypsum board included a slot to accommodate the hanger. The hanger was fixed to the top plate of the wall with six 10d common nails in the connector tabs. The cavities in the wall were filled with mineral wool insulation. The testing was performed per ASTM E814 which subjected the specimen to the time/temperature curve prescribed in ASTM E119 for a period of two hours, followed by a hose stream test. As a result of this testing, the outside firm reported that when installed on one side of a maximum 2 hour fire-rated wall assembly, the penetration of the truss hanger through the gypsum board will not reduce the fire resistive rating of the 2 hour fire resistive assembly.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A fire wall hanger for connecting a structural component to a frame wall adapted to have two layers of drywall mounted thereon to form a fire separation wall, the fire wall hanger comprising:

a channel-shaped portion configured to receive the structural component, the channel-shaped portion including a base configured to receive an end portion of the structural component thereon to support the structural component, the base having an upper surface arranged to engage the structural component, the upper surface lying in a base plane, the channel-shaped portion including a side panel extending from the base;

a connection portion including a top flange arranged to engage a top surface of a top plate of the frame wall and a back flange extending from an edge of the top flange, the back flange arranged to engage a vertical face of the top plate of the frame wall, the back flange having a planar front surface lying in a back flange plane; and an extension portion including first and second extension plates extending from the channel-shaped portion to the connection portion, the first and second extension plates spacing the channel-shaped portion from the back flange plane by a distance sized large enough to permit the two layers of drywall of the fire separation wall to be received between the channel-shaped portion and the back flange plane, the first and second extension plates being parallel to one another;

wherein the channel-shaped portion, the extension portion and the connection portion are rigidly fixed with respect to one another; and wherein the side panel of the channel-shaped portion is spaced apart from the planar front surface of the back flange of the connection portion along an axis that is normal to the planar front surface of the back flange of the connection portion, the axis intersecting the side panel of the channel-shaped portion and intersecting the planar front surface of the back flange of the connection portion.

2. The fire wall hanger of claim 1, wherein the edge of the top flange the back flange extends from is a front edge of the top flange.

3. The fire wall hanger of claim 2, wherein a bend directly connects the back flange to the front edge of the top flange.

4. The fire wall hanger of claim 3, wherein each of the first and second extension plates includes a bottom edge, the channel-shaped portion and the bottom edges of the first and second extension plates bounding a drywall space sized and shaped to receive the two layers of drywall therein, each bottom edge extending from the channel-shaped portion to the connection portion, each of the bottom edges being a free edge.

5. The fire wall hanger of claim 4, wherein the bottom edge of the first extension plate forms a first driving point, and the bottom edge of the second extension plate forms a second driving point.

6. The fire wall hanger of claim 4, wherein:

the first extension plate is directly connected to the channel-shaped portion by a first connection, the first connection having a first upper end and a first lower end, the first connection extending from the first upper end to the first lower end in a first direction;

the second extension plate is directly connected to the channel-shaped portion by a second connection, the second connection having a second upper end and a second lower end, the second connection extending from the second upper end to the second lower end in a second direction;

the first extension plate is directly connected to the connection portion by a third connection, the third connection having a third upper end and a third lower end, the third connection extending from the third upper end to the third lower end in a third direction;

the second extension plate is directly connected to the connection portion by a fourth connection, the fourth connection having a fourth upper end and a fourth lower end, the fourth connection extending from the fourth upper end to the fourth lower end in a fourth direction; and the first, second, third, and fourth directions are parallel to one another, and the first, second, third, and fourth directions are perpendicular to the base plane.

7. The fire wall hanger of claim 6, wherein each of the first, second, third, and fourth connections comprises a bend, wherein:

the first extension plate and the channel-shaped portion form the bend of the first connection;

the second extension plate and the channel-shaped portion form the bend of the second connection;

the first extension plate and the connection portion form the bend of the third connection; and the second extension plate and the connection portion form the bend of the fourth connection.

8. The fire wall hanger of claim 6, wherein the third connection directly connects the first extension plate to the back flange, wherein the first and second extension plates each include an inner face and an outer face, the inner faces of the first and second extension plates facing one another, the inner face of the first extension plate facing in a fifth direction toward the inner face of the second extension plate and the outer face of the first extension plate facing in a sixth direction that is opposite the fifth direction, the back flange extending outward, in the sixth direction, from the third connection directly connecting the first extension plate and the back flange.

9. The fire wall hanger of claim 8, wherein the top flange extends in a direction rearwardly away from the channel-shaped portion, the top flange including a rear edge located rearwardly of the back flange.

10. The fire wall hanger of claim 9, wherein the channel-shaped portion and the first and second extension plates are formed as one-piece of sheet metal.

11. The fire wall hanger of claim 10, wherein the side panel of the channel-shaped portion is a first side panel, wherein the channel-shaped portion includes a second side panel extending from the base, wherein the base of the channel-shaped portion comprises a unitary portion of the one-piece of sheet metal, wherein the first and second side panels of the channel-shaped portion are each a unitary portion of the one-piece of sheet metal and are unitary extensions of the unitary portion of the base, and wherein the first and second extension plates are each a unitary portion of the one-piece of sheet metal and are unitary extensions of the sheet metal forming the channel-shaped portion.

12. The fire wall hanger of claim 11, wherein the axis intersects the planar front surface of the back flange at a location spaced apart from a perimeter of the planar front surface, and wherein the axis is spaced apart from the first and second extension plates of the extension portion.

13. The fire wall hanger of claim 10, wherein the channel-shaped portion, the connection portion, and the first and second extension plates are formed as one-piece of sheet metal.

14. The fire wall hanger of claim 10, wherein the drywall space has an open lower end between the channel-shaped portion and the back flange plane, the open lower end sized and shaped to permit the two layers of drywall to be inserted therethrough.

15. The fire wall hanger of claim 1, wherein the first and second extension plates and the channel-shaped portion bound a drywall space sized and shaped to receive the two layers of drywall therein.

16. The fire wall hanger of claim 1, wherein the axis intersects the planar front surface of the back flange at a location spaced apart from a perimeter of the planar front surface.

17. The fire wall hanger of claim 16, wherein the axis is spaced apart from the first and second extension plates of the extension portion.

18. A fire wall hanger for connecting a structural component to a frame wall adapted to have two layers of ⅝-inch-thick drywall mounted thereon to form a fire separation wall, the fire wall hanger consisting of:

a channel-shaped portion configured to receive the structural component, the channel-shaped portion including a base configured to receive an end portion of the structural component thereon to support the structural component, the base having an upper surface arranged to engage the structural component, the upper surface lying in a base plane, the base having a rear edge;

a first top plate shaped and arranged to engage a top surface of a top plate of the frame wall;

a first back plate shaped and arranged to engage a vertical face of the top plate of the frame wall, the first back plate being directly connected to the first top plate by a first bend, the first back plate and the first top plate forming the first bend, the first back plate having a front surface lying in a back plate plane;

a first extension plate directly connected to the first back plate by a second bend, the first extension plate and the first back plate forming the second bend, the first extension plate being perpendicular relative to the base plane, the first extension plate interconnecting the channel-shaped portion with the first top plate and the first back plate;

a second top plate shaped and arranged to engage the top surface of the top plate of the frame wall;

a second back plate shaped and arranged to engage the vertical face of the top plate of the frame wall, the second back plate being directly connected to the second top plate by a third bend, the second back plate and the second top plate forming the third bend;

a second extension plate directly connected to the second back plate by a fourth bend, the second extension plate and the second back plate forming the fourth bend, the second extension plate being perpendicular relative to the base plane, the second extension plate interconnecting the channel-shaped portion with the second top plate and the second back plate; and a stop arranged to engage and space an end of the structural component from the back plate plane by a distance sized large enough to permit the two layers of ⅝-inch-thick drywall of the fire separation wall to be received between the end of the structural component and the back plate plane, the first and second extension plates being parallel to one another;

the first and second extension plates each having an inner face and an outer face, the inner faces of the first and second extension plates facing one another, the inner face of the first extension plate lying in a first inner face plane, the inner face of the second extension plate lying in a second inner face plane, the inner face of the first extension plate facing in a first direction toward the inner face of the second extension plate and the outer face of the first extension plate facing in a second direction that is opposite the first direction, the first back plate extending in the second direction from the second bend directly connecting the first back plate to the first extension plate, the first back plate and the first top plate being entirely disposed outward, in the second direction, of the first inner face plane, the second back plate extending in the first direction from the fourth bend directly connecting the second back plate to the second extension plate, the second back plate and the second top plate being entirely disposed outward, in the first direction, of the second inner face plane;

the first and second extension plates spacing the rear edge of the base of the channel-shaped portion from the back plate plane by a distance sized large enough to permit the two layers of ⅝-inch-thick drywall of the fire separation wall to be received between the rear edge of the base of the channel-shaped portion and the back plate plane.

19. The fire wall hanger of claim 18, wherein the channel-shaped portion includes first and second side plates extending upward from the base of the channel-shaped portion.

20. The fire wall hanger of claim 19, wherein the stop includes first and second panels extending toward each other.

21. The fire wall hanger of claim 20, wherein the first panel of the stop is directly connected to the first extension plate by a fifth bend and the second panel of the stop is directly connected to the second extension plate by a sixth bend, the first panel and the first extension plate forming the fifth bend, and the second panel and the second extension plate forming the sixth bend.

22. The fire wall hanger of claim 18, wherein the fire wall hanger is formed as one-piece of sheet metal and is free of welding.

* * * * *